United States Patent [19]

Baump et al.

[11] 4,148,012

[45] Apr. 3, 1979

[54] ACCESS CONTROL SYSTEM

[75] Inventors: Paul A. Baump, Canoga Park; Don Lyu, Los Angeles; Jerry T. Sain, Thousand Oaks; Richard A. Zbriger, Canoga Park, all of Calif.

[73] Assignee: Greer Hydraulics, Inc., Los Angeles, Calif.

[21] Appl. No.: 617,232

[22] Filed: Sep. 26, 1975

[51] Int. Cl.[2] ..... H04G 3/00

[52] U.S. Cl. ..... 340/149 A; 340/149 R; 340/147 MD

[58] Field of Search ..... 340/149 A, 149 R, 147 MD, 340/274 C; 179/2 CA; 235/61.7 B

[56] References Cited

U.S. PATENT DOCUMENTS

| | | | |
|---|---|---|---|
| 3,821,704 | 6/1974 | Sabsay | 340/149 A |
| 3,833,885 | 9/1974 | Baump | 340/149 A |
| 3,845,277 | 10/1974 | Voss | 340/149 A |
| 3,906,447 | 9/1975 | Crafton | 340/149 A |
| 3,931,497 | 1/1976 | Gentile | 340/149 A |
| 3,937,925 | 2/1976 | Boothroyd | 340/149 A |
| 3,956,615 | 5/1976 | Anderson | 340/149 A |

*Primary Examiner*—Harold I. Pitts
*Attorney, Agent, or Firm*—Paul L. Gardner

[57] ABSTRACT

An access control system for controlling and monitoring access to selected restricted areas and "alarm" conditions at such areas. The system comprises a central controller unit which repeatedly polls a number of remotely located reader terminals and alarm monitors. The reader terminals are adapted to receive and "read" magnetically encoded card keys issued to personnel and to sense "alarm" conditions at such areas. When a card key which has a proper facility code on it, is inserted into a card activated lock, a card reader at a reader terminal determines whether the card key is magnetically encoded so as to meet all entrance criteria stored in a memory of the central controller. If the card is properly encoded, access is granted to the cardholder at that location. If the card key does not have the proper facility code or does not meet the entrance criteria stored in the memory system of the central controller, access is denied and an alarm condition may be generated at the central controller to alert the person or persons monitoring the system. Alarm signals (e.g., fire, smoke, etc.) may also be transmitted to the central controller via any given reader terminal.

The central controller is programmed to provide a number of different access levels and time zones for controlling access of card holders at selected locations and times of day. Programming is also provided for operation of various peripheral equipment in the system.

A number of optional features are provided for expanding the capabilites of the system of the present invention and enhancing its advantages.

One such optional feature prevents a cardholder from passing his card back to another (unauthorized) person after the cardholder has entered the restricted area. This optional feature may also be used to determine and indicate whether a particular cardholder is on or off the premises.

Also optionally provided is a printer for interfacing with the controller to provide hard copies of all transactions and parameters and to list parameters recalled from the memory unit in the central controller of the system.

Other optional peripheral equipment is provided for simplifying installation of the system and enabling operation of reader terminals at relatively long distances from the central controller.

Terminal expanders may be used to simplify cabling requirements. Cables from a number (e.g., 16) of reader terminals may be connected to a terminal expander from which only a single cable is run to the central controller.

Modems may be used in the system to enable reader terminals to be operated at virtually unlimited distances from the central controller through telephone lines.

When the access control system of the present invention is initially installed, the central controller is programmed with all necessary parameters for all authorized card keys, reader terminals and alarm monitors.

23 Claims, 36 Drawing Figures

ACCESS CONTROL SYSTEM

CENTRAL CONTROLLER

CPU MODULE

PROM MODULE

RAM MODULE

CLOCK/PANEL CONTROL

PERIPHERAL ADDRESS DECODING

POWER UP SEQUENCE CONTROL

REAL TIME CLOCK

DISPLAY PANEL CONTROL

TEST READER CONTROL

READER INTERFACE MODULE SELECTION CIRCUIT

ANNUNCIATOR CONTROL

PERIPHERAL DATA BUFFER/DRIVER

MEMORY ARRAY MODULE

MEMORY CONTROL MODULE

KEYBOARD

FRONT PANEL DISPLAY

SINGLE DIGIT OPERATION

PRINTER INTERFACE

DATA BUFFER/DRIVERS

PRINTER CONTROL

POWER SYSTEM

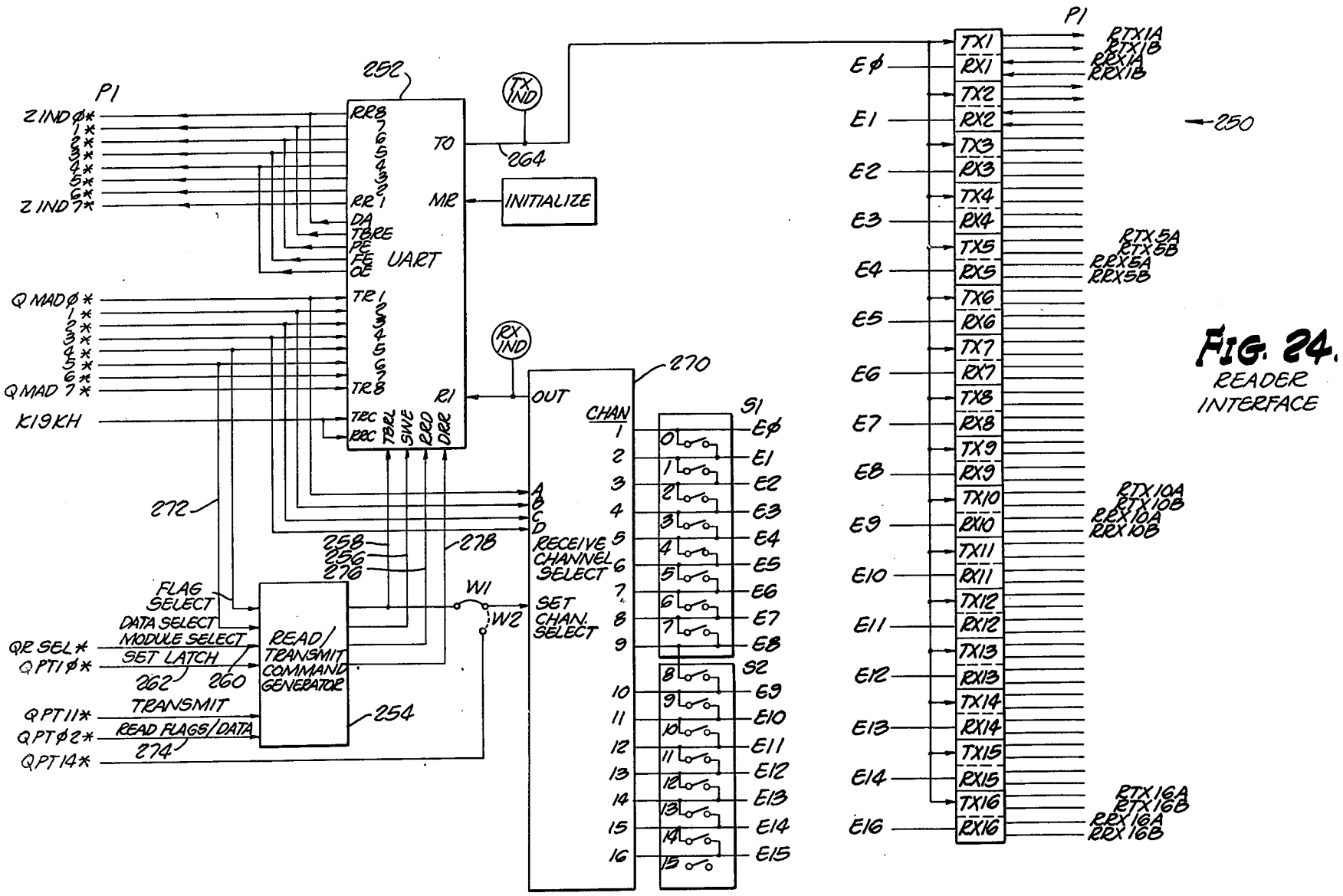
FIG. 24.
READER INTERFACE
250
P1
RTX1A
ETX1B
REX1A
REX1B
RTX5A
ETX5B
REX5A
REX5B
RTX10A
ETX10B
REX10A
REX10B
RTX16A
ETX16B
REX16A
REX16B
TX1
RX1
TX2
RX2
TX3
RX3
TX4
RX4
TX5
RX5
TX6
RX6
TX7
RX7
TX8
RX8
TX9
RX9
TX10
RX10
TX11
RX11
TX12
RX12
TX13
RX13
TX14
RX14
TX15
RX15
TX16
RX16
E0
E1
E2
E3
E4
E5
E6
E7
E8
E9
E10
E11
E12
E13
E14
E16
S1
S2
270
CHAN
OUT
RECEIVE CHANNEL SELECT
SET CHAN. SELECT
TX IND
264
INITIALIZE
RX IND
252
TO
MR
UART
RB
RR
DA
TBRE
PE
FE
OE
TR
TBRL
SWE
REO
DRE
TEC
REC
272
278
W1
W2
258
256
276
254
READ/TRANSMIT COMMAND GENERATOR
FLAG SELECT
DATA SELECT
MODULE SELECT
SET LATCH
262
260
TRANSMIT
READ FLAGS/DATA
274
Z IND 0*
Z IND 7*
Q MAD 0*
Q MAD 7*
K19KH
QR SEL*
QPT1 0*
QPT11*
QPT02*
QPT14*

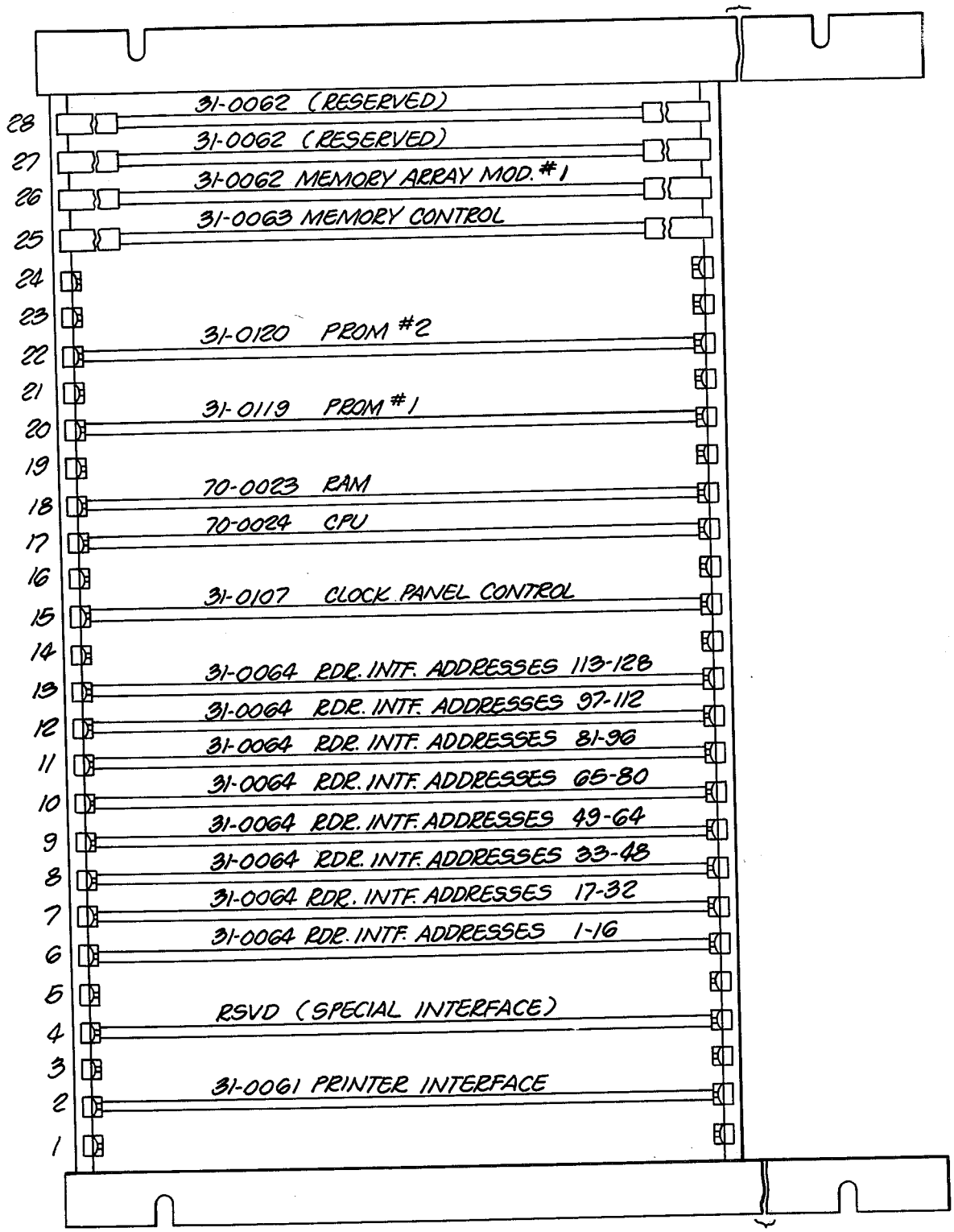
FIG. 25, PC BOARDS IN CONTROLLER

CARD READER

TERMINAL INTERFACE

TERMINAL EXPANDER

MODEM

ALARM MONITOR

READER/TERMINAL INTERFACE

FIG. 32. READERS TO CENTRAL CONTROLLER

REMOTE READERS WITH TELEPHONE INTERFACE

INTERCONNECTION DIAGRAM, ALARM MONITOR

FRONT PANEL

| FORMAT MODE | 11 | | 10 | | 9 | | 8 | | 7 | | 6 | | 5 | | 4 | | 3 | | 2 | | 1 | BYTE |
|---|---|---|---|---|---|---|---|---|---|---|---|---|---|---|---|---|---|---|---|---|---|---|
| | 21 | 20 | 19 | 18 | 17 | 16 | 15 | 14 | 13 | 12 | 11 | 10 | 9 | 8 | 7 | 6 | 5 | 4 | 3 | 2 | 1 | COLUMN |
| 1. | 1 | 2 | : | 3 | 4 | | | | X | | 1 | 2 | 3 | | X | | | | | | | |
| | | | | | | | | | JULIAN DATE | | | | | | | | | | | | | |
| 2. | 1 | 2 | : | 3 | 4 | | 1 | 2 | 3. | 4. | *1 | 2 | 3 | | 6 | 5 | 4 | 3 | 2 | . | 1 | |
| | | | | | | | | | | | ACCS LEVEL | | | | CARD# | | | | | ISSUE | | |
| 3. | 1 | 2 | : | 3 | 4 | | 1 | 2 | 3 | | – | – | 1 | – | – | 4 | – | – | – | 8 | | |
| | | | | | | | | | | | | | ALARMS | | | | | | | | | |
| 4. | 1 | 2 | : | 3 | 4 | | 1 | 2 | 3. | 0. | | | | | | | | | | | | |
| 5. | 1 | 2 | : | 3 | 4 | | 1 | 2 | 3 | .1. | | | | | | | | | | | | |
| | | TIME-READER | | | | | | | | | | | | | | | | | | | | |
| 6. | 6 | 5 | 4 | 3 | 2 | . | 1 | | 1 | 2 | 3 | | 7 | | – | | IN | | | K | | |
| | | CARD# | | | | | ISSUE | | ACCS LEVEL | | | | TIME ZONE | | VOID | | ENT EXIT | | | FORMAT IDENT. | | |
| 7. | | | | | 1 | 2 | 3 | | | | | | 7 | | – | | | R | | | | |
| | | | | | | READER | | | | | | | TIME ZONE | | VOID | | | FORMAT IDENT. | | | | |
| 8. | | | | | 1 | 2 | 3 | | 4 | 5 | 6 | | | | | | | | | | V | |
| | | | TERMINALS ON FOLLOWING LINES | | | | | | ACCS LEVEL | | | | | | | | | | FORMAT IDENT. | | | |
| 9. | | | 7 | | | | 5 | | | | 1 | 2 | : | 3 | 4 | | 1 | 2 | : | 3 | 5 | |
| | | TIME ZONE | | | | | DAY OF WEEK | | | | | | START TIME | | | | | | STOP TIME | | | |
| 10. | + | + | + | + | + | + | + | + | + | + | + | + | + | + | + | + | + | + | + | + | + | |

* VOID REASON CODE WITH DECIMALS ONLY WITH MODE 2 IN RED (VOID CARD)

FIG. 36.

PRINTER OUTPUT FORMATS

ACCESS CONTROL SYSTEM

FIELD, BACKGROUND AND OBJECTS OF THE INVENTION

The present invention relates to access control systems for controlling and monitoring access to remote, restricted areas and for monitoring alarm conditions (e.g., fire, smoke, vandalism, etc.) in such areas.

While various types of systems for controlling and monitoring access and alarm conditions at restricted remote areas have been devised prior to the advent of the present invention, none of these systems has been entirely effective or efficient.

It is an object of the present invention to provide an improved access control system which is flexible in permitting the user to expand or modify the system to meet new requirements as they arise.

A further object is the provision of such a system which is relatively inexpensive and yet reliable, efficient and effective in operation.

An additional object of the present invention is to provide an access control system which permits the simple replacement of lost or stolen cards.

A further object of the present invention is to provide an access control system which will not be effected by temporary power loss.

Still another object of the present invention is to provide an access control system which does not require a maximum number by storing capacity.

These and other advantages of the present invention will be evident by the following description read in association with the attached drawings.

BRIEF DESCRIPTION OF THE DRAWINGS

In the drawings:

FIG. 24 is a block diagram of the reader interface circuitry of the access control system of the present invention.

FIG. 25 is a diagram showing the locations of various printed and circuit boards in the card rack of the access control system of the present invention.

FIG. 36 is a chart of the output formats of a printer which is interfaced with the access control system of the present invention.

DETAILED DESCRIPTION OF A PREFERRED EMBODIMENT

Figure 1:
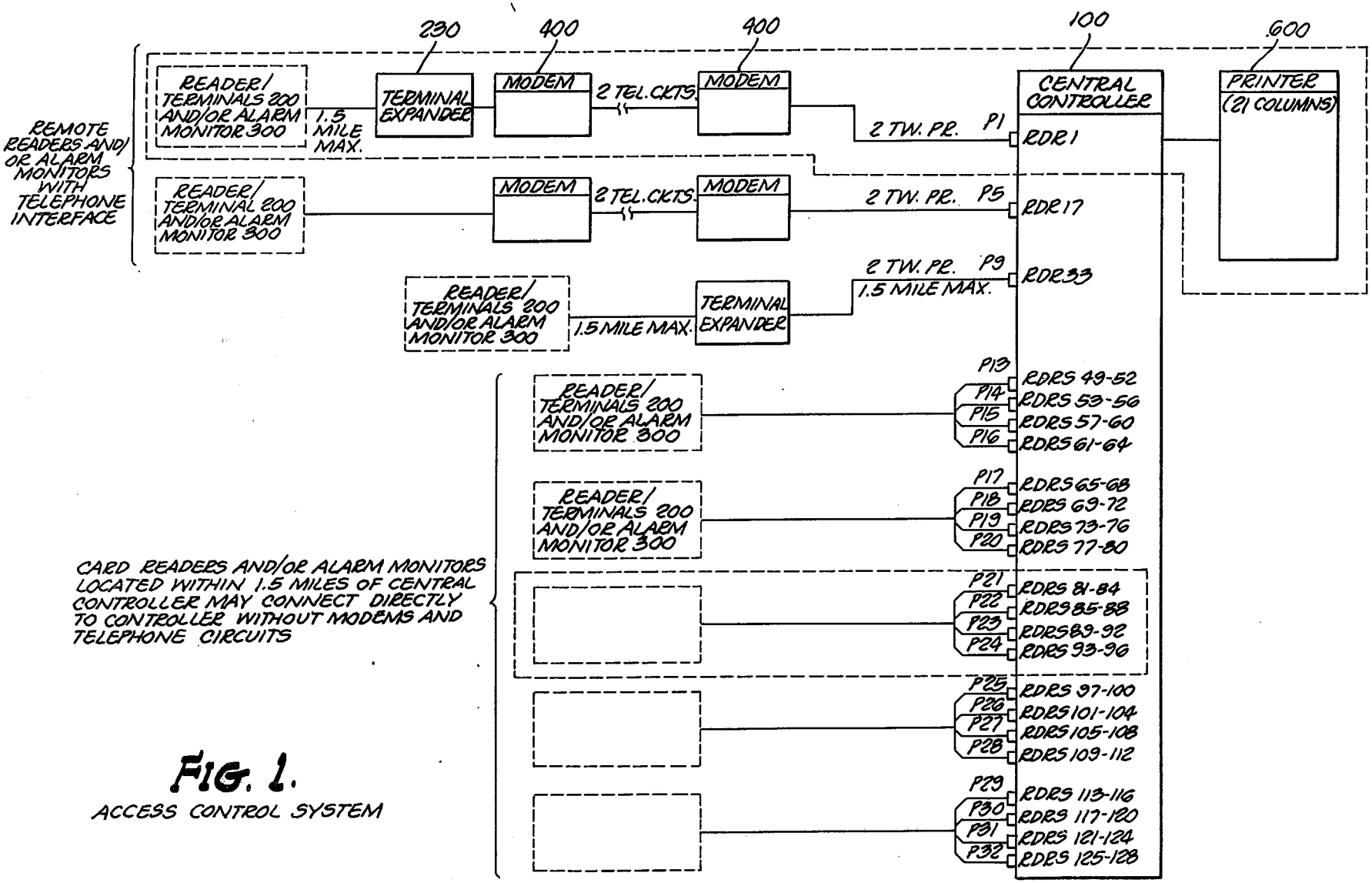
FIG. 1 is a block diagram of the access control system of the present invention.
Figure 32:
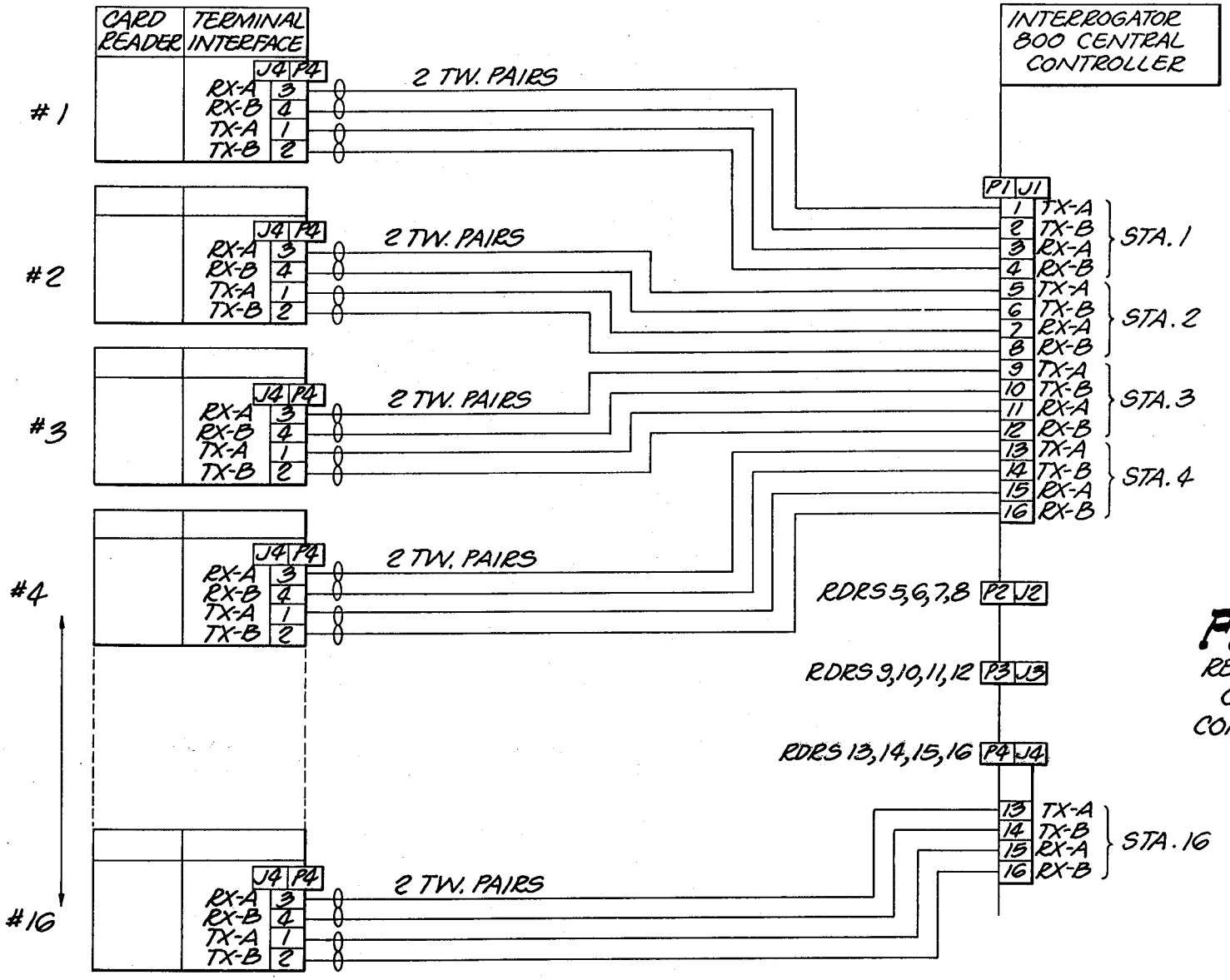
FIG. 32 is a diagram showing the interconnection of the remotely located card reader-terminal interfaces in the central controller portion (FIG. 2) of the access control system of the present invention.
Figure 33:
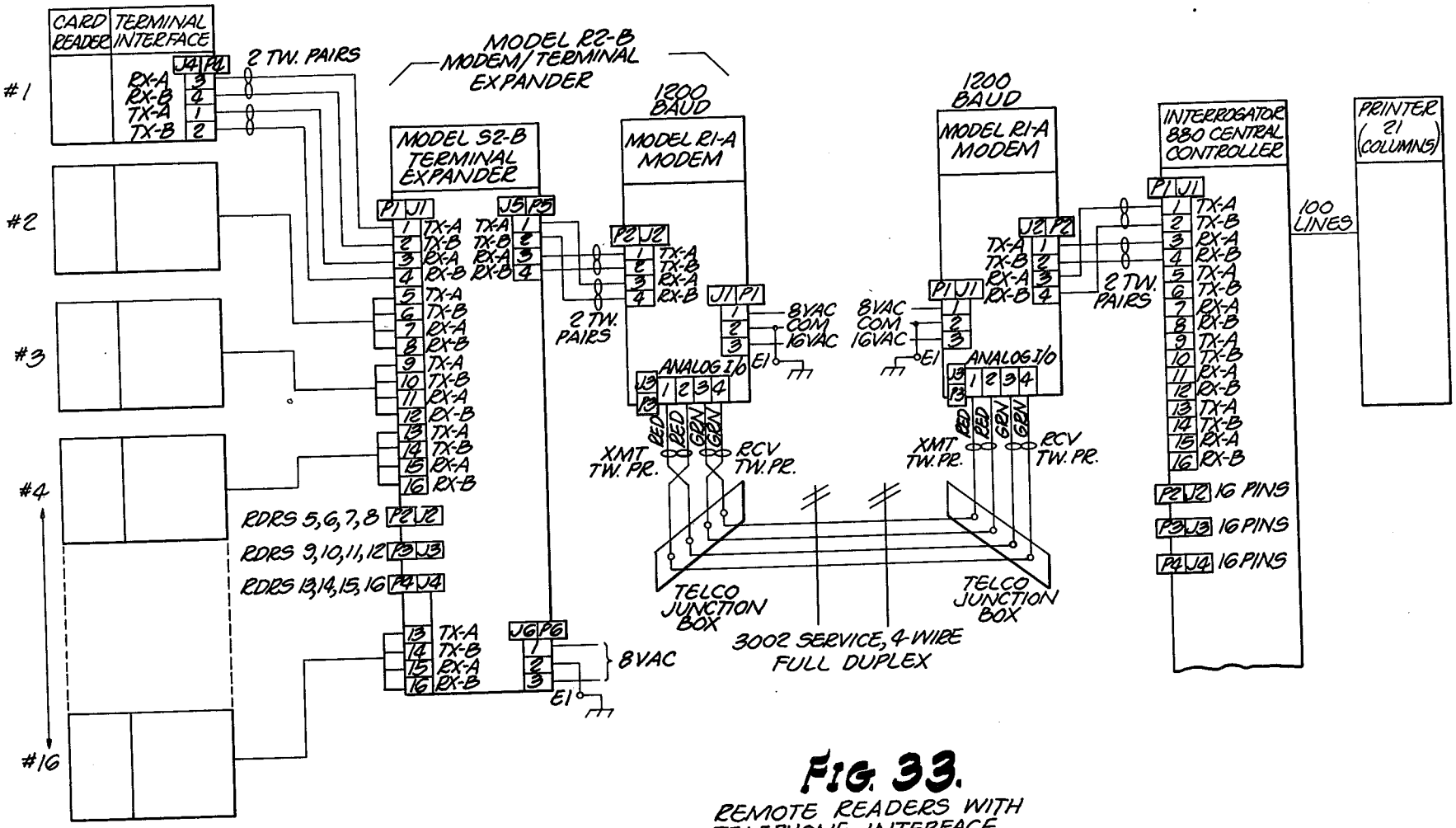
FIG. 33 is a diagram of the interconnection circuitry between the remotely located card readers and the central controller via telephone wire interface in the access control system of the present invention.

As best shown in FIGS. 1 and 32, the preferred embodiment of the access control system of the present invention shown and described herein includes a central controller unit 100 which polls, monitors and controls a number of remotely located reader terminals 200 and associated equipment (e.g., door locks, turnstiles, etc.) and/or remotely located alarm monitors 300 in designated areas to which access is to be controlled and alarm conditions are to be monitored.

Each reader terminal 200 is composed of two units: (1) a card reader 210 (shown in FIG. 26) and (2) a terminal interface unit 200 (shown in FIG. 27). The card reader 210 is preferably mounted on a wall surface outside its respective restricted area and near the entry barrier (e.g. door) at the area. The terminal interface unit 220 is preferably installed inside the restricted area. A multiwire cable, having a connector at each end, electrically connects the reader 210 and the terminal interface unit 220.

Figure 26:
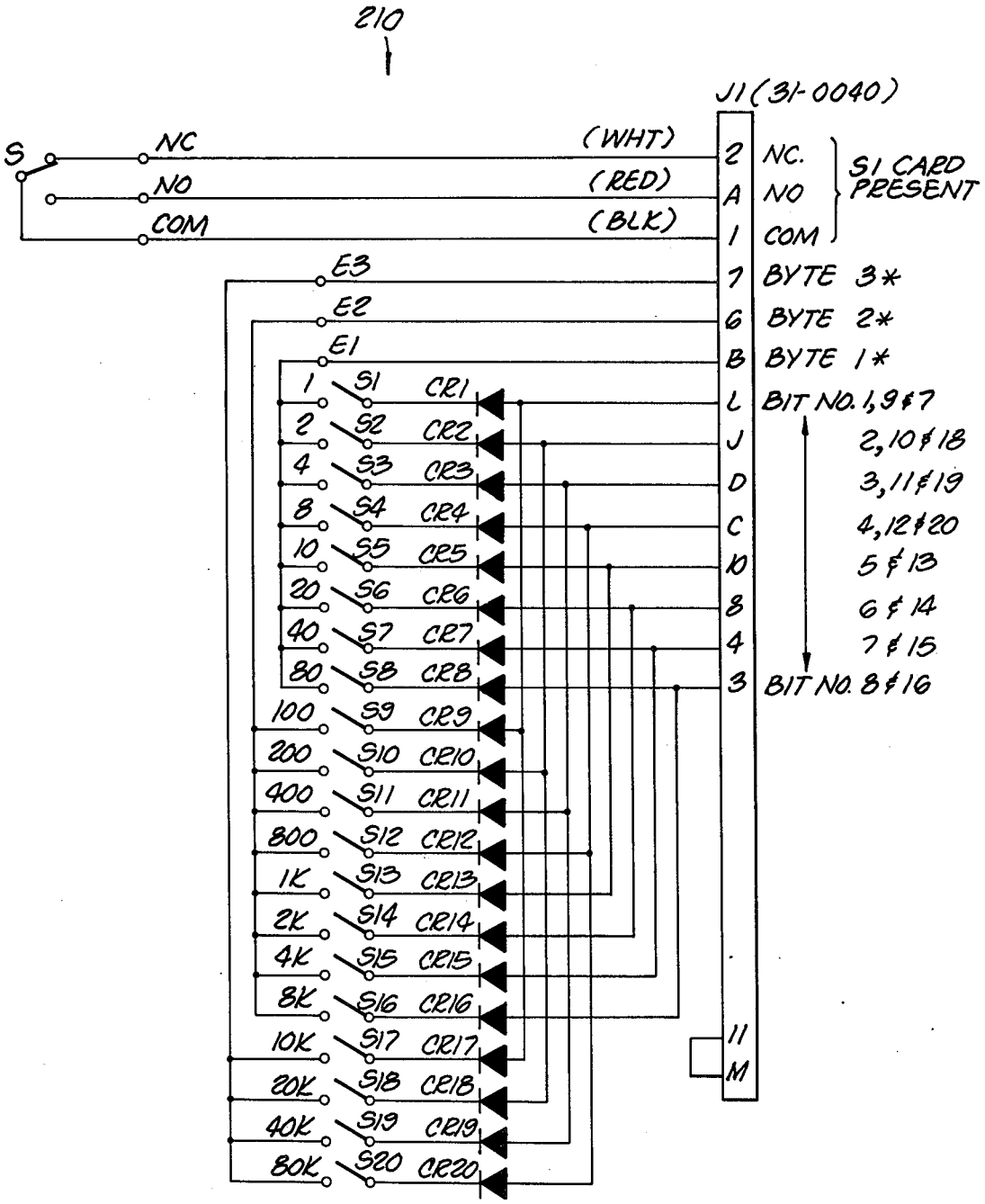
FIG. 26 is a schematic diagram of the reader assembly circuitry of the peripheral equipment of the access control system of the present invention, which assembly utilized the multi byte enable concept.

Each card reader 210, FIG. 26, (which may be, for example, of the general type shown in U.S. Pat. No. 3,581,030) utilizes a magnetic lock which prevents an improperly coded or false card from fully entering the card reader. Only a correctly coded card key, matching the coding of a matrix code in the lock, can fully enter and actuate a switch ("S", FIG. 26). This first code is referred to the facility code and may be changed customer to customer of this system. The closing of this switch "S" enables the reader terminal 200 to provide a card identification number to the central controller 100 through an interconnection system when that reader terminal 200 is polled by the central controller 100. The card key contains a second magnetically encoded identification number which is "read" by the card reader 210 when the card is fully inserted.

Figure 27:
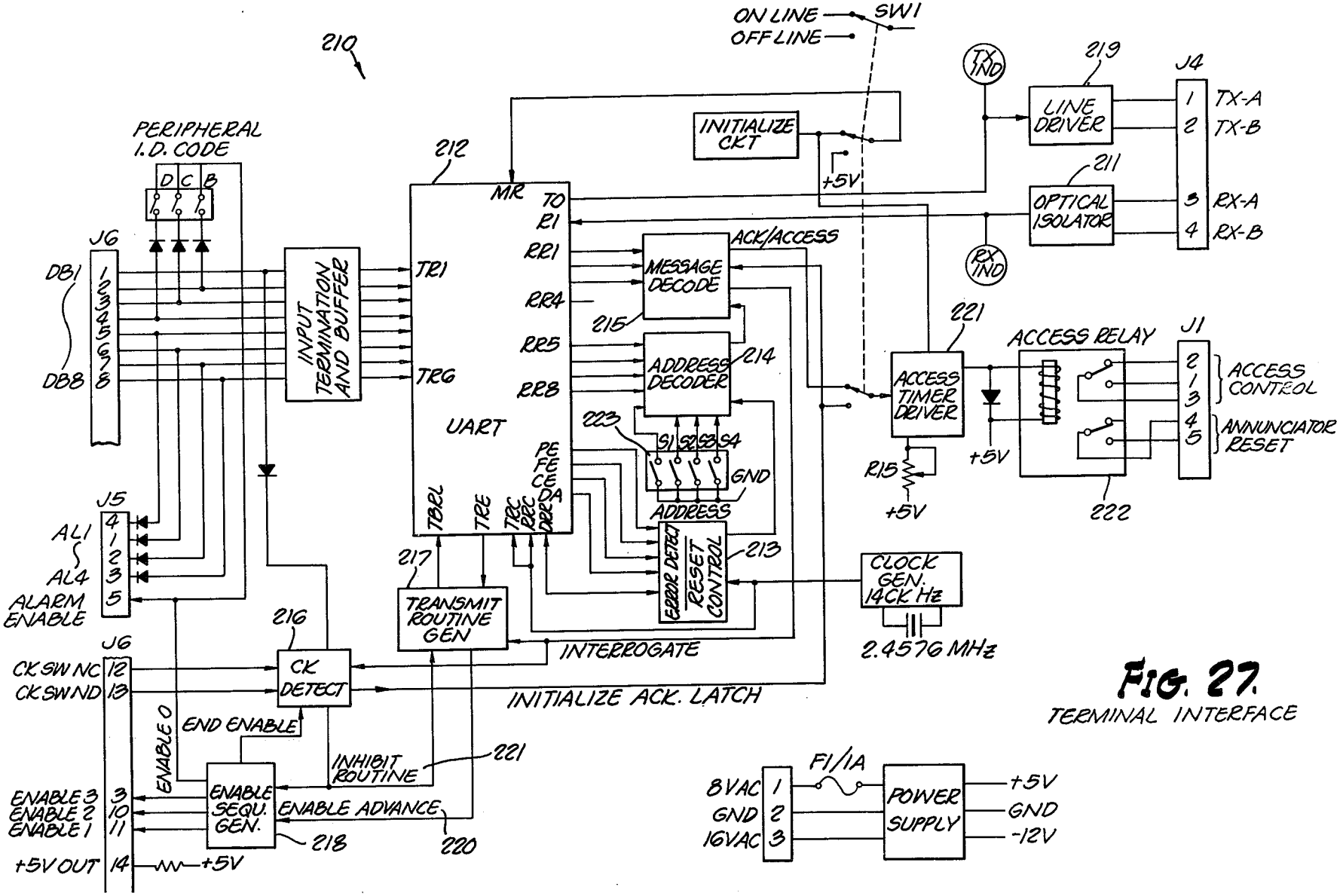
FIG. 27 is a block diagram of the terminal interface circuitry of the access control system of the present invention.

Each terminal interface 220, FIG. 27, converts parallel data from the card reader 210 to serial form for use with the central controller 100. The terminal interface 220 receives transmissions from the central controller 100 and transmits information back to the controller. The terminal interface 220 also monitors the status of four alarm inputs to the terminal interface and provides this information to the central controller 100 with each polling. The alarm inputs to the terminal interface are not to be confused with the alarm monitors 300 which are separate from the reader terminals and which may be installed at any desired location in place of or in addition to a reader terminal.

An access relay 222 (FIG. 27) in each terminal interface 220 is actuated to enable barrier (e.g., door strike) operation when an access signal is received from the central controller 100. Access time is adjustable within the terminal interface 220 from one to greater than 10 seconds. A separate emergency battery and charger unit may be incorporated to provide standing power in the event of power failure. All critical circuitry is contained within the terminal interface 220 so that tampering with the associated card reader 210 cannot result in access being granted.

The transmit-receive rate of the terminal interface 220 is 0–1200 bps (bits per second). Two twisted pairs of wires connect the terminal interface 220 and the central controller 100. Connections may be made in any of several methods. Direct connections may be made in any of several methods. Direct connections may be made upt to a maximum of, for example 1.5 miles. Connections may also be made through modems 400 (see FIG. 1; modems are described in detail hereinafter) and telephone lines for unlimited distances.

When a particular reader terminal 220 is polled (e.g., by a polling signal) it will always respond. If no card key is in the reader 210 at that instant, the terminal interface 220 responds with an 8-bit word which provides the peripheral identification code for that particular terminal and the status of the four alarm inputs to the terminal interface 220 to the central controller.

If a card key is in use at the moment the reader terminal 200 is polled, the terminal responds with a transmission of four 8-bit words and then immediately repeats the transmission. The four words provide the reader terminal peripheral identification code, the alarm status, and the card identification number to the central controller 100. The central controller verifies that both transmissions are identical and also checks for card data validity. When all data checks out, the central controller 100 transmits a two-word access routine; the first word is for acknowledgement and the second word is to grant access. The access relay 222 (FIG. 27) in the terminal interface is then actuated and the access timer is started. The door may now be opened.

In response to an access signal, the reader terminal 200 will activate the access relay 222 (FIG. 27), for a period determined by a variable resistor. The relay and variable resistor are located on the terminal interface module, as described more fully hereinafter in connection with a detailed description of the terminal interface 200 (shown in detail in FIG. 27).

Figure 34:
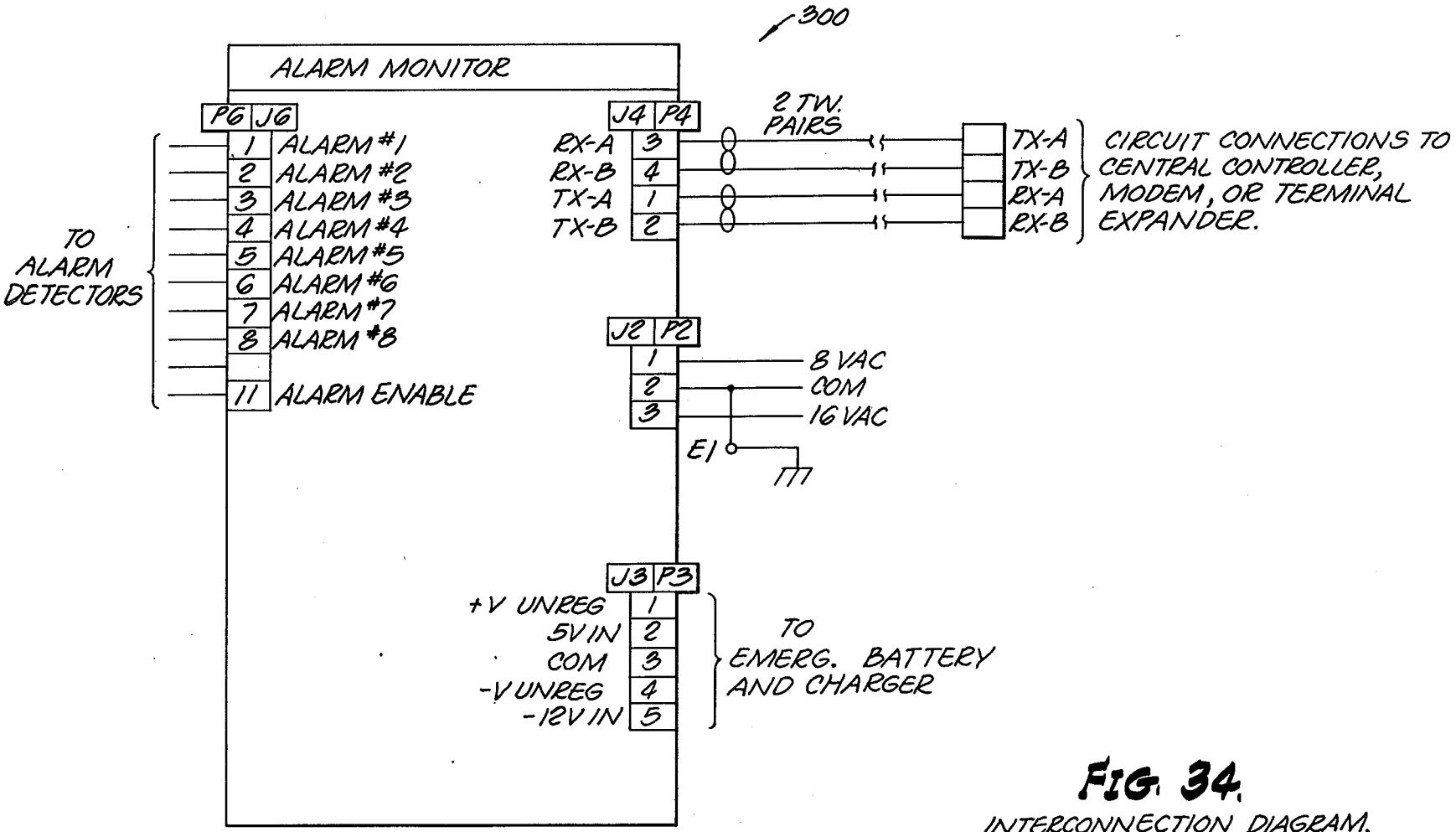
FIG. 34 is a diagram of the interconnection of the alarm monitors of the access control system of the present invention.

Polling of the reader terminals 200 by the central controller 100 also monitors the status of alarm monitors 300 (described in detail hereinafter in conjunction with FIGS. 30 and 34) and transmits the conditions sensed by the monitors to the central controller 100.

It will thus be appreciated that the central controller 100 of the system of the present invention continuously polls all reader terminals 200 and alarm monitors 300 to do the following:

(1) verify that all reader terminals 200 and alarm monitors are functioning properly;

(2) determine whether any card keys are presently in use (i.e., inserted at any of the reader terminals); and (3) detect any alarm signals received from any alarm monitor 300 or reader terminal interface 200.

TIME ZONES. Eight time zones (e.g., numbered from 1 to 8) are programmed into a memory array (FIG. 2; described in detail hereinafter) by the keyboard. Each time zone preferably comprises a seven day time period which can be programmed with one start time and one stop time per day. The seven day time period is generated by programming start and stop times into the memory array 550. If the start time (e.g., 20 hours on 8 p.m.) is greater than the stop time (e.g., 4 hours or 4 a.m.), it is assumed that the stop time occurs during the following day. The limits of each time zone are compared with the time generated from an actual or "real" time clock to determine whether a cardholder is entitled to enter during that particular time period when his card is presented at a particular reader terminal. The time zones are used to limit the time of access of any card holder into a restricted area on facility.

ACCESS LEVELS. The use of access levels provides means for controlling access to certain restricted areas or facilities via terminals or groups of terminals. The use of access levels is somewhat analogous to mastering and sub-mastering systems employed in conjunction with mechanical keys. An access level is assigned to a group of reader terminals, and specific terminals are designated as valid access points for personnel having cards assigned to that particular group. By assigning terminals to access levels and access levels to card holders, the movement of individuals within a facility can be controlled. For example, card holder 1 may be permitted access to doors 1, 3 and 6, while card holder 2 may be permitted access to doors 1, 3 and 7. 128 combinations of access levels (numbered 1 to 128) are provided. A given terminal may be assigned to as many access levels as desired, or as many terminals as desired may be assigned to an access level. A card key is assigned to only one access level.

CARD KEY NUMBERS. Each card key used in the preferred embodiment of the system of the present invention has a unique number encoded thereon to identify the card holder. Any number of card keys (e.g., 62,000) may be used and assigned a unique number (e.g., from 1 to 62,000). In addition, each card is provided with an issue level code which allows cards to be reissued seven times, while still maintaining the basic card number, this is maintained by a three bit code. This feature protects against unauthorized individuals from finding and using lost cards. Issue levels are numbered seriatim, e.g., from 0 to 7. In case a given card is lost, a second (or subsequent) issue level may be programmed into the memory array 550 (FIGS. 2 and 15) of the central controller. This feature also prevents the requirement of removing a given numbered code from the system memory, thus facilitating book keeping records. For example, if card number 6429 were lost or stolen, without the issue levels, the number 6429 would have to be removed from the memory and replaced by a nonsequential number. By the use of the issue level, the issue level may be changed and still maintain code number 6429 in the memory. An individual also need not have a new basic number assigned to him in the event of a lost or stolen card.

ENTRY/EXIT OPTION. The entry/exit feature optionally provided in the access control system of the present invention prevents the "passing back" of card keys to enable access by unauthorized individuals. After entering the restricted area, the card holder is required to use an exit reader before the card may be used to re-enter through an entry reader. This feature has no affect on the use of cards in readers that are not of the entry/exit type. This is accomplished by suitably programming the memory array 550 (FIGS. 2 and 15) in the central controller 100.

At any time that a card key is present at any reader terminal, the time and the location of the attempted usage of the card key is compared with information stored in the memory array 550 in the central controller 100. Access to a restricted area is granted to a card holder only when the following conditions are satisfied:

(1) the card key has a valid number;
(2) the card key is valid
  (a) for the predetermined time period (i.e., time zone) during which access is sought, and
  (b) for the particular restricted area (i.e., access level) where access is sought;
(3) the restricted area where access is being sought is accessible during the time period when access is sought;
(4) the issue level of the card is proper; and
(5) the entry/exit status is proper.

When all of the foregoing conditions have been satisfied, a signal is sent from the central controller 100 to the particular reader terminal 200 where the card has been presented to enable the user to enter the restricted area.

Figure 35:
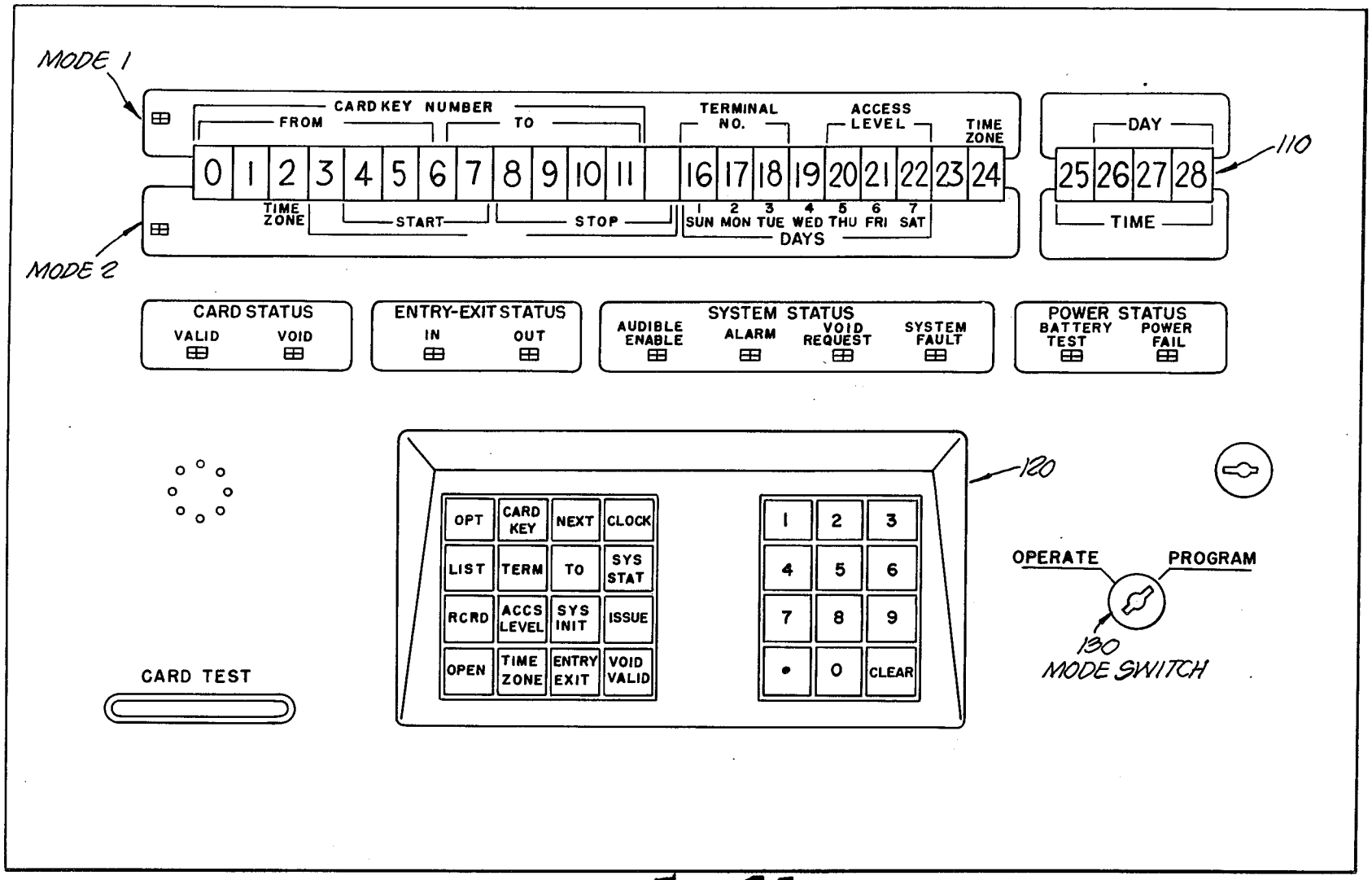
FIG. 35 is a front elevation view of the control panel of the access control system of the present invention.

If the proper facility code is present and access to the particular restricted area is not granted, for any reason, an indicator light (or other indicia) as illuminated (or otherwise displayed) on the display panel 110 (FIG. 35) of the central controller 100. If the person monitoring the central controller 100 desires further information about the attempted access, he may obtain such information by making an appropriate entry on the keyboard 120 (FIG. 35) of the central controller to display all data pertinent to the attempted entry on the display panel 110 (FIG. 35).

To assist the operator of the central controller, all parameters which are programmed into the memory array 550 (FIG. 2) of the central controller 100 may be recalled for visual display without risk to (i.e., without danger of destroying) the stored information. Additionally, data about the most recent cards presented in the reader terminals 200 is stored in memory and may be recalled for visual display showing all data pertinent to the nature of each such cards.

Figure 28:
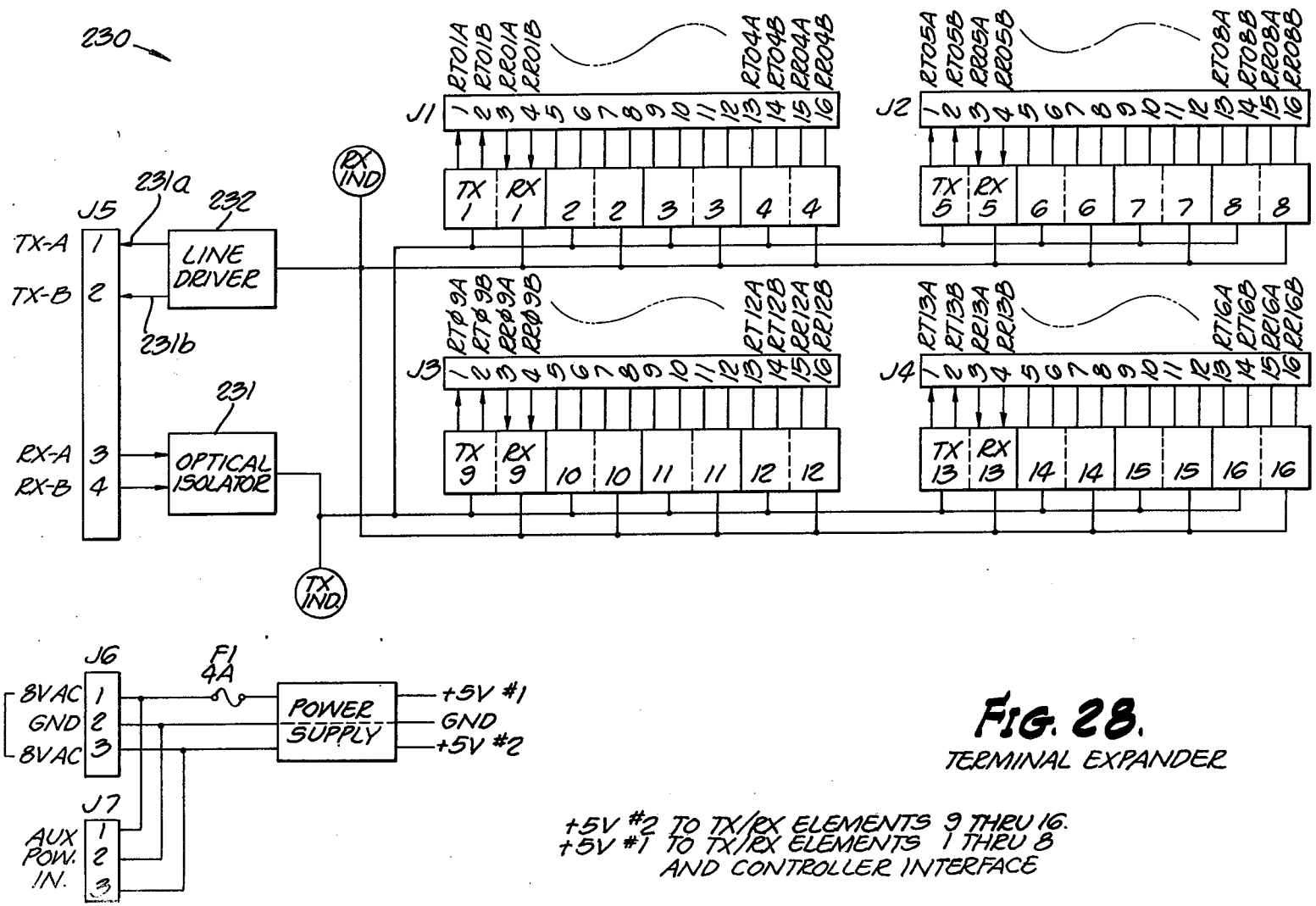
FIG. 28 is a block diagram of the terminal expander circuitry of the access control system of the present invention.

As best shown in FIGS. 1 and 28, terminal expanders 230 are provided for interfacing with a desired number (e.g. 16) reader terminals 200 and/or alarm monitors 300. Each terminal expander 230 contains up to 16 individual receiver optical isolators and dual line drivers to interface with the reader terminals 200. Each terminal expander 230 includes a common receiver optical circuit 231 (FIG. 28) and a common dual line driver circuit 232 to interface with the central controller 100. Each reader terminal 200 is connected to a terminal expander 230 by two twisted pairs of wires however, only two pairs of wires connects from the terminal expander to the central controller 100. As the central controller 100 polls all addresses, the interrogate signal from the controller enters the terminal expander and is transmitted to all reader terminals 20 and/or alarm monitors 300 connected to the terminal expander. When the polling address matches the address of a reader terminal or alarm monitor which is connected to a terminal expander a signal is returned from the reader terminal 200 or alarm monitor 300 through the terminal expander 230 to the central controller 100.

Figure 29:
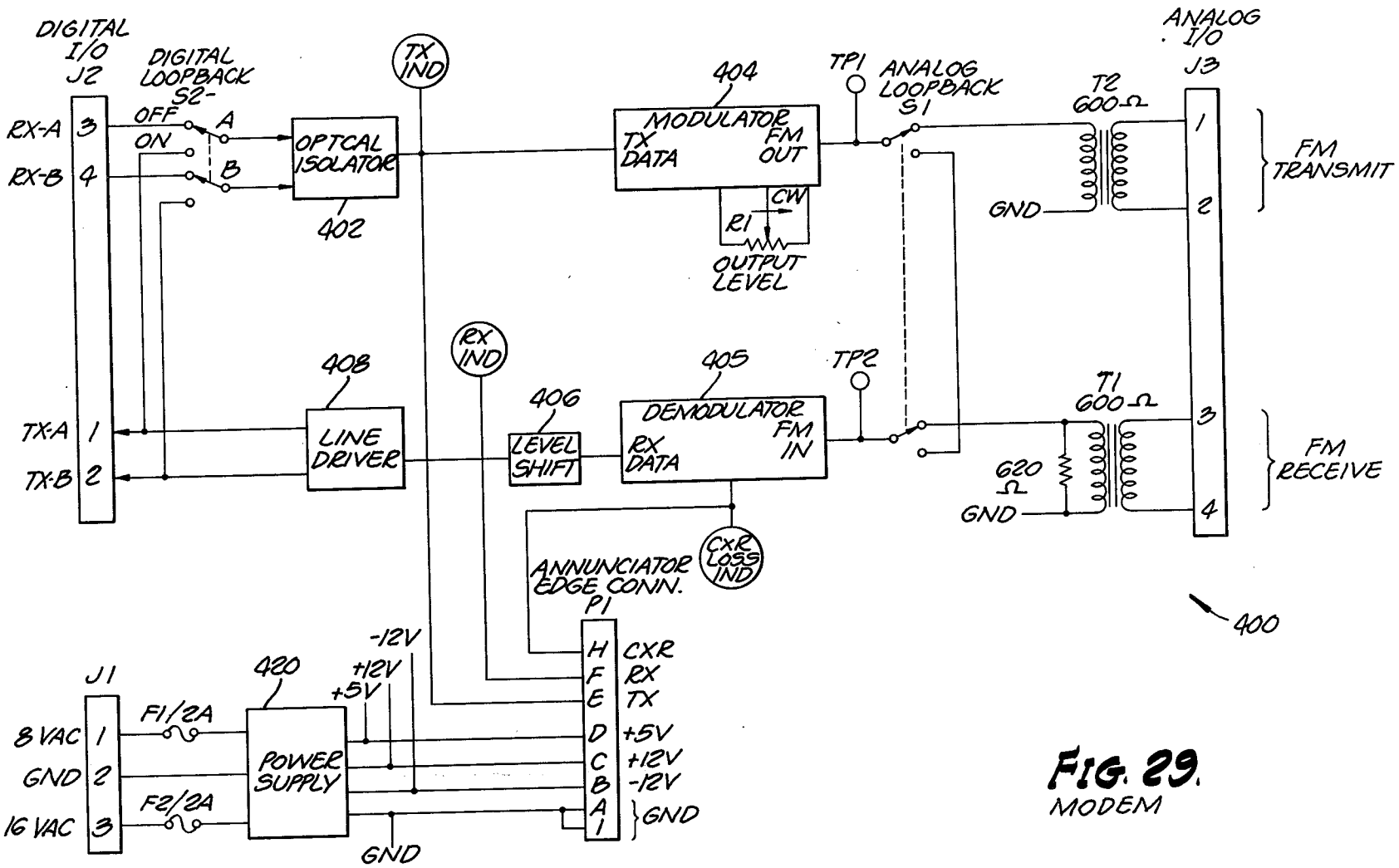
FIG. 29 is a block diagram of the modem circuitry utilized in the access control system of the present invention.

As best shown in FIGS. 1 and 29, the access control system of the present invention also optionally includes modems 400 for performing two types of signal conversions. When a digital signal is received (e.g., from the central controller, a reader terminal or an alarm monitor), the modem 400 converts the signal to a frequency shift keying (FSK) signal for transmission over a telephone circuit line. When a FSK signal is received from the telephone circuit, the modem 400 converts the signal back to digital form.

The access control system of the present invention may also optionally be provided with a modem/terminal expander (not shown) which is a combination of the previously described modem 400 and the previously described terminal expander 230.

The alarm monitors 300 (FIGS. 30 and 34) of the access control system of the present invention may include "door-open" detectors, smoke detectors, fire detectors, etc. As the central controller 100 pools all addresses (i.e., reader terminals and alarm monitors) in the system, all alarm monitors 300 in the system respond with an indication of the status of the alarm inputs. A change in the condition of an alarm detector results in an audible alarm at the central controller 100, a display of the alarm monitor address where the change occurred, and, if a printer 600 is in use, a hard copy of the transaction will be printed (preferably in a selected color, such as red).

Up to eight alarm detectors may be connected to each alarm monitor 300 and/or four to each reader terminal 200 and the status of each alarm detector is transmitted to the micro-processor unit 500 (FIG. 2; described hereinafter) of the central controller 100 along with data read from the card key. (See FIGS. 30 and 34) Invalid or unauthorized access requests (e.g., invalid or voided card keys) are detected during the normal terminal polling operation of the micro-processor unit 500 and the controller operator is alerted.

The access control system of the present invention is also provided with a system fault indicator to indicate that a reader terminal has not responded properly after being polled by the central controller a number of times (e.g., after four cycles). When this occurs, a system fault indication is generated and the reader terminal is identified to the operator.

Fault and alarm conditions are stored in a buffer (e.g., RAM 530), when they occur, for future examination by the operator and their presence is indicated on the front panel of the central controller. Alarm and fault conditions may also be printed with the time of their occurrences and an audible alarm may be sounded.

The micro-processor unit 500 (FIG. 2; described in detail hereinafter) of the central controller also continuously scans the keyboard FIG. 35 of the central controller 100 to detect when a key is depressed. When a depressed key is sensed, it is acknowledged to the operator by a change on the front panel display of the controller. After a complete key sequence has been entered by the operator, the operation is performed and acknowledged.

The front panel display 110 on the central controller 100 is employed to inform the operator of both system conditions and data stored in the memory units of the controller. Card key transactions and alarm and fault conditions may be recalled by the operator for display. Prior to entering data into the system memory, all information is displayed for operator verification. At any time, the operator can display any information stored in memory. The most recent card transactions or alarm transactions (e.g., the last 64) may be recalled from the buffer memory (e.g., RAM 530) for display on the front panel.

All alarm and card key transactions may be transmitted to a printer for a hard copy. The printer may be disabled, may print "void card" and/or alarm transactions only, or may print all transactions. The printer is in the preferred embodiment buffered by using the random access memory (RAM) 530 to store transactions until they can be printed. System parameters stored in memory may be transmitted to the printer via keyboard commands.

The access control system of the present invention also has the capability of transmitting information to other storage devices such as magnetic tape. These optional interfaces may be added to the system at any desired time. When these optional interfaces are added to the system, the PROM 510,520 program may require change to enable this capability.

All processing is time shared to allow reader terminal polling to continue while other processing functions are performed. Peripheral equipment which appear busy or do not respond to the polling operation will not cause the system to stop functioning.

Power interrupts do not affect the system programming or require any operator action to resume normal operation. Battery power is provided to maintain the "real" time clock and the card key data memory and can be used to store operator programmed data. In the absence of maintaining the clock on "real" time, the processor would erroneously refuse access to cards not encoded with the "real" time and permitting access to cards matching the time of the clock. When prime power is applied, a processor interrupt is automatically generated to allow for an initialization or power interrupt software routine.

The central processor unit module 505 (FIG. 2) of the access control system of the present invention serves as the central processing unit of the central controller portion 100 of the system, and all inputs and outputs thereto and therefrom are TTL (Transistor Transistor Logic) compatible.

Figure 2:
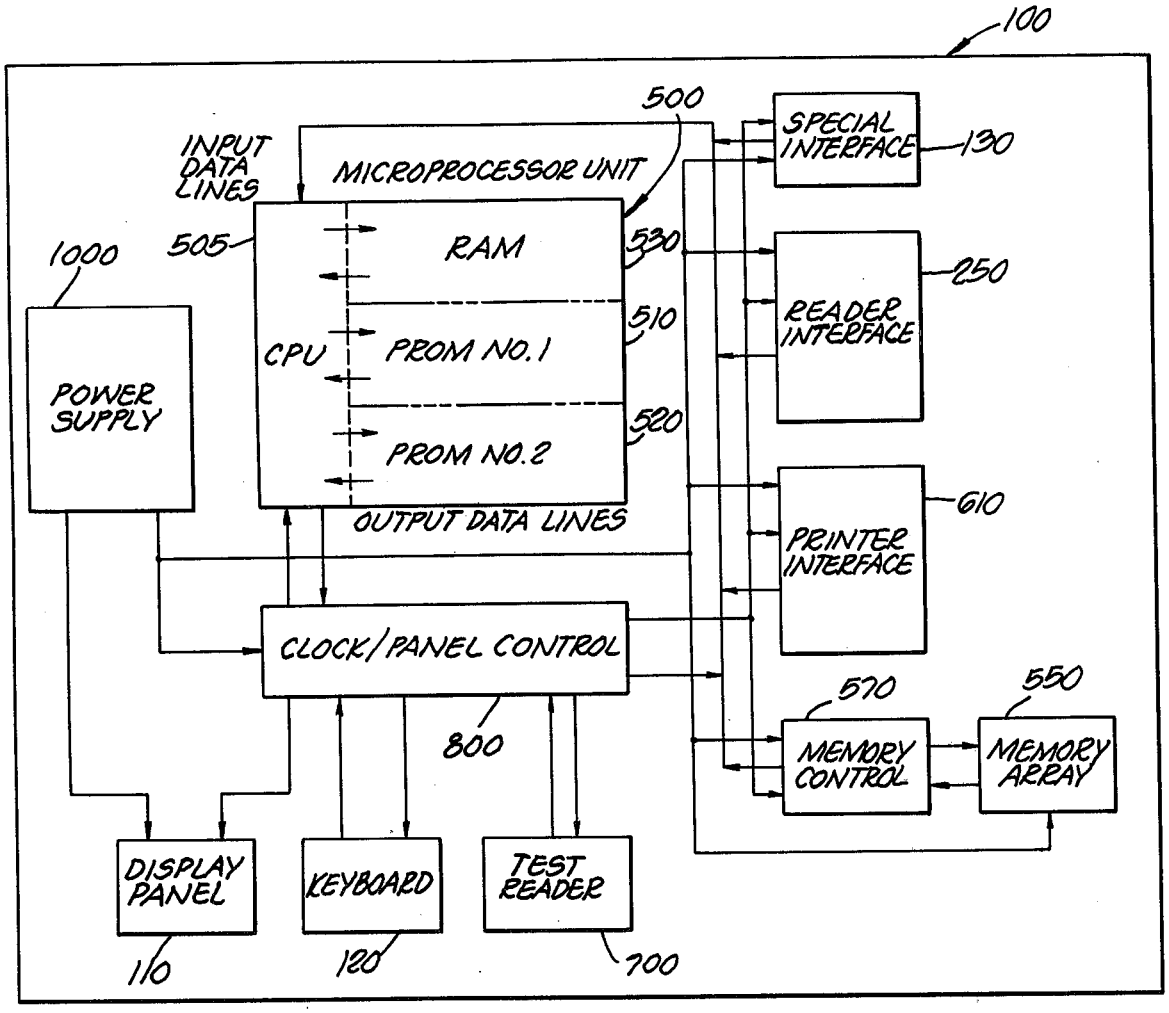
FIG. 2 is a block diagram of the central controller portion of the access control system of the present invention.

As best shown in FIG. 2, the central controller 100 of the access control system of the present invention includes a micro-processor unit 500 comprising a central processor unit (CPU) module 505, two programmable read only memory (PROM) modules 510 and 520 which store the software program instructions, a random access memory (RAM) module 530 which is used by the central processor unit module 505 for temporary storage of data (for example, up to more than 1,000 words of memory).

Figure 3:
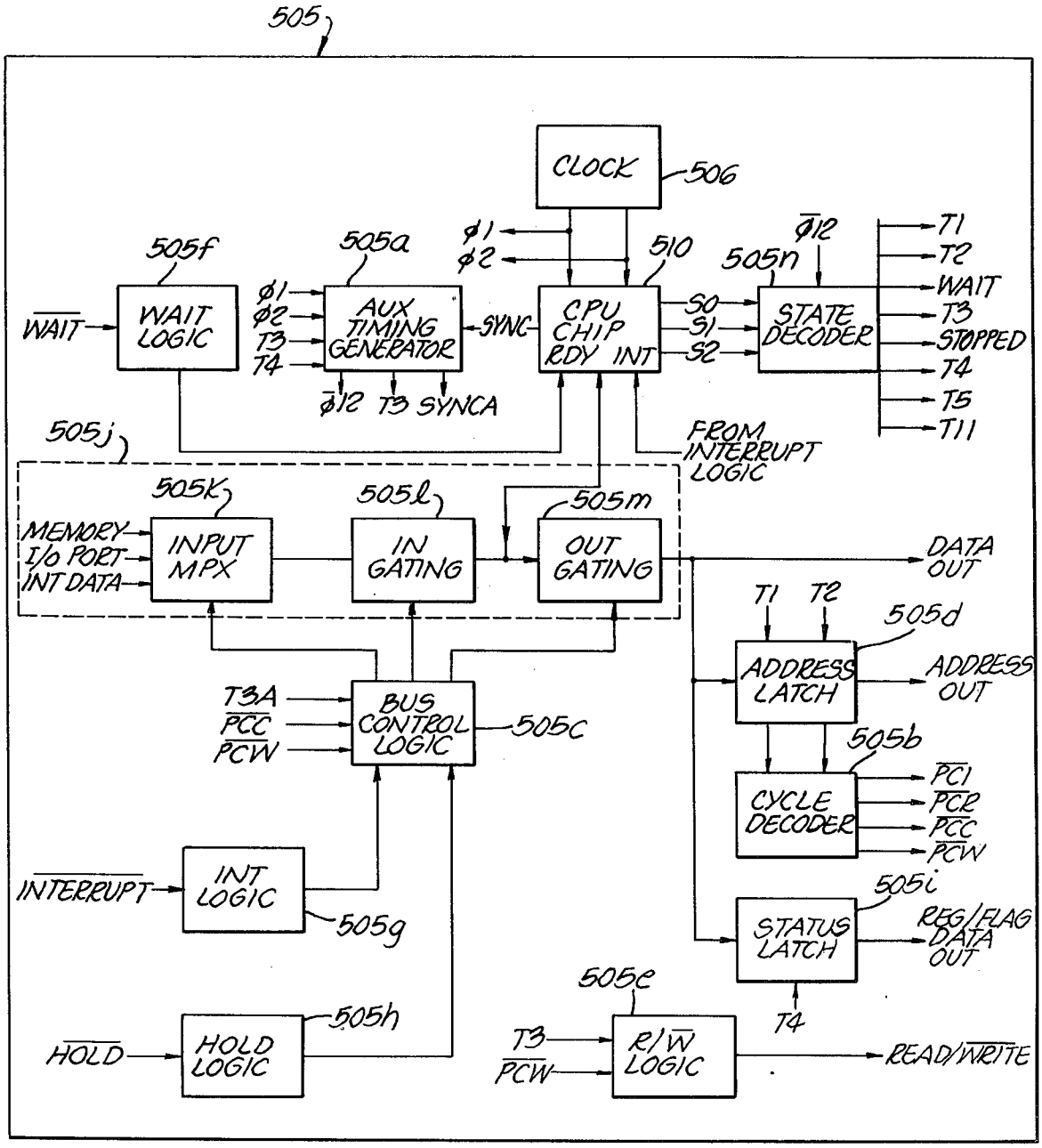
FIG. 3 is a block diagram of the central processor unit of the central controller of the access control system of the present invention.

As best shown in FIG. 3 the basic capabilities of the central processing unit 505 are obtained through the use of a large scale integrated monolithic CPU chip 515. This chip processor 515 (1) provides 48 command instructions, (2) accesses up to 16,384 memory bytes from the programmable read only memories 510 and 520 and the random access memory 530 directly, (3) has seven working index registers, (4) has a seven level subroutine stack, and (5) has interrupt handling capability.

As best shown in FIG. 3, the CPU chip 515 is connected to a crystal controller clock oscillator 506 which provides a stable timing reference for all circuitry in the system. The use of the monlithic chip processor and an 800 KHz clock permits a basic processor cycle time of approximately 12.5 microseconds.

Memory interface and control logic are included on the central processor unit module 505. The module contains a latched fourteen-bit address bus, and an eight-bit output bus for data to memory. The CPU module 505 generates signals which identify a memory read, a memory write, an instruction fectch or an input-/output cycle. These are available for the control of external circuitry.

Input/output interface and control are also built into the CPU module. Five digits on the address bus are used during input/output operations to specify one of 32 addressable peripherals. Eight addresses are reserved for input devices while the remaining 24 addresses are used for output. An eight line data bus for peripheral inputs is also included on the CPU module. The output devices share an eight line output bus with the memory. Signals generated on the module identify and synchronize input/output operations. These are available for the control of external circuitry.

The CPU module 505 also processes external interrupts. The module 505 is equipped with an interrupt request line and with a multibit (e.g., eight-bit) interrupt port. An external device may request service by placing an appropriate instruction code on the interrupt port's lines and activating the interrupt line. In the central controller this function is used to generate an interrupt only during power up and system reset operations.

The CPU module 505 of the access control system of the present invention is also equipped with a hold request line which enables external devices to access memory directly. By issuing a wait request, and following the acknowledge wait with a hold, the memory controller can cause the processor to suspend its operations and relinquish control of the main data bus. This allows an external device to man the bus and to effect memory transfers directly.

As best shown in FIG. 3, CPU module 505 also contains the following logic elements:

(a) auxillary timing generator 505*a*
(b) cycle decoder 505*b*
(c) bus control logic 505*c*
(d) address latches 505*d*
(e) read/write control 505*e*
(f) wait logic 505*f*
(g) interrupt logic 505*g*
(h) hold logic 505*h*
(i) status latches 505*i*

The CPU chip 515 exercises complete control over the rest of the logic on the module, according to the instructions it receives from the programmable read only memories.

The timing generator consists of a crystal controlled clock oscillator, a state decoder, logic on the CPU itself, and auxiliary timing logic.

The oscillator section generates two nonoverlapping 800kHz clock phases which drive the processor chip as well as other timing circuitry on the board. Logic contained in the CPU chip derives a symetrical 400 KHz SYNC signal from the phase 2 ($\phi$-2) clock, and this too is made available to the auxiliary timing logic.

The state decoder receives a 3-line signal (SO, S1, S,2) from the processor chip, indicating the processor's internal phase. The state decoder produces the following logically exclusive outputs:

T1, T2, WAIT, T3, STOPPED, T4, T5 and T1I.

The auxiliary timing logic receives phase 1, phase 2, and SYNC. It also receives T2 and T3 signals from the state decoder. The auxiliary timing logic uses these inputs to generate:

$\phi$ 12, SYNC A, and T3

The control signal produced by the state decoder and the timing logic then synchronize and govern all of the other internal operations of the central processor module.

The cycle decoder 505*b* (FIG. 3) receives two sub-cycle identification bits that the CPU chip 515 broadcasts during the T2 interval. Sub-cycle information is an internal function of the CPU chip 515 used to indicate which portion of a machine cycle is in progress. There are four possible sub-cycles, namely:

(1) instruction fetch (PCI)
(2) memory read (PCR)
(3) memory write (PCW), or
(4) input/output (PCC).

Still referring to FIG. 3, the cycle decoder 505*b* produces a 4-line exclusive output, indicating the kind of sub-cycle in progress. The $\overline{PCW}$ and $\overline{PCC}$ outputs are used by the processor module's control logic. All four signals are available for controlling external circuitry.

Bus switching logic 505*j* (FIG. 3) directs data to and from the CPU's main data bus under the control of the bus control logic 505*c*. This function is desirable in order to prevent conflict among the many devices that ultimately share the main data bus. The bus switching logic 505*j* consists of an input multiplexer 505*k*, an input gating section 505*l* and an output gating section 505*m*.

The control logic for the bus switching section 505*j* receives signals from the timing generator 505*a* and from the cycle decoder 505*b*. Inputs to the bus control logic include T3A, $\overline{PCC}$ and $\overline{PCW}$, as well as signals from the interrupt logic 505*g* and the hold logic 505*h*. From these sources, the control logic is able to sense an input or an output operation and can determine which of the external devices should be granted access to the main data bus 505*c*.

The input multiplexer 505*k* is a 3-way switch which selects one of three 8-line input channels and forwards it to the data bus of the CPU chip 515. This enables the multiplexer to select data from memory, data from the input peripherals, or data from the interrupt bus for input to the CPU chip 515.

The input gating section receives control signals from the timing generator 505*a* and the cycle decoder 505*b* respectively. These allow the input gate 5051 to forward the multiplexer's output to the CPU chip at precisely the right moment.

The output gating section 505*m* (FIG. 3) of the central controller is controllably the bus control logic 505*c* which, in turn, is shared by the memories and output peripherals. The bus control logic 505*c* is normally in an enabled condition. The only time that the module's output bus is inhibited or disabled is during direct memory access (DMA) operations. A control signal from the hold logic 505*h* disables the output gating section 505*m* when such an operation is in progress.

The address latch 505*d* (FIG. 3) comprises two eight-bit latch sections, both of which receive their data from the CPU chip 515. One latch receives the T1 timing signal as a strobe and the other receives the T2 signal. These latches thus register and hold the address which the CPU chip 515 sends out during the T1 and T2 intervals of all processor subcycles. The address stored in the latches 505*d* is presented to system memories and peripherals continuously during the phase in progress.

The read/write control logic 505*e* (FIG. 3) commands a two state output line. This line signals the system's memory when a write operation is in progress. If no write signal is present, a read occurs. The read/write control uses T3 and $\overline{PCW}$ to develop its output.

The wait or hold logic (FIG. 3) monitors the WAIT REQUEST line from the system memory. If the memory is slow to respond to the processor's read or write command, the wait logic causes the processor to idle until the memory can complete the transaction. A WAIT signal is available to external circuitry during the time that the processor is idling. This serves to acknowledge the wait request. A wait request may be of indefinite length, but the actual wait interval is always an even multiple of the CPU's clock period.

The interrupt logic 505*g* and hold logic 505*h* (FIG. 3) monitors the $\overline{INTERRUPT}$ request and the $\overline{HOLD}$ request lines from external devices. This section also receives a SYNC A signal from the timing logic 505*a*. The interrupt section 505*g* uses these inputs to develop an INTERRUPT signal which is correctly synchronized with the processor module's phase one and phase two clock signals.

The CPU module 505 responds to an interrupt by altering the sequence of events that occurs during the next instruction fetch cycle. The CPU enters a special alternate phase (T1I), rather than going into the T1 phase as it normally would. As it customarily does, the processor sends out the lower eight bits in its program counter, but the counter itself is not incremented. This is the only difference in the fetch, as far as the CPU chip 505 is concerned. The T2 and T3 intervals which follow the T1I are identical to those that occur in any other PCI sub-cycle.

Peripheral logic not shown is provided to sense the CPU's entry into the T1 phase. The peripheral logic responds by sending a control signal to the input multiplexer 505*k* (FIG. 3) causing the multiplexer to select the interrupt instruction port instead of the CPU's memory data input port. Thus the eight-bit word in the interrupt port gets interpreted as an instruction by the CPU.

Any instruction may be inserted, single or multiple byte. Synchronizing the presentation of successive bytes of a multiple byte instruction, however, requires some additional logic. For this reason, single byte instructions are preferred for interrupts. There are several possibilities.

Figure 4:
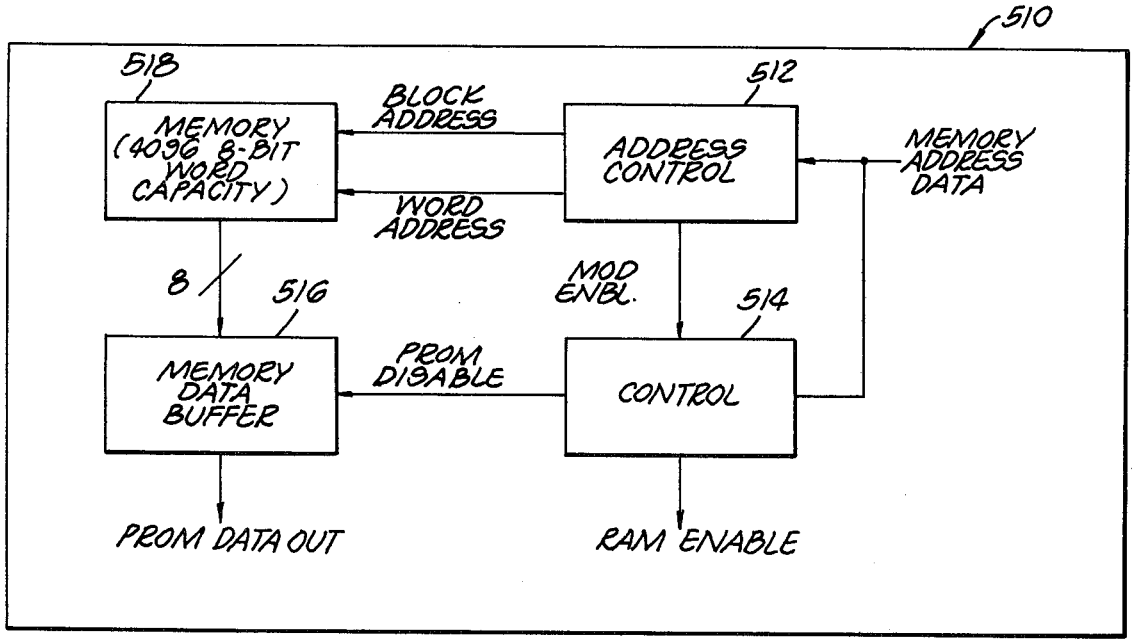
FIG. 4 is a block diagram of one of the programmable read only memory (PROM) modules of the central controller portion (FIG. 2) of the access control system of the present invention.

As best shown in FIGS. 2 and 4, the preferred embodiment of the access control system of the present invention uses two "programmable read only memory" (PROM) modules, 510 and 520, for providing 8,192 words of "read-only" memory. These modules are used for non-volatile program and data storage. Each module 510 and 520 has a separate program.

In order to understand the operation of the PROM modules, 510 and 520, each module may be considered to comprise the following four functional units, illustrated in block diagram form in FIG. 4:

(1) An address control block, 512, which determines which card is used for a memory operation, and which memory location on that card is being addressed.

(2) An operation control block 514, which controls the execution of all operations performed by the card.

(3) A memory data buffer 516, which buffers the data being read from memory.

(4) A memory block 518, which contains the actual memory components.

In order to obtain data from any given memory location, it is necessary to perform a "memory read" operation. This operation can best be understood by considering the operation into two phases:

(1) An addressing phase, in which the desired memory address is sent to the PROM module where it is decoded and used to "enable" the specific memory device which is to be accessed.

(2) A data phase, where data is sent out from the module.

The addressing phase is executed in the following steps:

(a) the central processor CPU 505 sends a memory address to the PROM module address control block 512.

(b) the address control block 512 translates the memory address into the following three types of signals: (1) module enabling signals, which enable the selected 4096 word block of the memory 510 or 520; (2) segment enables signals, which enable one 256 word segment within the larger 4096 word block; and (3) address signals, which access one word within the 256 word segment.

(c) the control block 514 checks the selected memory address and determines if it exists on the particular module. If it finds that it does not exist, it sends out disabling signals which prevent further operations with the card. At the same time, it sends out an enabling signal which can be used by the random access memory module 530 to enable its operation.

The operation control block generates the control signals necessary to cause the contents of the selected memory location to be sent from the memory block 518 to the memory data buffers 516, whence they are sent on to the central processor 505.

In the preferred embodiment of the access control system of the present invention, the first programmable read only memory 510 is connected for memory addresses zero through 4095, and the second programmable read only memory 520 is connected for memory addresses 4096 to 8191.

Figure 5:
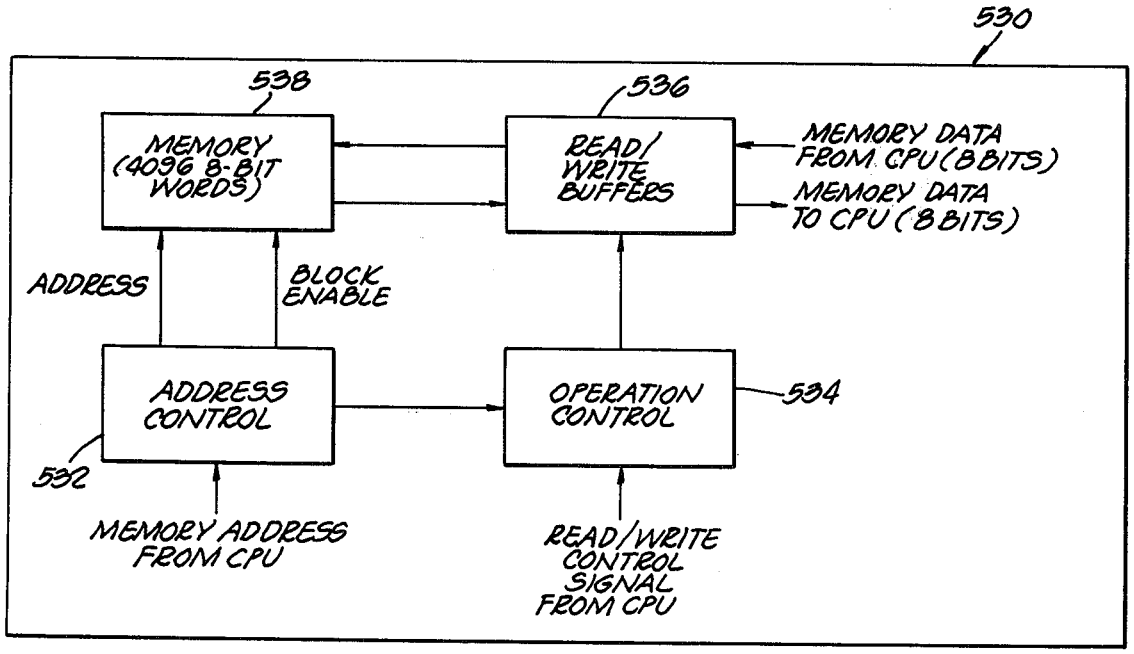
FIG. 5 is a block diagram of the random access memory (RAM) module of the central controller portion (FIG. 2) of the present invention.

The random access memory (RAM) module 530, best shown in FIG. 5, provides the user with 4,096 eightbit random-access memory words, which is used in the CPU.

In order to understand the RAM's operation, the RAM module 530 may be considered as four functional units:

(1) an address control block 532, which determines which memory module is to be used for a memory operation, and which memory location on that module is being addressed.

(2) an operation control block 534, which controls the execution of all operations performed by the module.

(3) read/write buffers 536, which buffer the data which is read from or written into memory.

(4) a memory block 538, which contains the actual memory components.

Each operation performed by the module uses one or more of the functional units 532–538.

In order to send data to a RAM memory locations, or to read data from a location, the location which is to be accessed is first specified. This function is provided by a "memory address" group of signals which represent a binary number and which are sent to the RAM module 530 by the central processor (CPU 505). Once the memory address is received by the RAM module, it is decoded in oder to select the correct location for a memory read or write operation.

The address control block 532 of the RAM module 530 decodes the memory address information, identifies the memory address, and translates it into the following three types of signals: (1) module enabling signals, which enable the selected 4096 blck; (2) segment enabling signals, which enable one 1024 word segment; and (3) address signals, which enables one in the 1024 word segment.

A "memory write" operation is executed by the following steps in order to load data into a selected memory word:

(1) The memory address for the word which is to be written into is sent to the RAM module 530 by the central processor.

(2) The address control block 532 (FIG. 5) receives the memory address and generates the signals necessary to access the addressed memory location, as described above.

(3) The central processor (CPU 505) sends a data word to the module, where it is received by the read/-write buffer 536. The central processor also sends control signals to the operation control block 534 which initiates a memory write operation.

(4) The operation control block 534 generates signals which cause data in the read/write buffer 536 to be written into the selected memory location in the memory block 538.

A "memory read" operation is performed by the following steps in order to read data from a selected memory location into the central processor:

(1) The memory address which is to be read is sent to the module by the central processor.

(2) The address control block 532 receives the memory address and generates signals necessary to access the addressed memory location.

(3) The central processor 505 sends control signals to the operation control block 534 which initiates a memory read operation.

(4) The operation control block 534 generates the control signals necessary to cause the contents of the selected memory location to be sent from the memory block 538 to the read/write buffer 536, and thereafter the signals are transmitted to the central processor.

The preferred embodiment of the access control system of the present invention requires a relatively small (e.g., 1,024 words) buffer storage, so the RAM module may be only partially populated with memory devices.

This actual memory of the RAM module is made up of a number of memory chips having a capacity of 1024 bits. Since the data word used by the RAM module 530 has a total of eight bits, the memory chips are tied together in a block of eight with each of the eight chips handling one of the eight data bits. This results in a combined block of 1024 eight-bit words.

The RAM module 530 in the central controller 100 may be connected for memory address 12288 to 16383.

The microprocessor unit (i.e., CPU 505, PROMs 510 and 520 and RAM 530) communicates with the peripheral modules through the use of sixteen memory address data lines eight input data lines and I/O (input/output) In and I/O Out control signals. These signals are buffered and docded in the clock/panel control module 800(FIG. 6), described below. Five memory address data lines are used in conjunction with I/O In and I/O Out to decode and generate the input and output port select signals. These signals are provided to the special interface connector location in the printed circuit board rack for the addition of special interfaces.

A printer accessory 600 (FIG. 1) is optionally provided for providing a hard copy print out of data regarding card keys presented in the reader terminals. At the operator's option the printer accessory 600 will print data about (a) each card as it is presented, (b) void cards, and (c) alarm conditions. The random access memory 530 of the central controller 100 prevents the speed of the system from being limited by the speed of the printer. Data about valid cards presented at reader terminals 200 may be printed in one color (e.g., black) and data about invalid cards (e.g., cards which are not properly coded) and/or alarm conditions may be printed in another color (e.g., red).

The printer 600 can also provide a hard copy print out of all parameters programmed into the memory array 550 in the central controller 100 either singly, sequentially or by groups of parameters.

The internal devices which interface with the CPU 505 are shown in block diagram form in FIG. 2 and are listed and briefly described below.

A. READER INTERFACE

The reader interface 250 (shown in detail in FIG. 24) provides bidirectional communication between the CPU 505 and the remote reader terminals 200. Each reader interface module 250 communicates with sixteen reader terminals. Eight reader interface modules 250 may be provided in the system.

B. CARD KEY DATA MEMORY

The card key data memory (FIG. 2) comprises the memory control module 570 and the memory array module 550. The memory array module 550 is a solid state memory which stores pertinent system information as well as card key information. This memory has a 16 bit word length and is expandable to 65,536 words. The memory control module 570 provides the interface between the CPU 505 and the memory array module 550 and all control signals for the memory's operations. Emergency battery power is provided for power loss protection.

C. KEYBOARD

The keyboard 120 on the front panel assembly (FIG. 35) allows the operator to program system parameters into memory and to recall information from memory for viewing on the display panel of the front panel assembly.

D. DISPLAY

The display panel 110 on the front panel assembly (FIG. 35) displays system status and card transaction information for the operator's inspection.

E. PRINTER INTERFACE

The printer interface 610 (FIG. 20) provides the necessary interface between the CPU and the printer 600. The printer is used to record card key transactions, alarm conditions, and a listing of information stored in memory.

F. TEST READER

The test reader 700 (FIGS. 2 and 11) is a card reader mounted on the front panel assembly (FIG. 35) for verifying numbers encoded on card keys. With a simple keyboard entry, the issue number, time zone, access level, and void/valid status for the card can also be displayed.

G. REAL TIME CLOCK

The real time clock 810 (FIG. 6) is included in the clock/panel control unit 800 (FIG. 2). It is a thirteen bit binary counter which is incremented every minute and is used to generate and control system time functions.

H. POWER SYSTEM

Figure 8:
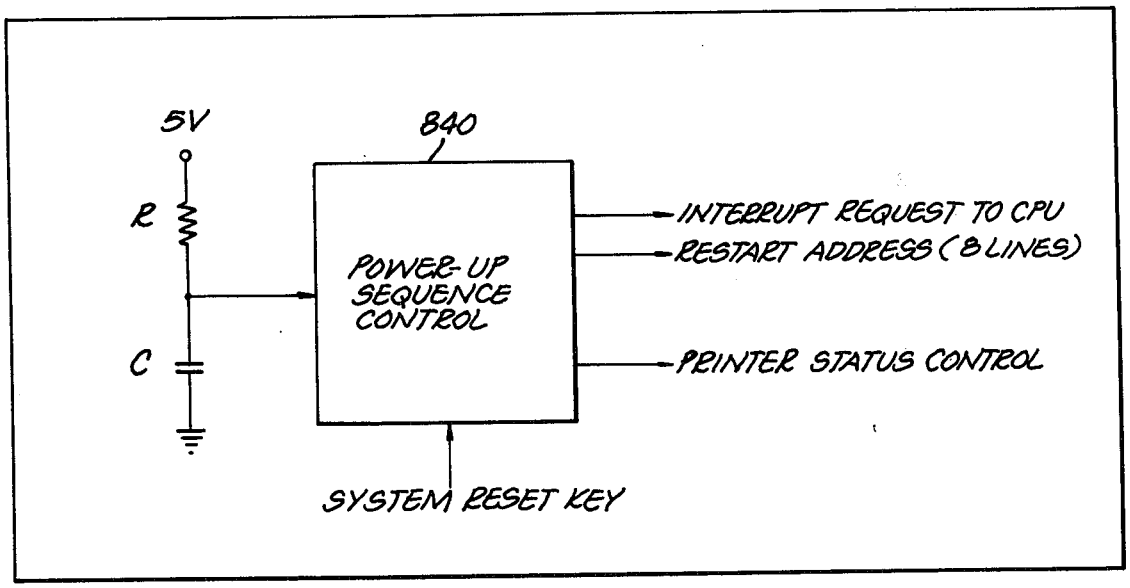
FIG. 8 is a block diagram of the power up sequence control portion of the clock-panel portion (FIG. 6) of the control controller portion (FIG. 2) of the access control system of the present invention.

The power supply 1000 (FIGS. 2 and 8) provides the required power for the functional modules within the central controller 100. Additionally, it provides a signal whenever primary power is applied or lost in order to prevent the changing or loss of data stored in memory, or the changing of the real time clock 810.

Figure 6:
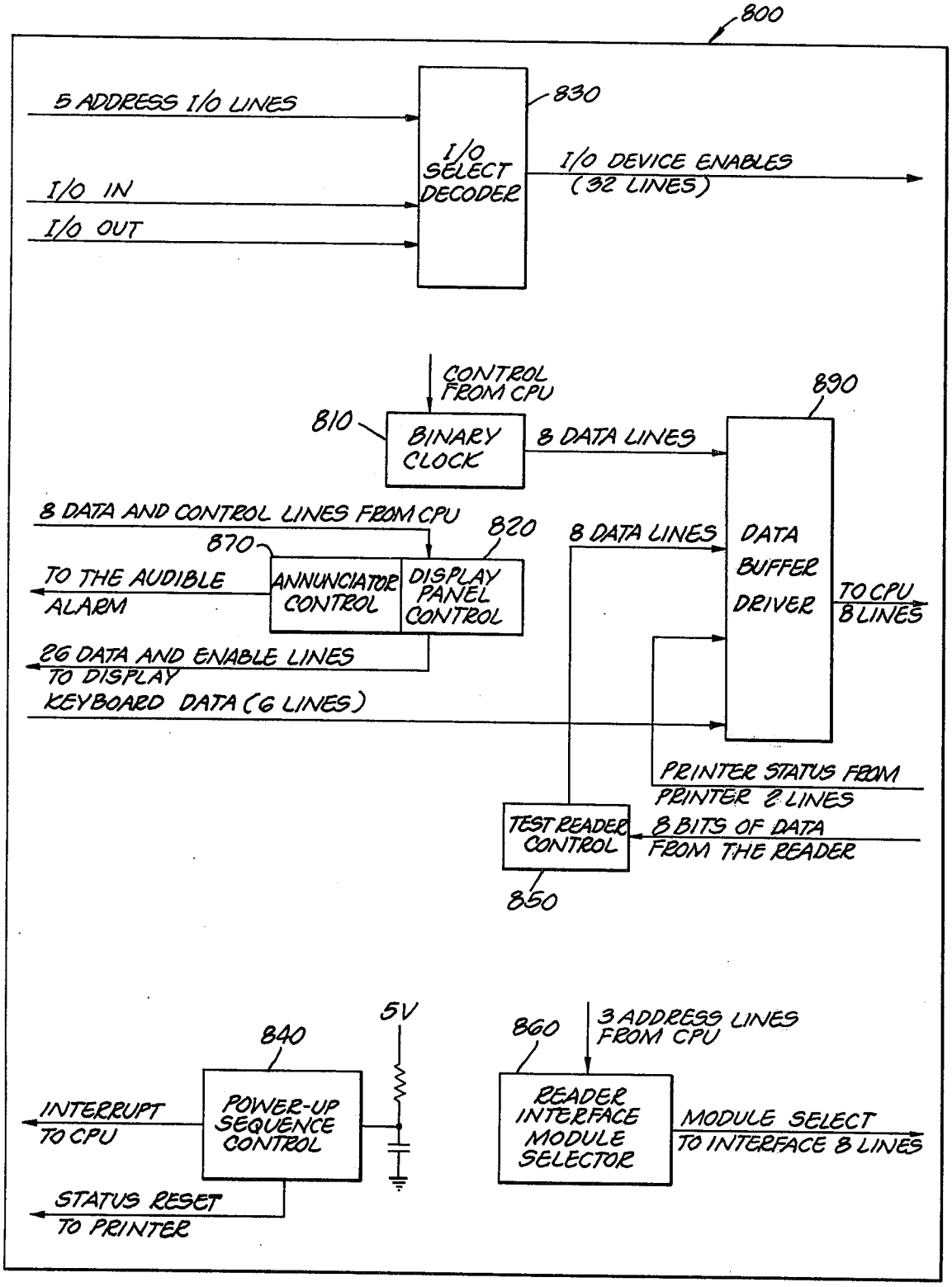
FIG. 6 is a block diagram of the clock-panel control portion of the central controller (FIG. 2) of the access control system of the present invention.

The clock/panel control board 800 is shown in detail in block diagram form in FIG. 6. The board 800 includes the following:

A. A binary real time clock 810 which provides the system with actual time when required by the system program.

B. Control circuitry 820, for the front panel display, which receives data and control signals from the CPU module 505 and controls the display.

C. Control circuitry 830 for peripheral address decoding which receives peripheral address data and timing signals from the CPU, and sends select signals to the proper peripherals.

In addition to the above, the clock/panel control board contains circuitry designated for power-up sequence control 840 (FIGS. 6 and 8), test reader control 850, reader interface module selection circuit 860, annunciator control 870, and peripheral data buffer driver 890.

All peripheral addressing is done through the clock-/panel control board 800 (FIG. 6). The CPU 505 may be interfaced to peripherals, or input/output (I/O) devices.

Figure 7:
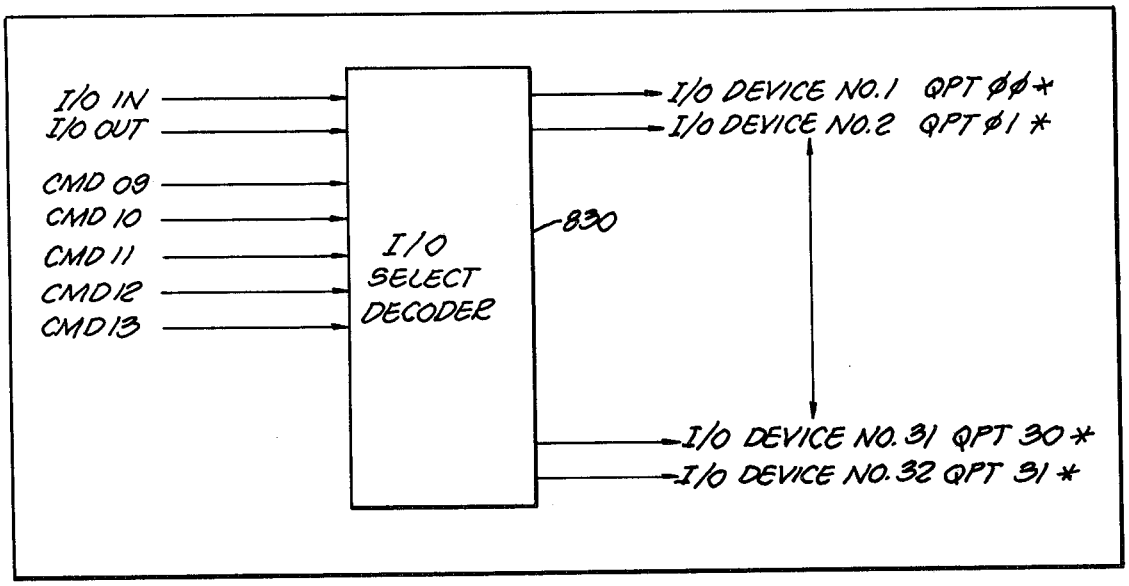
FIG. 7 is a block diagram of the peripheral address decoding portion of the clock-panel control portion (FIG. 6) of the central controller portion (FIG. 2) portion of the access control system of the present invention.

Five data bits may be used for I/O device addressing, e.g., CMD09 (computer memory data, bit 9) through CMD13 in FIG. 7, and are transmitted to the clock/panel control module 800 (FIGS. 2 and 6). The bits are transmitted to a decode circuit (e.g., "I/O SELECT DECODER" 830 in FIG. 6) which selects one of thirty-two possible input/output devices. The outputs are synchronized with the I/O timing signals, "I/O In" and "I/O Out". Each output goes to the proper I/O device to enable it whenever selected.

When power is first applied to the preferred embodiment of the access control system, the CPU module 505 goes into a "halt" mode. The power-up sequence control circuit (FIG. 8), after a delay to allow all voltages to come up to proper level, then issues an interrupt signal that puts the CPU into a "restart" mode. This powerup sequence control circuit also supplies the CPU with a "restart" instruction.

There are eight restart instructions available with each restart having its own starting program address.

The power-up sequence uses "restart 0" which uses starting address 0. The same result may be accomplished by pressing a "system reset" key on the keyboard 120 (FIG. 2) to initiate a restart instruction by the CPU.

Figure 9:
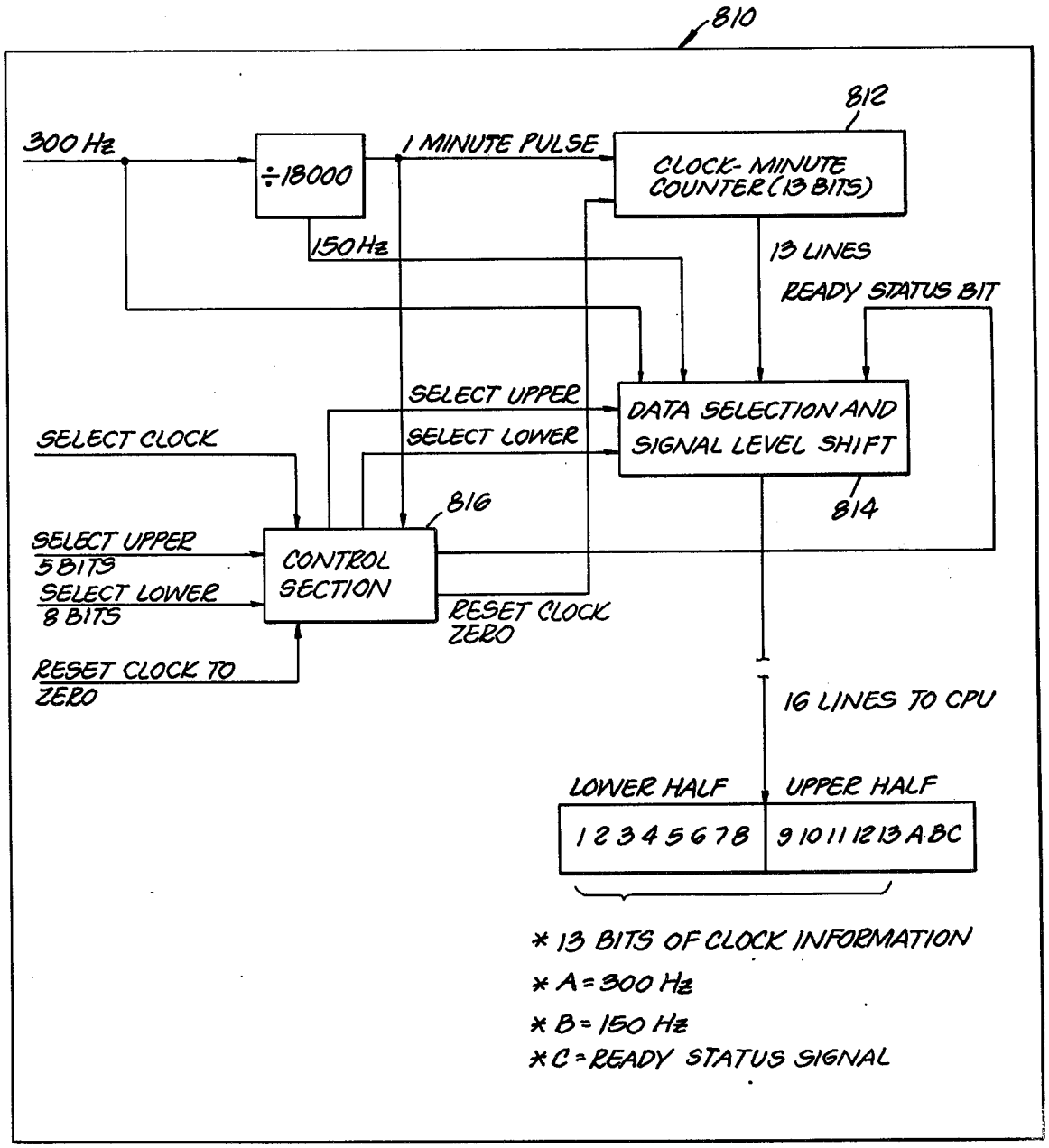
FIG. 9 is a block diagram of the real time clock of the central processor unit module (FIG. 3) of the central controller portion (FIG. 2) of the access control system of the present invention.

The real time clock 810 (FIG. 9) consists of three basic sections: a clock section 812, a data selection and signal level shift section 814, and a control section 816.

The clock 812 is a binary counter giving a binary number of 13 bits. It is incremented by one for every minute. Therefore, the output of the clock is equal to the number of minutes accumulated since it was last reset to zero.

The basic frequency, 300 Hz, to generate a one minute pulse is brought from the memory control board. This 300 Hz signal is divided by 18,000 to give 1/60 Hz, which is the one minute pulse incrementing the clock or counter 812.

The preferred embodiment of the system of the present invention utilizes an 8-bit microprocessor 500. Therefore, it is necessary to multiplex the clock data, which is 13 bits long. This logic which is controlled by the control section 816, selects the lower 8 bits or the upper 5 bits of clock data. When the upper 5 bits are selected there are three more lines left to be utilized of the 8 bus lines between the clock/panel board 800 and the CPU board 505. These three lines carry 300Hz and a clock ready status signal. The first two signals are used as timers (300 Hz will give a 3.3 mSec period and 150 Hz will give 6.6 mSec period) in the system. The third signal indicates to the CPU when one minute has elapsed so that the CPU can take action to update any time-related system parameters, such as time zones.

The control section 816 of the real time clock 810 (FIG. 9) takes a command from the CPU to (1) reset the clock or counter 812 to zero, or (2) select the lower 8 bits of the counter 812 to be sent to the CPU, or (3) select the upper 5 bits of the counter plus the 300 Hz signal, the 150 Hz signal, and the clock ready status signal to be sent to the CPU.

Figure 10:
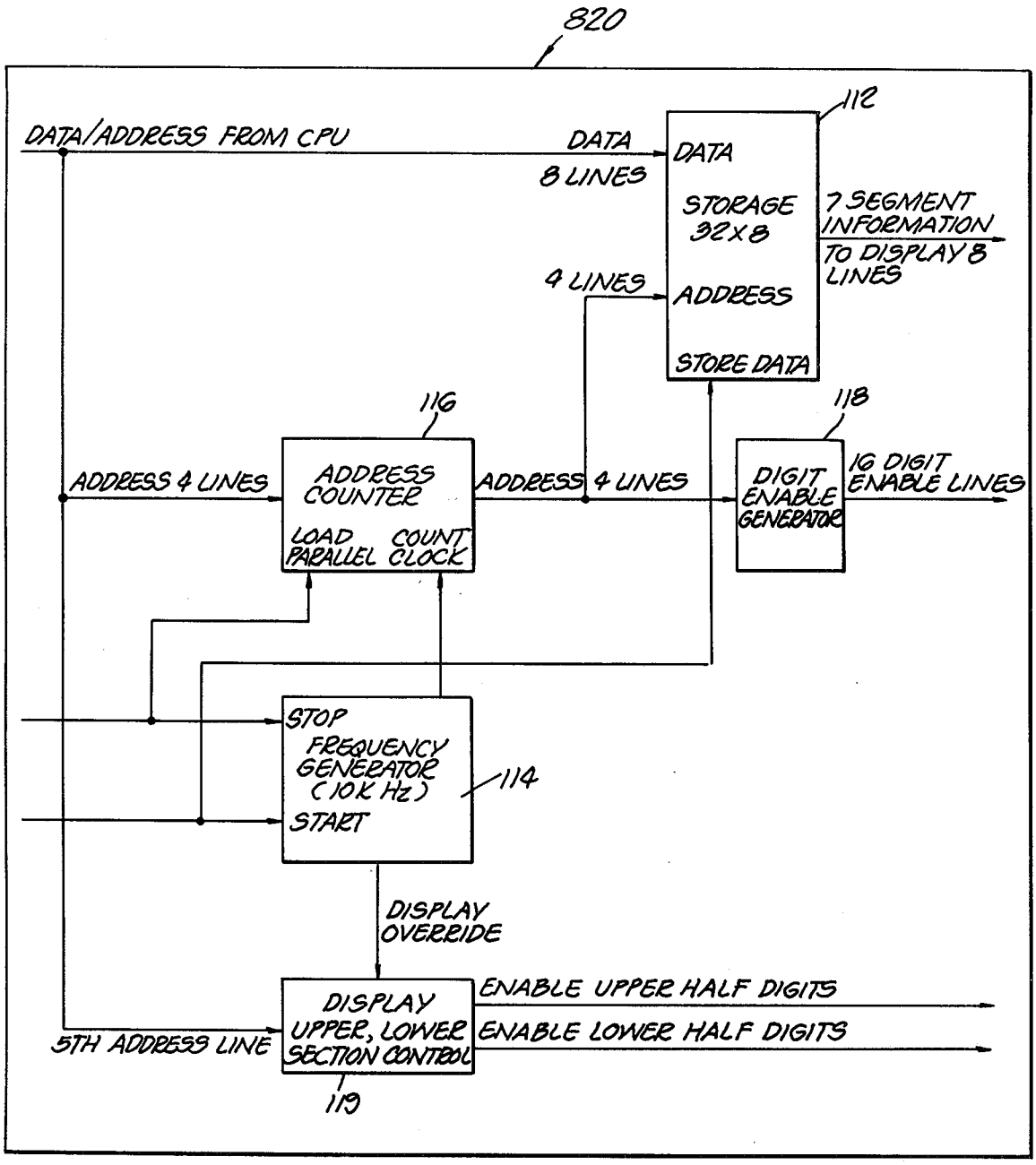
FIG. 10 is a block diagram of the display panel control of the central controller portion (FIG. 2) of the access control system of the present invention.

The front panel display control section 820, best shown in FIG. 10, comprises of two basic functional areas; (1) data storage and (2) control.

With regard to the data storage function, there are 24 7-segment numeric displays and 12 single light emitting diode (LED) indicators on the front display panel 110 (FIGS. 2 and 35). All except the Battery Test LED indicator are under panel display control 820. The data storage area contains the actual display data for each digit and each indicator LED. That is, the first location of the storage contains information that is displayed at the first digit, the second location is for the second digit, etc.

Referring to FIG. 10, the data storage section 112 of the display panel 820 itself comprises 32 locations with each location being 8 bits long. Note that 7-segment displays with decimal points require 8 bits of information while LED indicators need only a single bit for each. Therefore, one numeric display requires one location of storage while 8 LED indicators may share one location of storage.

Turning now to the control area of the front panel display control section 110 (FIG. 10), this area has two basic functions. The first is to supply location addresses to the storage section 112 and the second is to generate display multiplex timing signals. Note that since only one of 32 locations may be accessed at a time, it is necessary to indicate which digit or indicator is to receive the data from the storage section 112 at that time.

This control area contains a free-running 10 KHz frequency generator 114, a storage address counter 116, and a digit enable signal generator 118. There are 5 bits in the address counter 116, a 4 bit counter, and a flip-flop. The counter is capable of counting zero through 31.

Since the front display panel 110 (FIG. 35) has 24 digits and 12 LED indicators, only 26 locations of the storage are being used. (They are zero through 11, 13, 16 through 22, and 24 through 29). The address counter 116 gets its basic clock from the 10KHz frequency generator 114. In normal operation the counter 116 simply steps through zero to 31 and repeats. The output of the counter goes to storage 112 as an address. The same output also goes to the digit enable signal generator 118. This digit enable generator 118 receives the address and gives an "enable" signal only to the digit addressed. For this reason it is not required to have more than 8 data lines between the display controller 119 and the actual display. (If the address is 5, for example, the storage 112 will send data out of location 5, and the digit enable generator will make certain the only digit 5 receives the data.)

An additional operation is also performed by the address counter 116 when the CPU has new information to be displayed. In this case the counter receives the address directly from the CPU and the free-running frequency generator 114 will stop enabling the counter to hold the address received until the new data is stored into that address.

Since the display elements are LED's, it is possible to overload and burn them out by passing too much power through them. To prevent this the control section contains a display enable override signal generator (FIG. 10). This generator constantly monitors the frequency generator 114 and disables all the display elements when no pulses are detected. (Note that if there were no basic clock to the address counter, the counter could have only a single address and that this particular digit would be enabled constantly. This would result in continuous power comsumption by that digit display element and eventually destroy it.)

The following display example describes the circuit operations performed to place a number (in this example, 6) a digit location 8 on the display.

The CPU 505 initiates the operation by sending out the digit location, which is the same as the storage address for that digit. (Only the lower 5 of 8 bits from the CPU are used for the address.) The address information, clocked at the proper time (output port 12) is strobed into the address counter 116. Concurrently, the free-running frequency generator stops, and this causes the display enable override to activate and cause the display to become blank. Since there is no clock signal to the address counter, the output of the address counter is now equal to 8, the address it has received.

The CPU now sends out the data for digit location 8, which is 6. Since address 8 is being sent to storage 112, the data for number 6 now goes into storage location 8. The same signal that strobes the data into storage now enables the frequency generator 114. This action, in turn, enables the override signal to be lifted. Now the display will start at display location 8 and continue on until the next new data is to be loaded. (Unlike addresses, data requires the use of all 8 bits).

Figure 11:
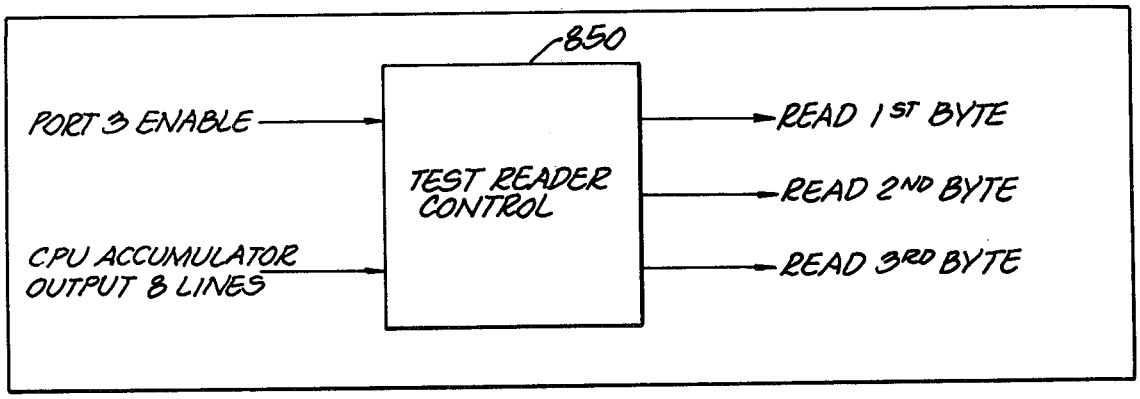
FIG. 11 is a block diagram of the reader interface module selection circuit of the central controller portion (FIG. 2) of the access control system of the present invention.

A test reader control 850, shown in FIGS. 6 and 11 is installed on the display panel 110 (FIGS. 2 and 35). When a card key is inserted at a reader terminal, a microswitch on the reader closes and provides a signal to the CPU. Under the program control, the test reader control 850 sends 3 bytes of information to the CPU through the clock/panel control board 800.

Figure 12:
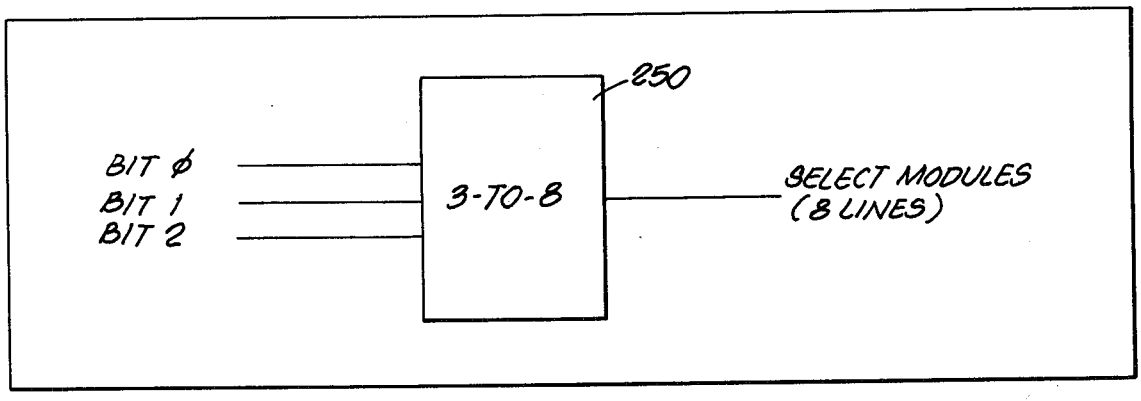
FIG. 12 is a block diagram of the reader interface module selection circuit of the central controller portion (FIG. 2) of the access control system of the present invention.

There are 128 reader terminals and/or alarm monitors in the preferred embodiment of the present invention. They are divided into 8 groups of 16 terminals. Each group is selected by the CPU 505 through the clock/panel control board 800 via the reader interface module selection circuitry 250 (FIG. 12).

Figure 13:
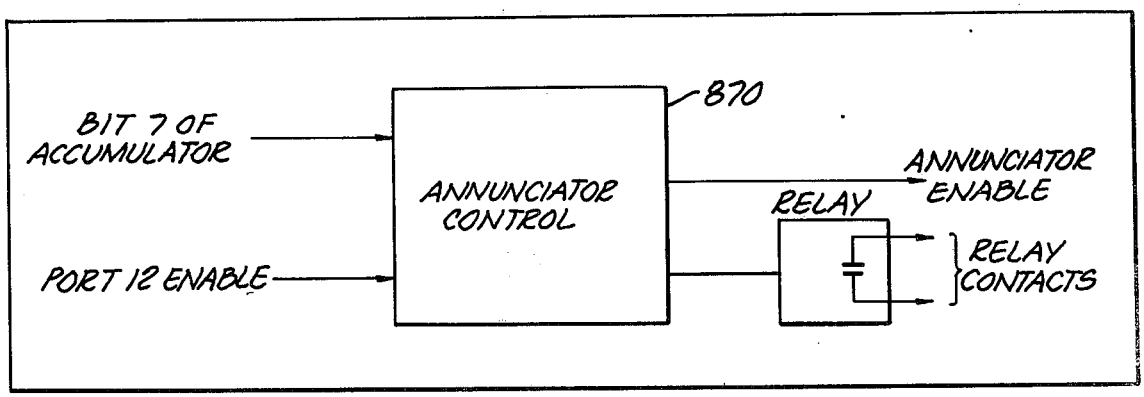
FIG. 13 is a block diagram of the annunciator control circuit of the access control system of the present invention.

The annunciator control 870 (FIGS. 6 and 13) is programmable and its programming is accomplished through the clock/panel control board 800.

A relay connected to the output of the annunciator control circuit provides normally open dry contacts rated at 10 watts resistive load.

Figure 14:
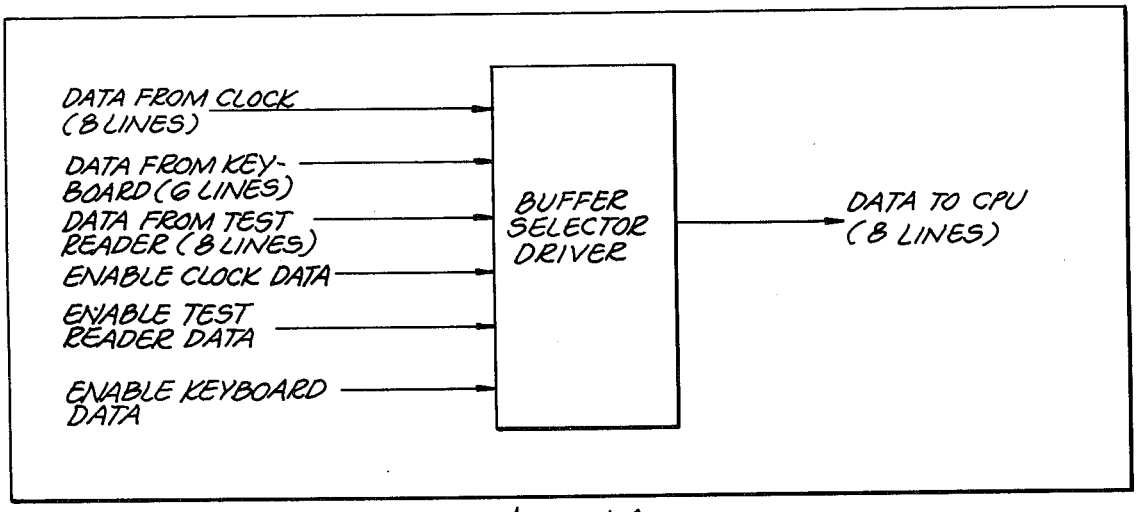
FIG. 14 is a block diagram of the peripheral data buffer-driver circuit of the access control system of the present invention.

As best shown in FIG. 14, data outputs from the real time clock 810, the test reader 700, and the keyboard 120 all enter the buffer selector driver. Here they are selected and buffered before being sent to the CPU.

The data memory system of the preferred embodiment of the access control system of the present invention is a solid state memory system which stores all information programmed into the system by the operator. The memory system consists of two basic module types. The first is a memory array module 550 (FIG. 2) which contains the actual storage elements and their peripheral circuitry. Each module may contain up to 8192 16-bit words. The second typê of module is a memory control module 570 (FIG. 2) which contains all of the timing and control logic necessary to operate memory array cards. The memory control module interfaces with the microprocessor unit's data busses for two way communication, and may interface with eight memory array modules.

All system information, with the exception of card key data is stored in the first 2048 words of memory. This information includes:

1. Terminal-access level combination points which are located in the first 1024 word locations. Each word may be 8-bits or 16-bits long depending on the reader capacity of the system. If the system capability is greater than 64 reader terminals, the words are 16-bits long.
2. Reader terminal information including time zone and void/valid status of the card keys.
3. Time zone data which includes the start and stop times for eight, seven-day time clocks.
4. Master clock information for maintaining the real time clock during power shutdown.
5. System options.

The second 1024 words store the information for items 2 through 5 and each word is always eight bits long.

Figure 15:
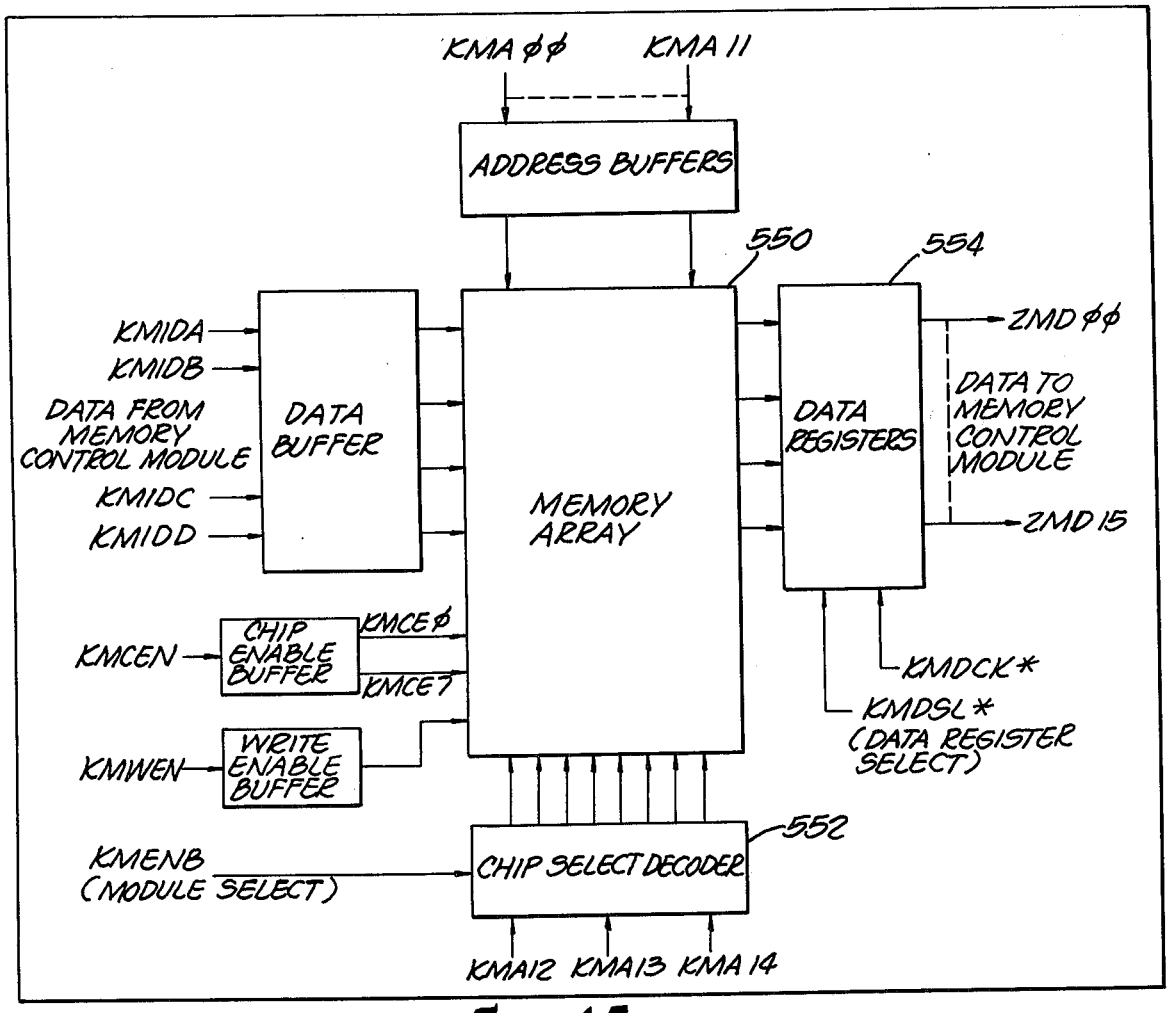
FIG. 15 is a block diagram of the memory array module circuit of the central controller portion (FIG. 2) of the access control system of the present invention.

Card key information begins with word address 2048 and memory is added to meet system requirements. The first memory array module in the system can store data for 6144 cardholders. For systems of greater capacity additional memory array modules are added and each module can store data for up to 8192 cardholders. The information stored for each cardholder includes:

(1) void/valid status
(2) issue level
(3) entry/exit status
(4) time zone
(5) access level With reference to FIG. 15, the memory array module 550 contains the actual memory elements which store system information. The module can store up to 8192 words and may be partially populated with memory devices depending on the memory capacity of the individual system. A suitable storage element is a 4096 bit dynamic N-Channel MOS device. These devices are contained in the memory array 550 shown in FIGS. 2 and 5.

All signals to and from the memory array module 550 are interfaced with the memory control module 570 (FIG. 2). To read or write information from memory, it is necessary to first select the desired memory array module. Eight modules may be selected, with each module containing up to 8,192 words of memory. After the module 550 is selected, a block of memory devices must be selected. The memory array is divided into eight blocks of 1024 words and each block contains four memory devices. A chip select decoder 552 takes the address information from the memory control module 570 and decodes this information to select one of the eight memory blocks. Next, the desired word within the 1024 word block must be selected. Ten address lines which are common to all memory array modules define this address. As will be described in the next paragraph, each CPU-requested memory cycle consists of four minicycles and the proper memory address is selected by using two more address lines. Address buffers are provided to translate the signals from the memory control module to the appropriate voltage level.

Each processor memory cycle performed on the data memory system consists of four minicycles which are performed automatically by the memory control module 570. Every time memory is accessed, the selected device will output four bits of information in a serial format. Since four devices are selected for every access, a total of sixteen bits of information are retrieved evry time memory is read. When performing a write cycle, data is loaded into memory devices over four lines. Because of the four minicycles, sixteen bits of information are stored during each write cycle. Data for a write cycle is provided by an input data bus which is common to all memory array modules 550 and is buffered on the memory control module 570. Data is read and stored in a data register 554 which has a tri-state output. This allows the outputs of the data registers on each module to be bussed together and only the output of the selected module will be active. Once accessed, data in the data register 554 will remain valid until the next read cycle is performed on the module.

Three timing signals are provided for proper operation of the memory. The write enable (KMWEN) signal selects the read or write mode, chip enable (KMCEN) is a timing signal required for every cycle, and the data register clock (KMDCK*) signal clocks data into the data register. The write enable and chip enable signals are buffered on each memory array module 550.

In the power backup, power is removed from the data registers 554 and only the necessary devices are powered to minimize power dissipation.

Figure 16:
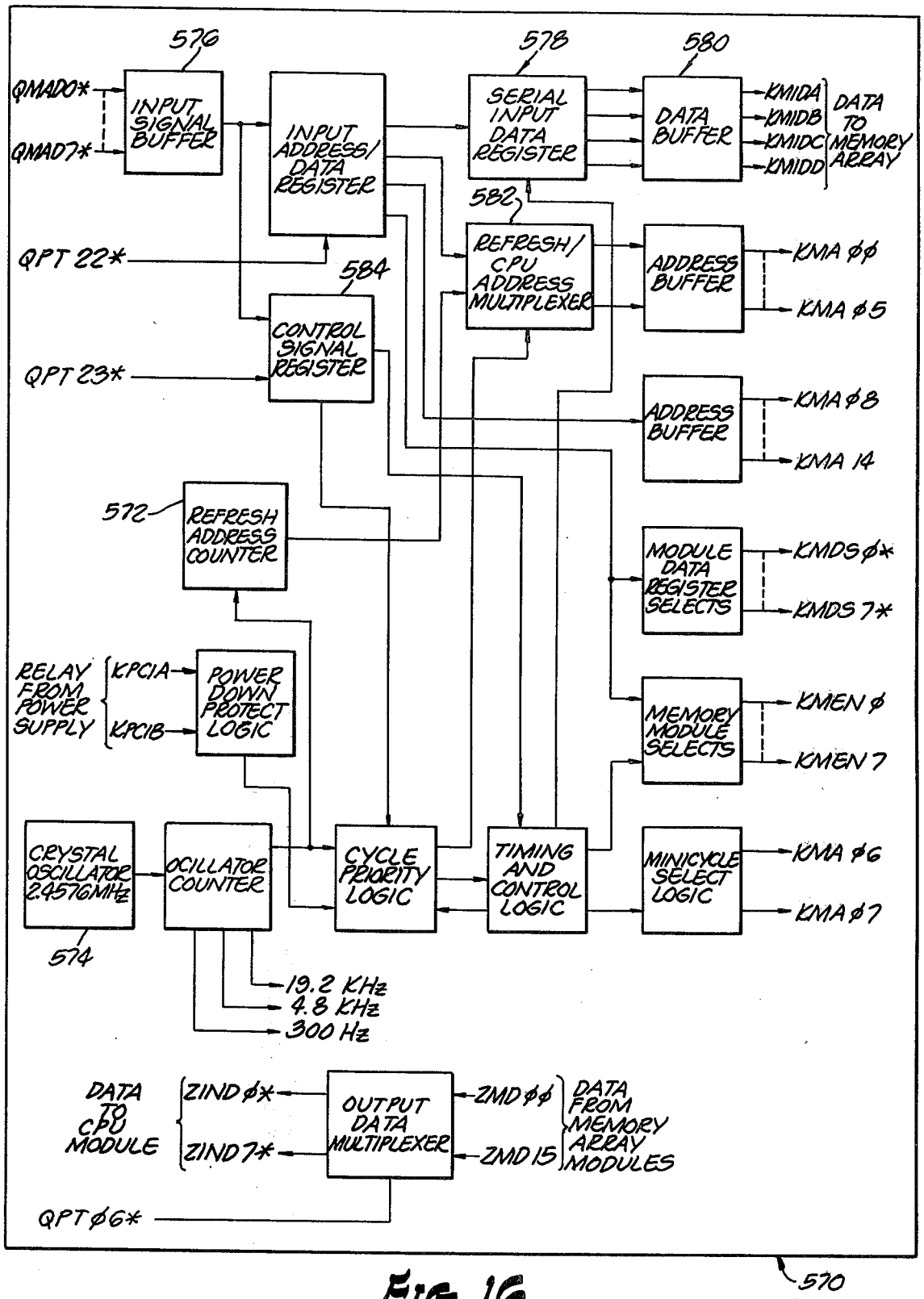
FIG. 16 is a block diagram of the memory control module of the central controller portion (FIG. 2) of the access control system of the present invention.

The memory control module 570, shown in some detail in the block diagram of FIG. 16, provides the necessary timing for all memory cycles and interfaces directly to the memory array modules 550 and the microprocessor unit 500.

Because the memory devices on the array modules 550 are dynamic devices, information which is stored must be periodically "refreshed" to prevent its loss. This is accomplished automatically by the memory control module 570 by initiating a refresh cycle approximately every 52 microseconds. Sixty-four cycles are required to completely refresh the entire memory. A refresh address counter 572 generates the required address signals for each such cycle and these lines are multiplexed with the incoming address lines for a CPU-requested memory cycle.

A 2.4576 MHZ crystal oscillator 574 is used to generate the control timing for the control module 570. The oscillator 574 is counted down to generate a 19.2 KHz signal which is the refresh cycle request signal, a 19.2 KHz and 4.8 KHz clock for the time base used by the reader interface modules, and a 300 Hz clock which is used to generate the real time clock.

The microprocessor unit 500 can generate a read cycle or a write cycle request. This is accomplished by first sending the memory control module 570 the data to be written into memory and then the desired address where the data is to be stored. Next, a write control and cycle initiate signal is transmitted and the logic on the memory control module generates all other signals. For a read cycle only the desired address must be transmitted and then a read control and cycle initiate signal are transmitted. Because the processor 500 is an 8-bit machine, it can send and receive only one 8-bit byte of information at a time. To store 16 bits of data into memory requires the data be sent in two bytes and similarly to address the memory requires two address bytes. Each data word read from memory must be done as two bytes. Input data and address information is sent to the memory control module by the QMADϕ* (memory address data bit zero from clock control panel) to QMAD7* lines and output data from the memory is received on the ZINDϕ* to ZIND7* lines. These lines are common to all peripherals interfaced to the microprocessor unit 500.

The QMAD* lines are buffered by the input line buffers 576 which level shift the signals to the appropriate voltage level and are then clocked into the input address/data registers.

An output program instruction is decoded on the I/O select decoder 830 of the clock/panel control module 800 (FIGS. 2 and 6), and generates the strobe (QPT22*) which loads this information into the registers. The data must be presented as a series of output operations, and in the following manner for the two types of cycles:

| | | |
|---|---|---|
| Write Cycle: | Input Data: | Lower Order Byte |
| | Input Data: | Higher Order Byte |
| | Address: | Lower Order Byte |
| | Address: | Higher Order Byte |
| Read Cycle: | Address: | Lower Order Byte |
| | Address: | Higher Order Byte |

Once the data is loaded into the registers, it is then presented to the various other sections of the module for use after the cycle initiate signal is generated.

The data to be written into memory is loaded into the serial input data register 578 and buffer 580. The data is then shifted out one bit at a time over four data lines to the memory array modules 550. Four bits of information are sent over each line to give a total of 16 bits of data to the memory.

The three most significant address bits of information are used by memory module select and data register select decoders to enable the selected memory array card module 550 and data register 554 (FIG. 15). The next three significant address bits are buffered and sent to the memory array modules 550 where they are decoded to select the appropriate one of eight blocks of memory. The ten least significant address bits are buffered and sent to the memory modules 550 for selection of one of 1024 words. The lower order six bits are multiplexed with the refresh address counter 572 output prior to being buffered. Once the address and input data are set up, the memory cycle may be initiated. There are three control signals which are required and they are clocked into the control signal register 584 by QPT23* which is generated by an output port 23 instruction.

When initiating a write cycle, the output data select line may be in either state. When performing a read cycle, either the lower or higher order byte is selected when the cycle is initiated. After it is read the other byte may be selected by changing the state of the output select line and generating an output port 23 instruction. This time the cycle initiate select line must be in a 1 state to prevent another cycle from being started. The data from the memory is present on the ZIND* lines during an input port 06 instruction. This operation generates a strobe (QPTϕ6*) signal which enables the tri-state output of the output data multiplexer.

When a cycle initiate is generated, a CPU memory request signal is internally generated. The cycle priority logic resolves priority between refresh and CPU memory cycle requests and initiates the cycle timing. If simultaneous requests occur, the refresh request has highest priority. Otherwise, the first request has priority and the second request will be acted upon immediately upon completion of the first. Refresh cycles take about 5 microseconds and CPU memory cycles are 20 microseconds (four mini-cycles long). Therefore, the microprocessor 500 may have to wait a maximum of 25 microseconds to obtain data.

The cycle priority logic initiates the timing and control logic which generates the external chip enable (KMCEN), write enable (KMWEN), data register clock (KMDCK*) and minicycle select (KMAϕ6 and KMAϕ7) signals which control the operation of the memory array modules 550. In addition, it generates all necessary internal timing signals for the module.

Backup power is maintained on all control logic when primary power is lost. Most of the logic on the memory control module 570 comprises devices manufactured with complementary metal oxide semiconductor (CMOS) technology which requires very low power, and all bipolar devices which require much more power are turned off in this mode. A set of relay contacts (KPCIA and KPCIB) from the power supply are connected to the power down protect logic. These contacts remain open until all voltages are at their proper level when primary power is applied. The contacts remain closed during normal operation, but will open up when the loss of prime power is sensed and before regulated voltage is lost. This is to prevent the inadvertent destroying of data during primary power sequencing of the system.

KEYBOARD

Figure 17:
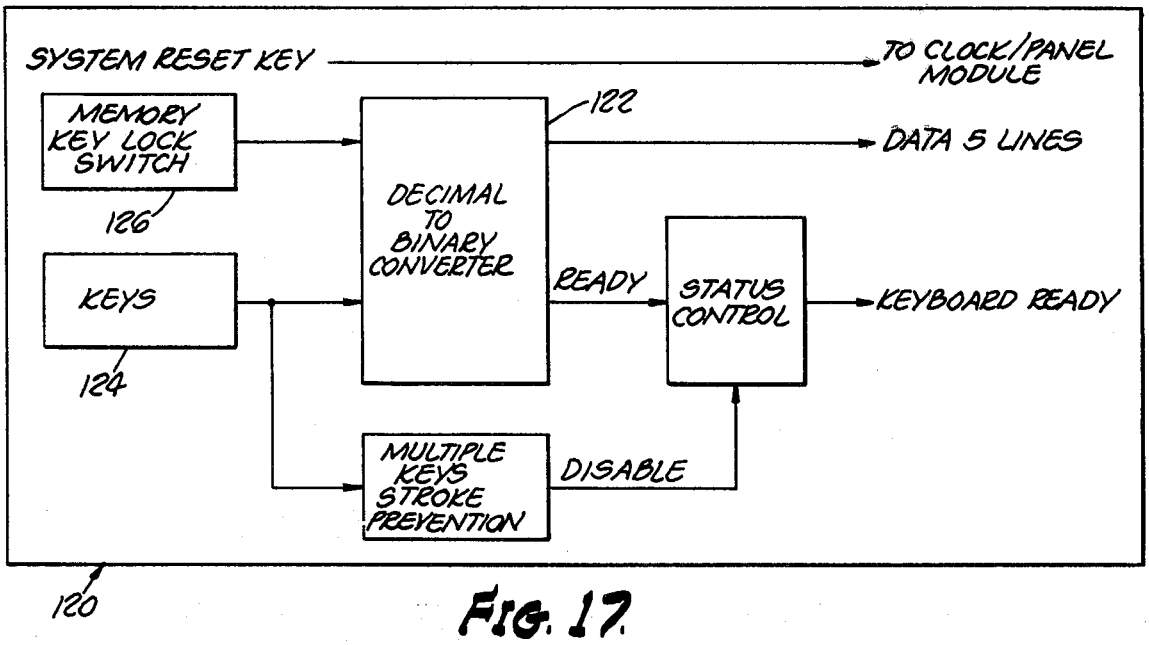
FIG. 17 is a block diagram of the keyboard of the central controller (FIG. 2) of the access control system of the present invention.

Referring now to the block diagram of FIG. 17, the keyboard 120 of the preferred embodiment of the access control system of the present invention has two functional parts: (1) a decimal key to binary code converter 122 and (2) data entry keys 124.

The keyboard capacity is 32 keys: however, only 28 are used in the preferred embodiment. These are divided into 4 groups of 8 keys each. Four "input available indicator outputs" are used to generate a 2-bit binary number that determines to which one of 4 groups the key belongs. The binary number consisting of the above 5 bits (the 3 outputs and the 2-bit binary number) is sent to the CPU. One key, e.g., key 15, is actually a microswitch that activates the test reader 700.

These keys, e.g., keys 29, 30, and 31 are designated "record", "list" and "option" keys. These keys are connected to a memory key lock switch 126. When the switch is in the operate position, these keys are disabled.

The 8-to-3 encoders are "low" or "ground" input active. The record, list and option keys 29, 30 and 31 (FIG. 35) are connected to the ground through the memory key lock switch. When a key is depressed, a short pulse is generated. This pulse lasts about 20 milliseconds and is used to suppress any key bounce noise. During this suppression time, the status bit is forced into an unready condition. At the end of this time, a flip-flop is set to indicate the data is ready. This flip-flop may reset by one of two ways, one when the key is released and the other when the CPU 505 reads the keyboard 120. When the key is released, the data is no longer there, and therefore, the status must return to a not ready condition. If the CPU reads the keyboard output while a key is pressed down, it must be made certain that the same key is not read again by resetting the status bit.

When two keys are pressed at the same time the status bit is forced into a not ready status since it cannot be determined which key depression is correct.

The system reset key is not connected to any encoder and does not generate any data ready status. That key is directly connected to the clock/panel control board and is used to initiate the system reset sequence, which is identical to the power-up sequence. The key lock switch must be in the program position to activate the system reset sequence.

Figure 18:
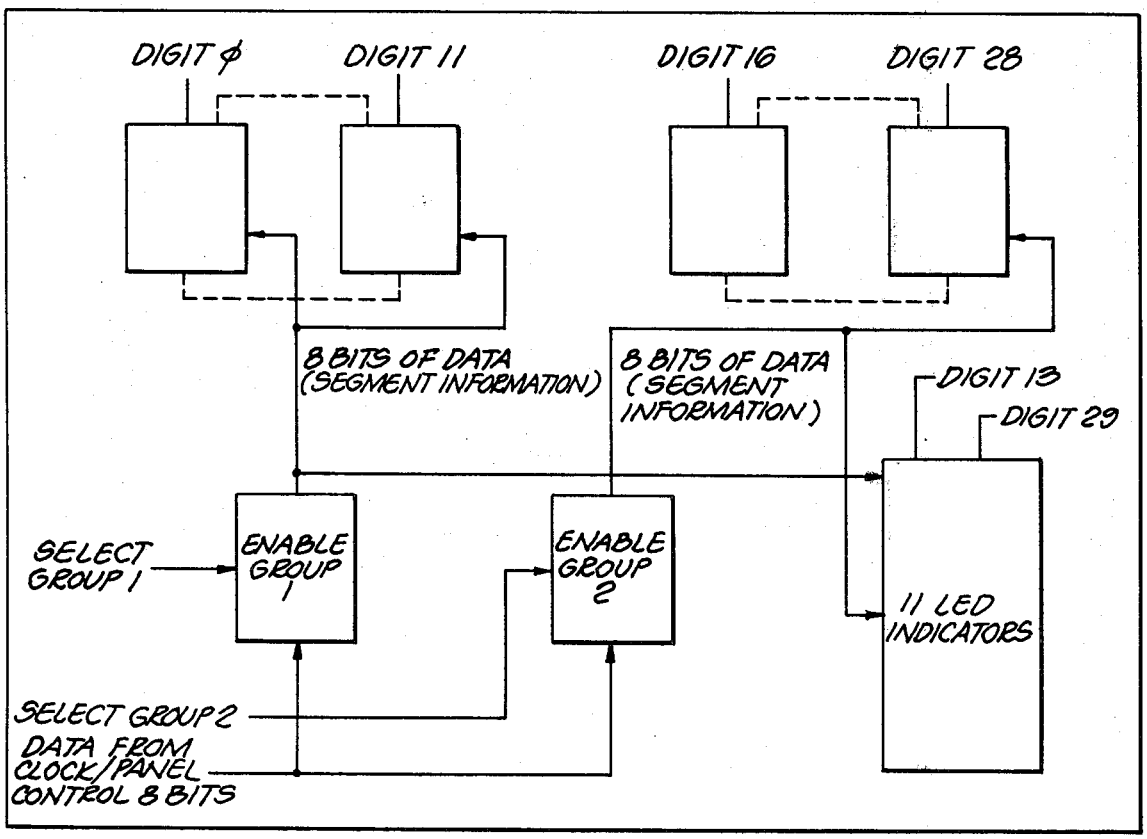
FIG. 18 is a block diagram of the front panel display of the access control system of the present invention.

The front panel 110 (FIG. 2) on the front panel assembly (FIG. 35) contains 24 digits and 12 light emitting diode (LED) indicators (also see FIG. 18). Except for a battery test indicator, all of the display is under program control. All control from the CPU 505 goes to panel control logic residing in the clock/panel control board 800. The panel control logic sends proper signals to the front panel display 110.

The display board 110 may be considered in two parts: (1) display hardware and (2) control.

The display panel is used to display card key and alarm transactions. Additionally, it is used in conjunction with the keyboard to aid the operator in programming the system and retrieving data from memory. The display which is shown in FIG. 36 consists of 24 seven-segment, light-emitting diode (LED) displays, six with decimal points and eleven individual LED's. Each display element and an audible alarm which is considered to be part of the display is selectible by software.

DISPLAY FORMATS

Primary display functions are positioned in fixed formats. The 7 segment displays are used in two primary formats. The first format which is indicated when the mode 1 discrete LED is displayed is used for card key transactions, and the recalling or storing of card key data into the system memory. The silkscreen on the front panel above the display indicates the format. Card key numbers are displayed in elements 00 to 04 and the decimal in element 04 is always used with the issue level displayed in 05. When keyboard functions involving upper and lower limits on card key numbers are performed, the upper limit is displayed in the "TO" section (elements 07 to 11) without an issue level or decimal point. Terminal numbers are shown in elements 16 to 18, access levels in 20 to 22 and time zone in 24.

The second primary mode which is indicated by the mode 2 discrete LED is used for recording and displaying time zone information. The time zone number is shown in elements 01 and the day of the week of interest in 16 through 22. Start time is displayed in 03 to 06 with a colon generated by decimal points in elements 04 and 05. Stop time is displayed in 08 to 11 with the decimal points in 09 and 10. For programming, the days of the week are numbered from 1 (Sunday) through 7 (Saturday) and the appropriate number is indicated in the display for each day when appropriate. The mode 1 and 2 LED's are used for these display formats.

The time of day, day of week, and day of year are shown in elements 25 to 28. Only one parameter is shown at a particular time and the display can be revolved to display any parameter. Military time (00:00 to 23:59) is used with the decimal points in elements 26 and 27. The Julian day of the year (1 to 366) is displayed in 26 to 28 and the day of the week in 27 with dashes in 26 and 28.

The other discrete LED's are used to indicate void/valid status, in/out (entry/exit) status, audible alarm enable, alarm void request and system fault conditions, and primary power failure. The power failure indicator is set whenever power is first applied and must be reset by the operator. Another indicator is provided for battery status and it is controlled directly by the power supply. If battery voltage is too low, the output from the supply causes the indicator LED to turn off.

The audible alarm is utilized in conjunction with system status functions only when the audible enable is active. When enabled, the alarm will sound for specific conditions.

MISCELLANEOUS FORMATS

Alarm conditions are displayed on the front panel by indicating a dash for no alarm or the number of the alarm, 1 through 4 or 8, in segments 03 to 10 and the terminal number in 16 to 18.

Void requests are displayed just as other card transactions and include card number, issue level, access level, terminal, void/valid, entry/exit status, time zone and void reason code.

Every keyboard response is acknowledged on the display by some method such as a momentary blanking or the changing of some display element.

Leading zeroes are blanked on all display parameters.

KEYBOARD SEQUENCES

The functions and operation of the keyboard on the front panel of the centrol controller are:

(a) Programming of system parameters.
(b) Recalling of system parameters for visual inspection.
(c) Modification of system parameters.
(d) Recording system parameters and information on output devices.
(e) Control of output devices interfaced with the central controller.

FIG. 35 shows the keys used in the system and their arrangement. A key switch 130 (FIG. 35) is provided to prevent unauthorized individuals from changing information programmed into the system. When this switch is in the "operate" position, information may be only recalled for inspection. The system is periodically monitoring the keyboard and performs functions without interfering with reader polling. The display panel is used in conjunction with the keyboard as an aid to the operator.

FUNCTION KEYS

OPT Key

The OPT key is used to program into the system certain available options and their code number is:

1. Audible Enable
2. Printer Enable
3. Print Valid Cards
4. Print Alarms
5. Time Zone Enable
6. Reader Polling Additional functions may be added in the future. The OPT key is enabled only when the key switch is in the "program" position.

LIST Key

The LIST key is used for outputting information stored in the system memory to the Printer or any other output peripheral interfaced to the system. As with the OPT key, the LIST key is enabled only when the key switch is in the "program" position.

RCRD key

The RCRD key is used to record or modify information in system memory. It is enabled ony when the key switch is in the "program" position.

OPEN key

The OPEN key is used to grant access at any reader location from the control console.

CARD KEY key

The CARD KEY key is used in sequences and operations involving card key numbers or parameters.

TERM key

The TERM key is used in sequences and operations involving card reader terminals.

ACCS LEVEL Key

The ACCS LEVEL key is used for sequences and operations involving access levels.

TIME ZONE KEY

The TIME ZONE key is used in sequences and operations involving time zones.

NEXT Key

The NEXT key is used to speed up keyboard functions. It is used in conjunction with parameter keys for incrementing the displayed item.

TO KEY

The TO key is used for group storing of data into system memory. This greatly decreases the time required for loading information.

SYS RESET Key

The SYS RESET key is used to generate a system reset interrupt and send the program to an initialize routine. This key is enabled only when the key switch is in the "program" position.

ENTRY EXIT Key

The ENTRY EXIT key is used to program entry/exit status of the individual card key.

CLOCK Key

The CLOCK key is used to switch the clock display from time to day of week to day of the year. It is also used when setting these parameters.

SYS STAT Key

The SYS STAT key is used for acknowledging received alarm and other system status conditions.

ISSUE Key

The ISSUE Key is used for functions involving the card key issue level.

VOID VALID Key

The VOID VALID key is used for voiding or validating system parameters.

· Key

The · key is the execute key and causes the system to perform the previously loaded key sequence.

CLEAR Key

The CLEAR key is used to clear display entries or cancel key sequences which have been entered.

Numeric Key

Keys 0 through 9 are numeric keys which are used with the previously described keys in the various sequences.

Figure 19:
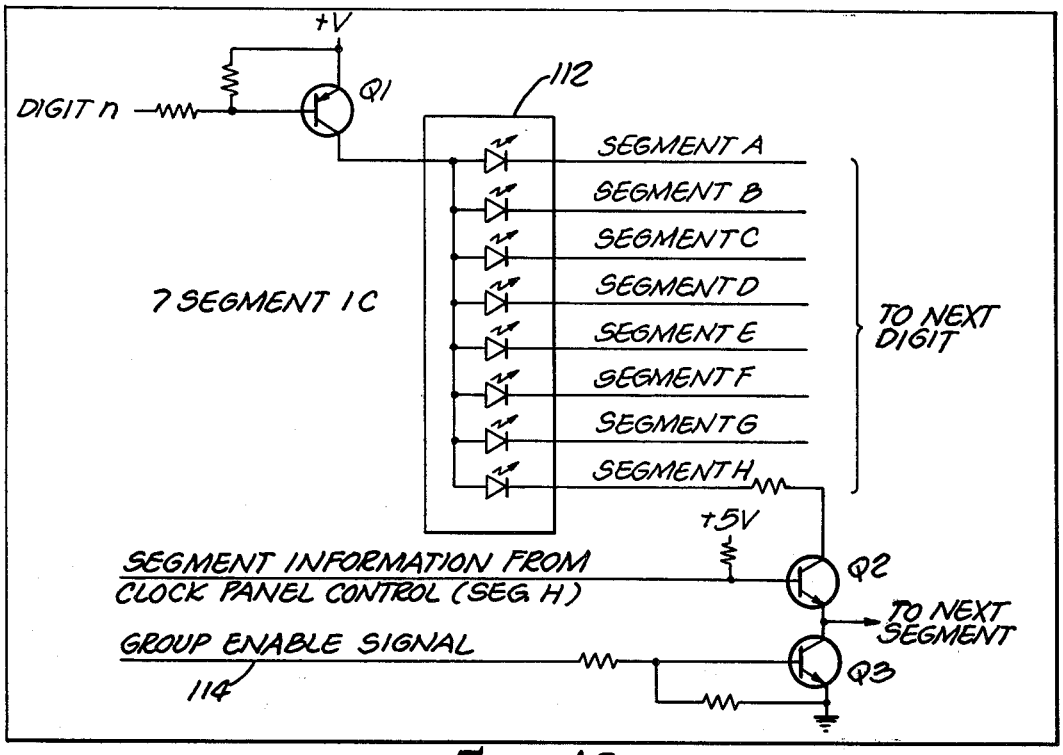
FIG. 19 is a block diagram showing the manner of single digit operation of the display panel of the access control system of the present invention.

Referring now to FIG. 19, a transistor Q1 turns on and supplies a 7-segment display element 112 with +V, which is about 7 volts. Segment H in element 112 cannot conduct unless transistor Q2 is turned on by segment information. The same is true of the other segments (whose transistors are not shown). Circuit operation is not completed until transistor Q3 conducts. The operation of Q3 is controlled by a group enable signal 114 from the clock/panel control board 880.

The printer interface 610 (FIGS. 2 and 20) of the preferred embodiment of the access control system of the present inventions operates as two functional parts: (1) a data buffer driver section 612 and a control section 614.

Figure 20:
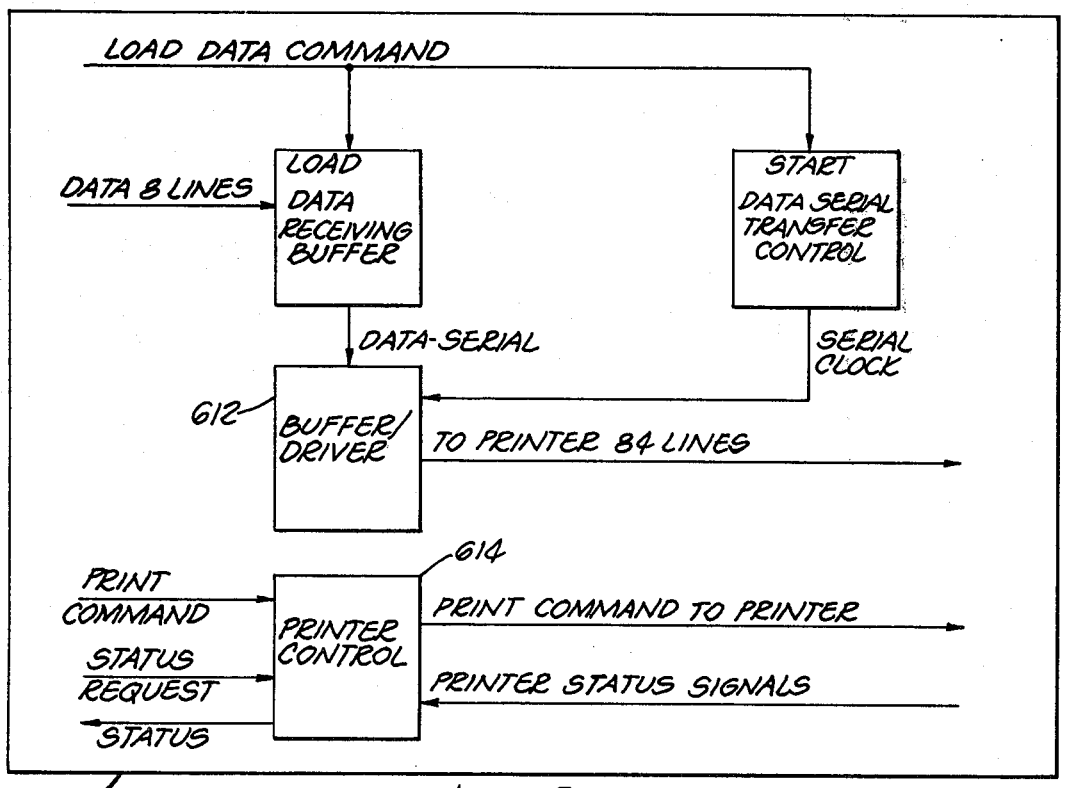
FIG. 20 is a block diagram of the printer interface circuit of the central controller portion (FIG. 2) of the access control system of the present invention.
Figure 21:
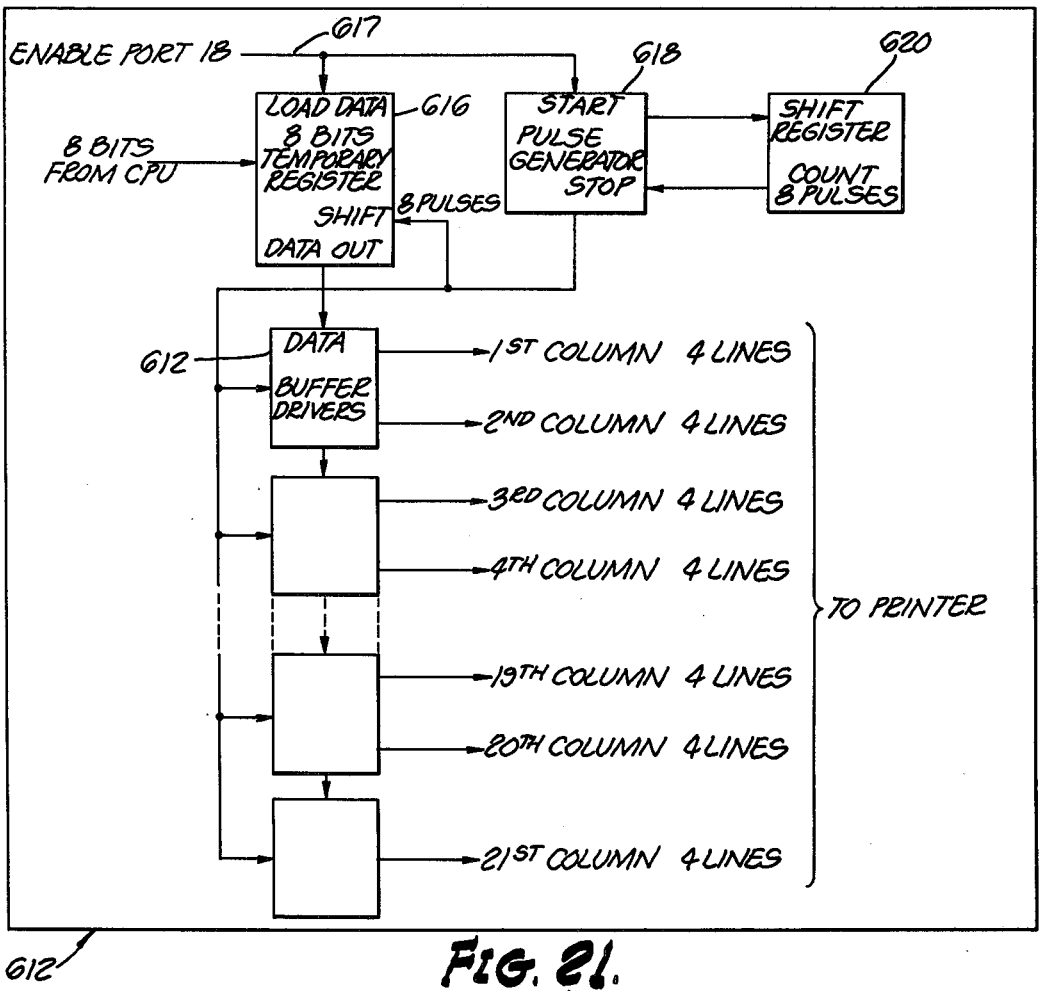
FIG. 21 is a block diagram showing the data buffer-driver circuitry of the printer interface portion (FIG. 20) of the access control system of the present invention.

Referring to FIGS. 20 and 21, of the printer interface 610 accepts 21 columns worth of data from the CPU 505 in parallel mode, 2 columns at a time. Since each column is a 4-bit binary number, the 8-bits from the CPU make up two columns of data. The data is held in a temporary register 616 (FIG. 21). At the same time a pulse generating signal 617 is generated to trigger the pulse generator 618 which causes 8 pulses to be generated. These pulses clock the data into the buffer drivers 612 which is an 8-bit shift register. Once a pulse is generated it is followed by 7 more pulses. The number of pulses (8) is controlled by an 8-bit shift register 620. Once all of the 8-bits are in the data buffer drivers 612, the interface waits for the next set of data. Note that at this time only the first two columns are provided with the data. When the next data is shifted into the data buffer the first 2 columns move into the third and fourth columns and the first and second columns are replaced with the new data.

In this fashion the data buffer is provided with all 21 columns worth of data. Note the 11 CPU data transfers must occur to provide the 21 columns with the data. In actuality there are 22 columns provided in the interface board, but only 21 columns are used in the printer. This means that the upper half of the data first transferred will not be used in the actual printing.

Figure 22:
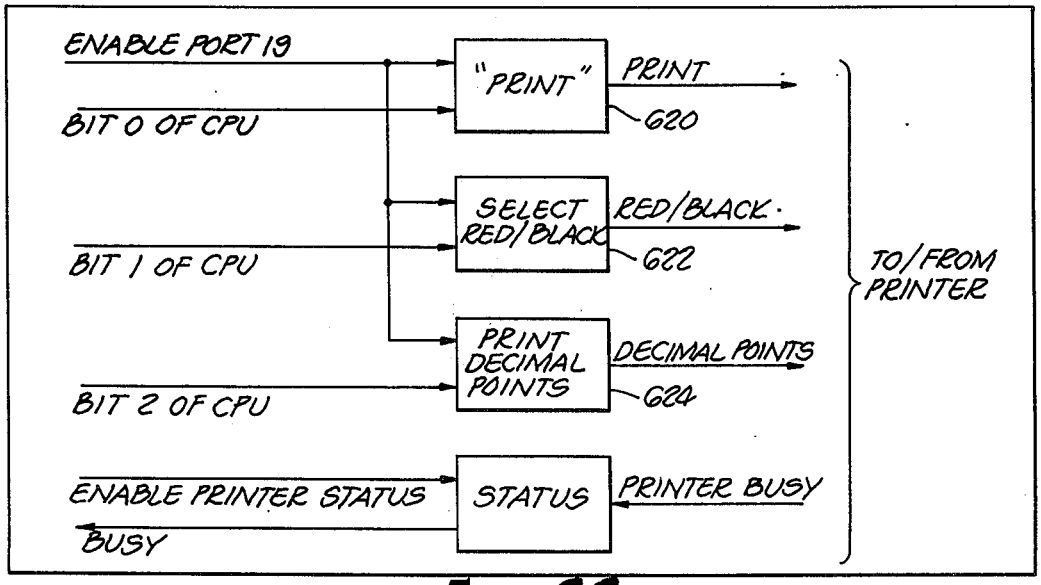
FIG. 22 is a block diagram of the printer control circuitry of the printer interface portion (FIG. 20) of the access control system of the present invention.

Referring to FIG. 22, when the data buffer/driver 612 (FIG. 20) is filled with proper data, the printer interface is ready to issue a print command to the printer. The CPU 505 issue a print command at any time via a print circuit 620. With the print command the CPU 505 may select either black or red print via a "select red/black" circuit 622. Also decimal points at fixed column locations may be printed via a "print decimal point" circuit 624.

The printer control section also checks for the printer status in response to a CPU request. A "printer busy" status line is brought to the interface board. This status bit is sent to the CPU when interrogated.

The decimal points may be printed in two ways. One is to treat the decimal point as column data. That is, a decimal point may take up one column. The other is to utilize the hard-wired decimal points. These decimal points do not take up any column and are located right next to a character.

The reader interface 250 (FIG. 2) provides the link of communication between the remote reader terminal 200 and alarm monitors and the CPU 505 in the central controller 100. Parallel data from the CPU 505 is converted to serial format and transmitted to all terminals 200, and serial data received from the terminals is converted to parallel format for the CPU. The received data is checked for transmission errors with status information which is available to the CPU 505 via the PROM and RAM memories. Each interface module 250 can control 16 terminals, eight reader interface modules may be installed in the central controller 100.

The basic steps for communication between the CPU 505 and the reader terminals 200 via the reader interface modules 250 are:

1. Select desired reader interface module.
2. Read status flags.
3. Transmit data.
4. Read data.

With reference to FIG. 24, a detailed description of the foregoing functions or operations and the circuitry for implementing these functions will now be given.

Before the CPU 505 can initiate a transmission it must first determine whether or not the transmit buffer in a universal asynchronous receiver/transmitter (UART) 252 is empty. The CPU does this in two cycles. First, data lines QRSEL (module select), QMAD4 (flag select), and QPT10 (set latch) are made true. These inputs to a read/transmit command generator 254 first set up a steering latch in the generator. In the second cycle the CPU 505 makes data lines QPTϕ2 (read flags/data) true. This input to the read/transmit command generator 254 produces an output on a status word enable (SWE) line 256 to the UART 252. The appropriate flag line will be made true and the flag data will be sent to the CPU.

If the buffer in the UART 252 is empty, a transmitter buffer empty (TBRE) line 258 will be true and the CPU will begin its interrogate transmission routine. If the buffer in the UART 252 contains other flag data, the CPU will perform other operations momentarily and then return to examine the flags.

The CPU transmission routine also consists of two cycles. First, the module select line 250 and the set latch lines 262 are made true. In the second cycle, parallel data for the interrogate word enters TR1 to TR8 in the UART through data lines QMABϕ to QMAD7, and the transmit (QPT11) line to the read/transmit command generator 254 is made true. The latter produces an output on the transmitter buffer load line to the UART 252, which causes the interrogate word data to enter the buffers. At the end of the second cycle, the transmitter buffer load signal is removed, which causes the UART to begin transmitting the interrogate word in serial format.

While waiting for response from the terminal, the CPU continues the flag reading routine, searching for data available (DA), parity error (PE), and frame error (FE). The response from the terminal must be received within a certain time limit. During this period the terminal is polled four times. If there is no response after the fourth transmission, the controller is programmed to cause a system fault condition to alert the operator. The controller polls each reader in the system once per cycle. Four complete polling cycles are required before the system fault condition is generated.

The serial data from each terminal enters the reader interface 250 through the appropriate optical isolator (RX1 to RX16) and is converted into normal 5 volt logic levels before entering a receive channel selector 270. At the time when the interrogate word data enters the UART 252, the terminal address component of this data also enters the receive channel selector 270. This address data set latches in the receive channel selector to allow only a response from the correct terminal to travel through.

Any extraneous signals which might possibly appear at the inputs are blocked. The serial data is transmitted to the UART when it enters at the receive input R1. This signal also causes the illumination of a receiver indicator, RX.

The serial data is clocked into the UART 252 and enters the buffers. When the last bit of data has been clocked in, the DA flag is made "true"internally and is then available for the next status word enable (SWE).

To read data the CPU first determines whether a receive register in the UART contains data. This is also done in two cycles. Having determined that the buffer contains data, the CPU first makes the module select line 260, data select line 272, and set latch line 262 true in order to set the sterring latch in the read/transmit command generator 254. On the second cycle the read flags/data line 274 is made true, and this produces an output on the read data (RRD) line 276 to the UART. This releases the response word from the buffers in parallel format on dat line ZINDϕ (input data bit zero, ϕ, from peripheral equipment) to ZIND7 for the CPU.

The first bit in the response word indicates whether or not a card key is in the reader at the reader terminal 200 at the time of polling. If no card is present, only one word will be sent by the reader/terminal. The program recognizes this by the first bit and it expects only one word. If the first bit in the response word indicates that a card is present, the program expects eight words and repeats the data reading routine until all eight words have been received.

After the terminal response has been received in its entirety, the read flags/data signal 274 is dropped, the latch in the read/transmit command generator 254 resets and the read data line to the UART is dropped. Concurrently, a data ready reset (DRR) line 278 to the UART resets the DA flag.

When reader terminals 200 are connected directly to the central controller 100, the response from each terminal enters the reader interface module through an individual optical isolator and then passes through direct connection to the receive channel selection 270. The desired address is set by latches and only a response from the correct terminal can pass through to the UART 252.

When a terminal expander 230 (FIG. 1) is used in the system, the response from all terminals connected to the terminal expander enter the corresponding reader interface module through only one optical isolator, which is normally RX1. Since the output of RX1 enters the receive channels selector 270 at channel 1, and channel 1 is internally configured to accept only responses from terminal address 1, a means must be provided to enable the multiplexed signals from all terminal addresses to enter and pass through the receive channel selector 270.

Switches S1 and S2 are provided on the module for this purpose. These switches are in 16-pin dual in line packages with each package containing 8 single pole switches. Adjacent to the devices are screened the symbols $\frac{1}{2}$, $\frac{2}{3}$, $\frac{3}{4}$, etc., up to 15/16. The symbol $\frac{1}{2}$ represents terminal addresses 1 and 2, and symbol $\frac{2}{3}$ represents terminal addresses 2 and 3, etc. By closing the switch across the terminals designated $\frac{1}{2}$, the incoming signals will be applied to both the channel 1 and channel 2 inputs to the receive channel selector 270, and the internal addressing circuitry will allow responses from both terminal 1 and terminal 2 to pass. Generally, the terminals connected to a terminal expanded 230 will start at address 1 for that unit and continue in sequence to the highest address connected. In this case the switches are closed across $\frac{1}{2}$, $\frac{2}{3}$, etc., up to and including the highest address number. If the terminals connected to a terminal expander do not start at address 1, the multiplexed signal will enter the reader interface 250 at the optical isolator for the lowest numbered terminal. In this case the switches are closed only in the positions from the lowest terminal address to the highest terminal address. It should be noted that any addresses on the reader interface module 250 which are not wired for terminals being multiplexes through the terminal expander are free to have terminals connected directly to them.

The power system 1000 (FIG. 2) of the central controller 100 is a multi-voltage power supply which operates on ac line voltage to provide the necessary dc voltages to the electronic modules in the controller. In addition it accepts battery power inputs to provide power to protect information stored in memory, and it provides signals to indicate battery status and primary power being turned on or off.

Figure 23:
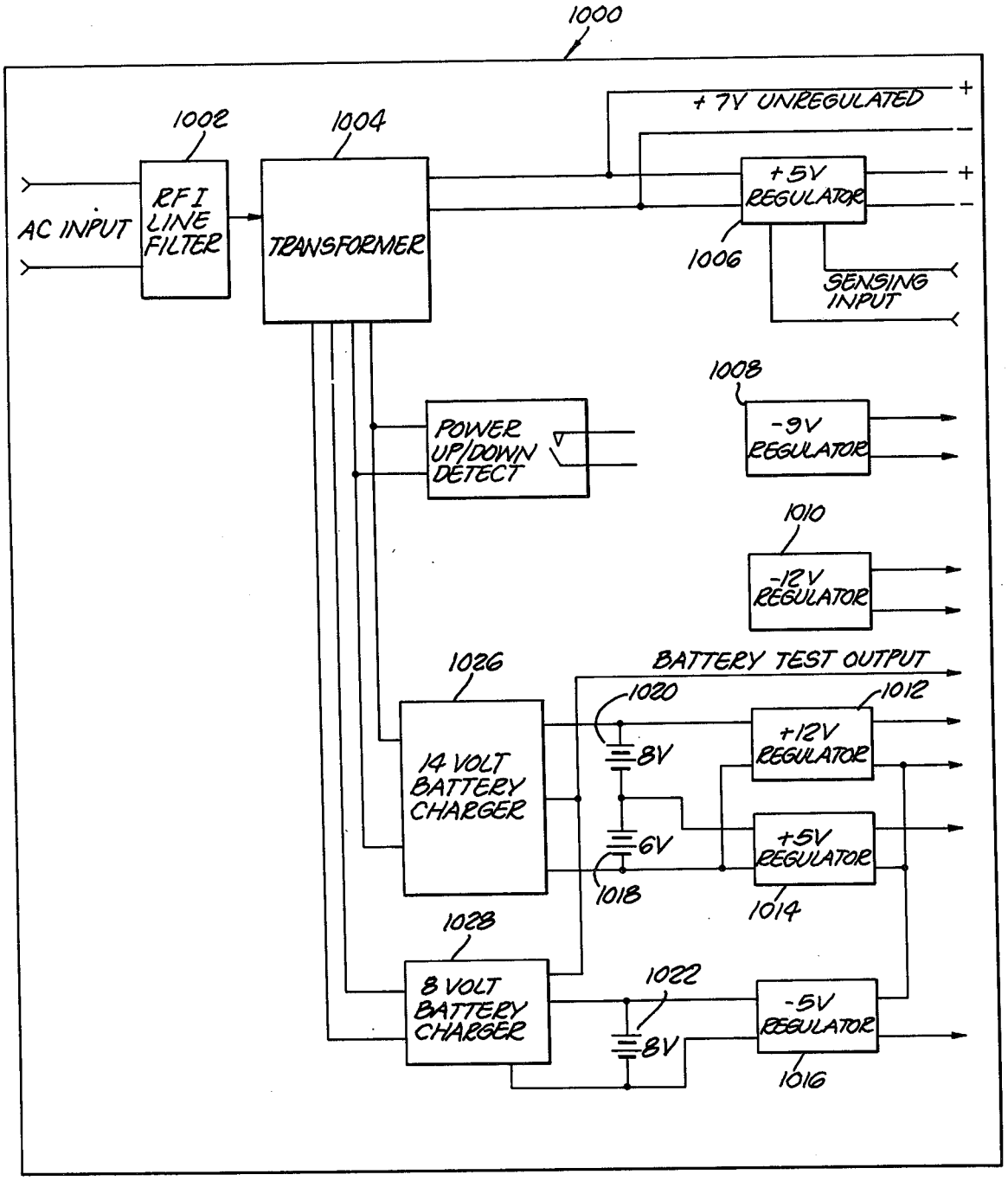
FIG. 23 is a block diagram showing the power system of the central controller portion (FIG. 2) of the access control system of the present invention.

Referring to FIG. 23, power from an ac power line enters the power supply 1000 through a fuse and a radio frequency interference (RFI) line filter 1002. The output from the filter 1002 then travels through a connector (not shown) having a plug which has jumper wires to return the circuit back through the connector and to the primary of a power transformer 1004. The primary winding has several taps for operation on a number of line voltages, and the location of the wires in the jumper plug determine which taps are used and thereby establishes the operating voltage for the unit. The secondary side of the transformer has several windings which are used as the inputs to the various dc regulators and battery charge circuits.

Series regulators 1006, 1008, 1010, 1012, 1014 and 1016 are used for all supply voltages, and the +5 volt supply has a switching preregulator to increase its efficiency. The output of each regulator is individually fused and contains current foldback and overvoltage protection circuitry.

The power for the memory system and the clock of the system is maintained during a loss of primary power with the use of three batteries; two are 8 volt and one is 6 volt. The 6 volt battery 1018 and one 8 volt battery 1020 are connected in series across both the +12 volt regulator 1012 and the +5 volt regulator 1014. The second 8 volt battery 1022 is connected across the -5 volt regulator.

Two battery charger circuits are used. One charger circuit 1026 is for the 6 volt and 8 volt battery combination, and the other charger circuit 1028 is for the second 8 volt battery. These are trickle charge circuits which normally maintain the batteries at full charge. Higher current levels are used for charging discharged batteries and will fully charge the batteries in 8 hours. Crossover from primary to battery power is instantaneous, and there is no interruption of power to the system.

The batteries are constantly monitored for proper voltages levels, and a saturated transitor output is provided to the front panel to illuminate a battery test indicator (an LED). If the batteries are not connected to the controller 100, or if the battery voltages fall outside of specified limits, this transistor is turned off and the battery test indicator will become dark.

The clock and memory circuits of the system are protected against loss of information during power transistions by a power up/down detect circuit. A relay closure is provided 5 milliseconds after the last regulator has reached regulation. This relay will open 5 milliseconds before any regulator goes out of regulation. The CPU 505 can operate on the memory and clock modules only when this relay is closed. When the relay is open, the CPU cannot perform these operations and there will be no sudden power demands which might otherwise disturb the clock and memory circuits.

PERIPHERAL EQUIPMENT AND OPERATION

Following are further detailed descriptions of the various types of peripheral equipment which may be used in the preferred embodiment of the access control system of the present invention, and the manner in which the peripheral equipment interfaces and operates in conjunction with the various parts of the central controller.

READER TERMINAL

Figure 31:
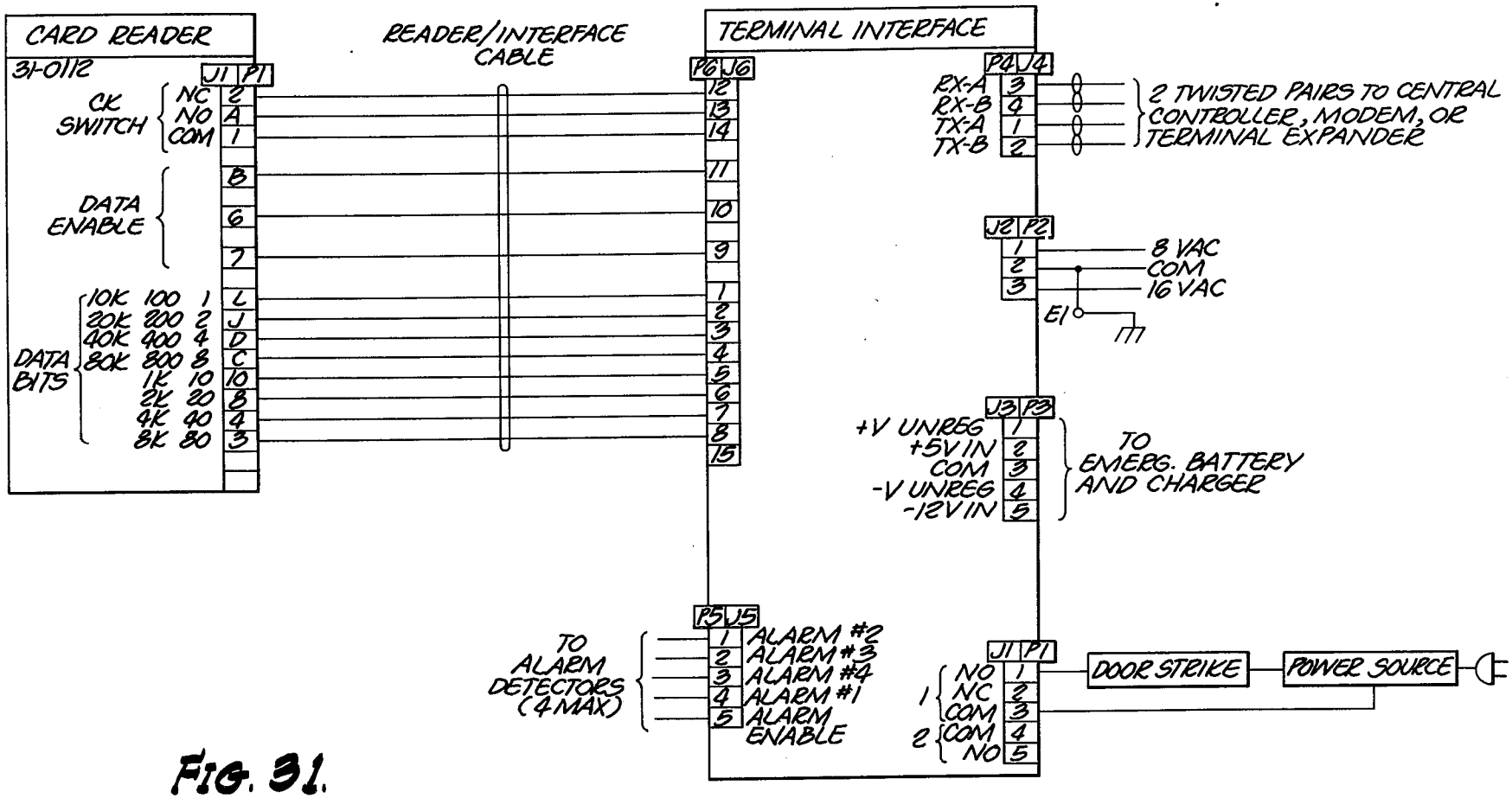
FIG. 31 is a diagram showing the card reader-terminal interface interconnection in the access control system of the present invention.

As noted above, each reader terminal 200 (FIG. 31) composed of two units: a card reader 210, FIG. 26 (e.g., such the general type of reader of U.S. Pat. No. 3,581,030, for example) and a terminal interface unit 220 (FIG. 27). The card reader preferably is mounted outside the restricted area. A multi-wire cable connects the two units (i.e., the reader and the interface unit) electrically. All critical circuitry is located within the terminal interface unit. Thus tampering with the card reader cannot enable access to the secured area.

CARD READER AND LOCK

The card reader and lock performs two basic functions: (1) it reads data from an acceptable card key and transmits these signals through a cable to the terminal interface; and (2) denies entry to the holder of an unacceptable card and does not transmit data from such a card.

When a card key (e.g., such as the card of U.S. Pat. No. 3,611,763) is inserted into a reader 210, (e.g., such as the reader of U.S. Pat. No. 3,581,030, for example) the card encounters a stop before it reaches maximum depth. The stop is caused by a magnetic lock section which has a combination established by a matrix of "combination set" card inserted in the rear of the reader. If the card key has the porper magnetic coding for the combination, corresponding to the code for the facility or individual customer, the lock releases to allow the card to travel to maximum depth. If the inserted card key is not properly coded to match the matrix or "combination set" card, the magnetic lock portion does not release and the card cannot be inserted further.

When a properly encoded card key unlocks the lock portion of the reader, the added increment of travel of the card key actuates a microswitch which starts a data enable sequencing circuit in the terminal interface unit. The added increment of card travel also positions additional coding on the card key over a bank of magnetic reed switches. This magnetic coding, which is in the form of data, closes appropriate reed switches to transmit the signals through the cable to the terminal interface unit 220.

PROGRAMMABLE CARDS

Both the card key and the matrix card employed in the card reader at each reader terminal are constructed in layers. A magnetic core material is laminated between outer layers which are made of plastic. The card key may optionally have photographs or other printed matter under a plastic overlay.

The core material is magnetized in small areas to form a pattern of magnetized data bits. This concept is described in U.S. Pat. No. 3,611,763.

Each card key contains two codes; magnetized data corresponding to some of the positions on the matrix card are read from the top surface of the card and, in addition, another set of data bits is encoded to represent data read from the bottom surface of the card. The data, in turn, represents an identification or employee number.

The cards are magnetically encoded after the lamination process, and this coding can be changed or updated at a later time with the use of special coding equipment. Because they can be magnetically recoded or reprogrammed, these cards are called "programmable".

MAGNETIC LOCK SECTION

The magnetic lock section of the card reader at each reader terminal is a card-operable, programmable magnetic lock. The operating principles of the lock are shown and described in U.S. Pat. No. Re. 27,753, although the specific embodiment of the lock in the card reader of the present invention differs in some minor details from the lock shown in U.S. Pat. No. 27,753.

In the preferred embodiment of the present invention the magnetic lock is in the upper part of the card reader assembly. Below the matrix card position or slot is a moveable core containing magnets which are free to move a limited distance in a vertical direction. Without a matrix card or a card key in place, all magnets rest at the bottom of their enclosures. The lower ends of the magnets in the back half of the core rest in matching holes in a fixed locking plate. The moveable core is normally caused to move by the insertion of a card key in its slot and pushing the end of the card key against a projection on the back of the moveable core. Without a matrix card in place, however, these magnets in the core and locking plate prevent the core from moving more than the slight distance corresponding to the clearance between the magnets and the holes in which they are locked.

When a matrix card is inserted, its pattern of magnetized data matches the magnet pattern and the magnets are attracted up to the matrix card. If the matrix card did not have an additional code this would lift all of the magnets out of the locking plate and free the moveable core. In practice, however, the matrix card is given an individual code by punching out certain magnetized areas. With the coded matrix card in place, the magnets below the holes in the card remain in the locking plate and the core remains locked.

The card keys for use with the matrix card are magnetically encoded with data in the positions corresponding to the holes in the matrix card. This encoding is in opposition to the polarities of the magnets in those positions. The opposing magnetic fields push the magnets upward out of the locking plate, freeing the core and enabling the card key to be inserted to full depth.

The possible combinations obtainable from the variations in polarities on the matrix card, the magnets, and the selection of punches hole positions on the matrix card are almost unlimited. Every installation or facility has its own individul code. Only card keys specifically programmed for a particular installation can unlock the magnetic locks in readers in that installation.

CARD READER SECTION.

The data encoded in the card keys is "read" in the lower part of the card reader assembly. Below the card key slot in the reader is a block containing a pattern of magnetic reed switches. (See U.S. Pat. No. 3,581,030) When the card key is fully inserted, a corresponding pattern on the card is positioned directly over the reed switches.

As best shown in FIG. 26, there are 20 reed switches in the reed switch block of the reader. One reed switch is required for each bit. The card key is magnetically encoded with magnetized data corresponding to the code for the card identification number. The magnetic field of magnetized bit on the card, reinforced by the field from the bias magnet above, closes the reed switch below. For dependable operation, the reed switches must close within a certain range of magnetic flux values. To provide this magnetic bias, a calibration card is installed below the switches to provide the amount of magnetic flux required by each switch to operate within the required limits. This calibration is not adjustable in the field unless special calibration equipment and test cards are utilized and the work performed by factory-trained personnel.

Each magnetized spot on a card may close one read switch. Switches not needed in the code do not close. To assure that they do not close the card key is magnetized in those positions (i.e., positions corresponding to the switches which are to remain open) with polarities opposing the fields of the magnets and, instead of reinforcing each other, the two magnetic fields tend to cancel out. The minute magnetic fields remaining are far too weak to affect the switches which are to stay open.

DATA TRANSMISSION

When the magnetic lock is unlocked with a properly coded card key, indicating the proper facility, the moveable core is freed to travel a predetermined distance. As the core moves, a vertical post on the front part of the core actuates the microswitch on the top plate of the card reader. This switch, through the connecting cable, initiates the data enable sequencing circuit in the terminal interface unit. The circuit connects circuit ground to data enable 1 (E1), and data enable 2 (E2), and data enable 3 (E3) in that order. (See FIG. 26) When data enable 1 is grounded, the circuits closed by the reed switches for bits 1 through 8 connect a ground through each appropriate diode and then through the cable to the data input circuit in the terminal interface unit, as shown in FIG. 26. Similarly, when data enable 2 is grounded, the data for bits 9 through 16 are connected to the data input circuits; and when data enable 3 is grounded, the data for bits 17 through 20 are connected to the data input circuit, as shown in FIG. 26.

TERMINAL INTERFACE

The central controller 100 (FIG. 1) continuously polls all reader terminals 200 and the reader terminals always respond. When a card key is inserted into a card reader, the terminal interface 220 converts the parallel data from the reader to serial form and includes this information in its response. When the data meets all entrance criteria, a signal from the controller enables the terminal interface to grant access at that location. Additionally, the terminal interface monitors the status of four alarm inputs and provides this information in its response. The terminal interface 210 is best shown in FIG. 27.

DATA RECEPTION

Referring to FIG. 27, three types of messages may be transmitted to and received by the terminal interface 220. These are (1) interrogate (the polling message), (2) acknowledge, or (3) access. The access message is actually composed of both the acknowledge word and an access word.

The received data enters the terminal interface through an optical isolator 211 and is converted to normal logic levels. The incoming data is indicated by the illumination of the receive indicator, RX (a light emitting diode). The data then enters the input of the universal asynchronous receiver/transmitter (UART)212. The data enters serially until one full word has been entered, at which time a data available (DA) signal is internally generated in UART 212. Concurrent with the DA signal, the contents of the data register in the UART 212 and error flags are produced in parallel at their respective outputs, and are applied to appropriate decode logic circuits.

The data available (DA) signal is used as one term of the error detect logic. If either parity error (PE), frame error (FE), or overrun error (OE) are detected, the decoding function will stop and a data available reset (DDR) signal will immediately be generated by an error detect and reset control circuit 213.

When a data word has been determined to be error free, the output of the error detect logic 213 is used as one term of address decode logic 214. If the UART 212 data outputs, RR5 through RR8, do not contain the correct address as compared with the settings of an address selector switch 223 (FIG. switches 1, 2, 4, and 8 of U18), the decoding function will stop. Concurrently, a data available reset (DDR) will be generated. When the correct address data is compared and decoded, the output of the address decode logic 214 is used as one term of message decode logic 215.

The message decode logic circuit 215 determines whether the message is (1) interrogate, (2) acknowledge, or (3) access, and produces a corresponding output for each. When the message is interrogate, this output results in either a 1-word or an 8-word transmission to the controller 100. When the message is acknowledge, no obvious action occurs. When the message is access, access is granted at the terminal location.

DATA TRANSMISSION

Referring again to FIG. 27, when the interrogate word has been successfully decoded, the output of the message decode circuit 215 is applied to the card key detect logic 216 and to transmit routine generator logic 217. The operation at this point depends upon whether or not a card key is present in the card reader at that moment.

When the card key detect circuit 216 determines that no card key is present in the reader, a single transmit command is issued to the UART 212 through the transmit buffer load (TBRL) input in the UART 212. The card key detect circuit then establishes an inhibit condition to the transmit routine generator 217, which prevents successive transmit commands from being generated. The inhibit condition is also maintained at the enable sequence generator 218, thereby preventing advancement of the data enable outputs to the card reader.

When the single transmit command signal is applied to the TBRL input of the UART 212, eight data bits are parallel-loaded into the transmitter buffer (TR 1 through TR 8). When the TBRL signal is removed, serial data is transmitted from the TO output of the UART 212 to the line driver 219. The line driver 219 operates in a current loop mode and matches with the system interconnection requirements. The transmission of data is indicated by the illumination of the Transmit indicator, TX, a light emitting diode.

When the card key detect circuit 216 determines that a card key is present in the reader, a card key present latch is set to remove the inhibit condition from the transmit routine generator 217 and also from the enable sequence generator 218. The interrogate signal provides the initial transmit signal to the UART transmit buffer load (TBRL) inputs. When a card key is present, eight words are transmitted. As the first TBRL signal is applied, the first word (data bits enabled by "Enable O") is loaded into the transmit register of the UART 212 and the transmit register empty (TRE) output goes to a false condition. As the TBRL signal is removed, transmission of the first word begins. Concurrently, an enable advance signal 220 is generated which steps the enable sequence generator 218 and it produces a true output at "Enable 1".

When transmission of the first word has been completed, the transmit register of the UART 212 is empty once more and the TRE output returns to a true level, thereby causing a second transmit command (TBRL) to be generated. This causes the transmission of the second data word and steps the enable sequence generator 218 to "Enable 2".

The transmit routine continues to produce transmit commands and enable advance pulses 220 until eight words have been processed and transmitted. When the enable sequence generator 218 has reached the last position, an "end" of enable signal is produces. This signal resets the card key present latch and restores the routine inhibit signal 221.

ACKNOWLEDGE AND ACCESS CODE RECEPTION

The acknowledge code is a word returned to the terminal interface to acknowledge receiving the full 8-word transmission. No obvious action occurs although a latch is set to enable the access circuitry to become operational.

The access code consists of both the acknowledge word and the access word. This signal is sent by the central controller 100 only when the card key in use meets all entrance criteria. It results in a signal to the access timer/driver 221 which actuates the DPDT access relay 222 and which, in turn, enables a door strike to be energized and grant access at that location. When the entry sequence is entered at the central controller keyboard 120 to grant access at a terminal location, this same access code is sent to the appropriate terminal interface.

CONTROLS

A variable resistor R15 (FIG. 27) on the terminal interface module or printed circuit board controls the time period during which the access timer/driver energized the access relay after the access code is received from the central controller 100. The time period is adjustable from one to ten seconds.

When the switch SW1 (FIG. 27) is in the on-line position the reader terminal 200 operates in the normal bidirectional manner and access is controlled by the central controller 100. When the switch SW 1 is in the off-line position, the reader terminal 200 becomes an independent access control system and access is controlled only by the successful insertion of a card key into the reader.

Terminal address switches S1, S2, S4, and S8 are provided on address module 223. Setting these switches to a binary equivalent of 0 to 15 (corresponding to addresses 1 to 16) determines the address code to which the particular terminal will respond.

TERMINAL EXPANDER

The terminal expander 230, best shown in FIG. 28, is essentially a mutliplexer which an accommodate up to 16 reader terminals and/or alarm monitors. Signals from the terminals and/or monitors are multiplexed and transmitted to the central controller 100 over a single pair of wires. Signals from the central controller 100 are received over a single pair of wires and are transmitted to all terminals connected to the terminal expander 230.

Referring to FIGS. 1 and 28, the central controller 100 continuously polls all addresses in the system. The interrogate words for the 16 addresses controlled by the reader interface module 250 to which the terminal expander 230 is connected all enter the terminal expander through a twisted pair of wires. The signals pass through a common optical isolator 231 and enter all 16 dual line drivers TX1 to TX16 (FIG. 28). The dual line drivers TX1 to TX16 transmit the signals to all terminals connected to the terminal expander 230 through a twisted pair of wires to each terminal. The signal from the optical isolator 231 also illuminates a transmit indicator, TX (a light emitting diode), to indicate that the signal from the controller is being transmitted to the terminals.

SIGNALS FROM TERMINALS

Referring to FIG. 28, a terminal (i.e., a reader terminal 200 or an alarm monitor 300) will respond only when its particular address is contained in the interrogate word. The terminal response enters the terminal expander 230 through a second twisted pair of wires 233*a* and 233*b* connected to the receive (RX) input for that terminal address. The signal passes through individual optical isolators RX1–RX16 and enters the common dual line driver 232. The outputs of all of the individual optical isolators connect to the common dual line driver 232 in parallel. The common dual line driver 232 transmits the signal through a second twisted pair of wires 231*a* and 231*b* to the central controller.

MODEM AND MODEN/TERMINAL EXPANDER

The modem 400, shown in some detail in the block diagram of FIG. 29, is an asynchronous modulator-demodulator unit which converts digital pulses to analog waveforms and vice versa. As shown in FIG. 1, one modem is required at the central controller 100 location and another modem is required at each reader terminal location. The digital data is placed on a carrier by the modulator section, matched to a telephone line, and transmitted over the line as FSK signals. The reverse occurs at the opposite end when the demodulator recreates the original digital signals.

MODULATOR/TRANSMITTER

As best shown in FIG. 29, when the central controller scanner polls the reader terminals 200, the digital data enters the modem at the optical isolator 402. The data input is in the form of a two-wire differential current loop, and is optically isolated from the modem logic circuits and power supply. The output of the optical isolator 402 illuminates a transmit indicator TX, to provide a visual indication of data transmitted via the digital I/O. The output of the optical isolator also enters the transmitter/modulator 404 wherein the digital data is converted to frequency shift keying (FSK) for transmission over a telephone circuit. The matching transformer (T2) is driven by the transmitter module and the resulting FSK signal appears at the analog I/O, connector J3.

The FSK signal uses two frequencies: 1200 Hz, the "Mark" frequency (representing a digital high), and 2200 Hz, the "Space" frequency (representing a digital low). Tupe 3002 service, 4-wire full duplex telephone circuits are required. The modem data rate is 1200 BAUD.

RECEIVER/DEMODULATOR

Referring to FIG. 29, the FSK signals enter the modem at the reader terminal location through the Analog I/O. The data signals travel through the matching transformer, T1, and enter the receiver/demodulator 405 where they are converted to digital form. The output level of ± 12 volts is converted to +5 and 0 volts by a level shifting circuit 406. The level shifter output illuminates a receive indicator RX to provide a visual indication that the data signals received are now being applied to a line driver 408 for transmission through 1 and 2 of J2. A third indicator, CXR, is provided to monitor the presence of the received carrier frequency.

TERMINAL RESPONSE

The response from the reader terminals 200 to the central controller 100 through the modems 400 repeats the operations described above. The digital signals from the terminal are converted to FSK form by a remote modem, transmitted over a telephone circuit to a modem at the controller location, and converted back to digital form for controller use.

MODEM CONTROLS

As shown in FIG. 29, the modem contains a digital loopback circuit (S2) and an analog loopback circuit S1. These circuits are not used during operation and are set in the "off" positions. They are used for test maintenance purposes.

ALARM MONITOR

The operation of each alarm monitor 300 is similar in many ways to the operation of the terminal interface of the reader terminal. When an alarm monitor 300 is polled by the central controller 100 it always responds. Its response, however only provides data pertaining to the status of its 8 alarm inputs. It does not provide card data and cannot enable access at any location.

ERROR DETECT

The data available (DA) signal is used as one term of the error detect logic 308. If either parity error, frame error, or overrun error are detected, the decoding function will stop and a data available reset (DDR) signal will immediately be generated.

ADDRESS DECODE

When the data word has been determined to be error free, the output of the error detect logic is used as one term of an address decode logic circuit 310. If the UART data outputs, RR5 through RR8, do not contain the correct address code as compared with the settings of the address selector switch (switches 1, 2, 4, and 8 of address module 323, the decoding function will stop. Concurrently, a data available reset (DDR) will be generated. When the correct address data is compared and decoded, the output of the address decode logic 310 is used as one term of the message decode logic circuit 306.

MESSAGE DECODE

The message decode logic 306 determines when a message is the interrogate word, as this is the only word that is ever sent to the alarm monitor.

DATA TRANSMISSION

Figure 30:
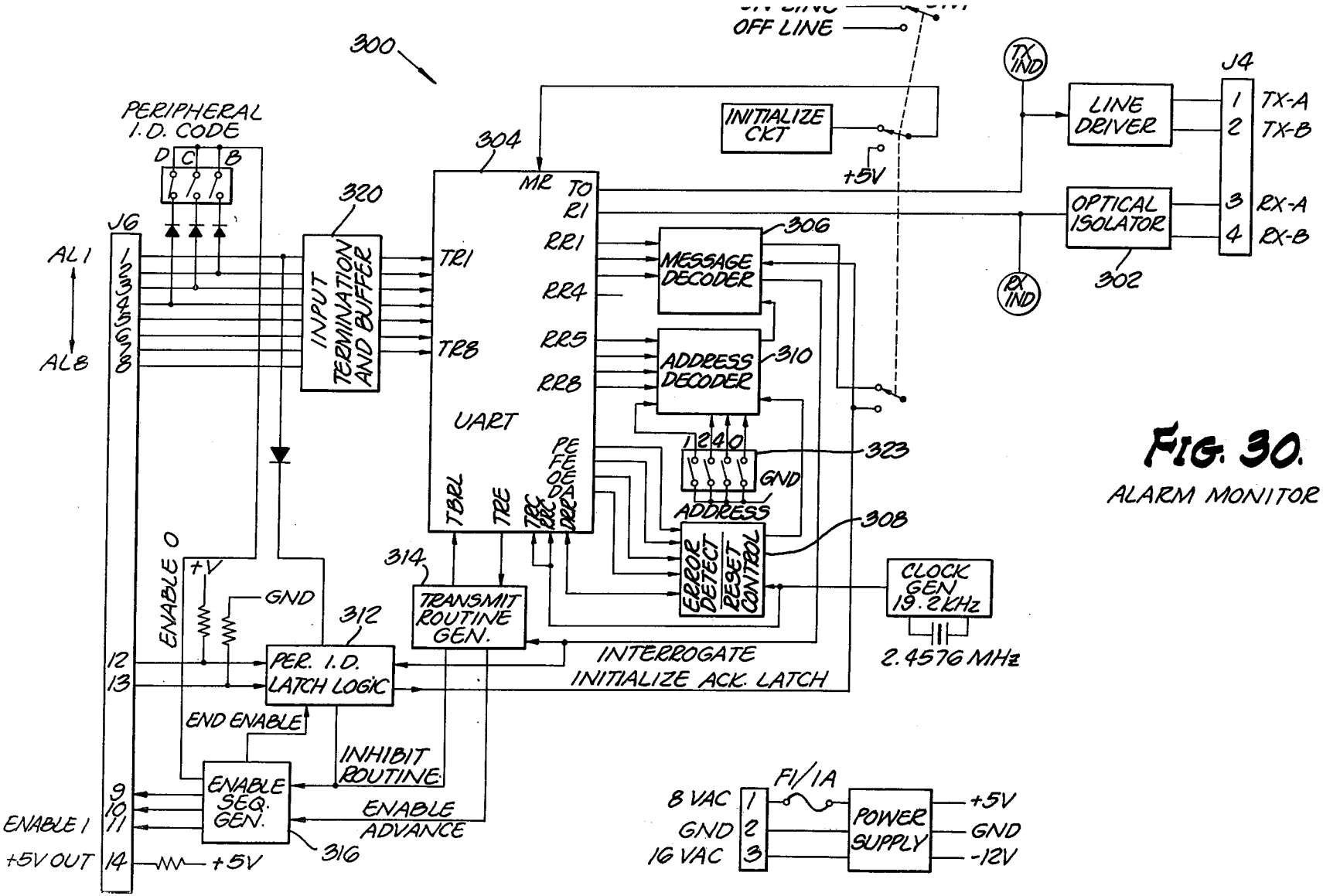
FIG. 30 is a block diagram of the alarm monitor circuitry utilized in the access control system of the present invention.

Referring still to FIG. 30, the output of the message decode circuit 306 is applied to a peripheral identification latch logic circuit 312 and to a transmit routine generator logic circuit 314. The interrogate signal from the central controller 100 provides the initial transmit signal to the UART 304 transmit buffer loan (TBRL) input.

As the first TBRL signal is applied, the first word (data bits enabled by "Enable O") is loaded into the transmit register of UART 304 and the transmit register empty (TRE) output goes to a "false" condition. As the TBRL signal is removed, transmission of the first word begins. Concurrently, as enable advance signal is generated which steps the enable sequence generator and it produces a "true" output at "Enable 1".

When the transmission of the first word has been completed, the transmit register of the UART 304 is empty once more and the TRE output returns to a "true" level, thereby causing a second transmit command (TBRL) to be generated. This causes the transmission of the second data word and steps the enable sequence generator 316 to an "Enable 2" condition.

The transmit routine continues to produce transmit commands and enable advance pulses until eight words have been processed and transmitted. When the enable sequence generator 316 has reached the last position, and "end of enable signal" is produced. This signal resets the peripheral identification latch logic 312 and restores the routine inhibit signal.

The alarm data is produced as a result of the "Enable 1" output of the enable sequence generator 316. This output is applied to all eight alarm detectors at each reader terminal and through their normally closed contacts to the data inputs at pins 1 through 8 of connector J6. From J6 the data inputs travel through an input termination and buffer circuit 320 to inputs TR1 through TR8 of the UART 304. When the contacts in all alarm detectors are closed, the alarm status for each is a logic "0". When alarm detector contacts are open, the alarm status for that alarm is a logic "1". A logic "0" produces a dash on the controller display. A logic "1" results in the display of the identifying number of the alarm detector having the open contacts. Any change in alarm status (from 0 to 1, or from 1 to 0) will produce an alarm condition at the central controller 100.

OPT KEY SEQUENCES

The OPT key is used for displaying the status of the varius system options. The key sequence for the operation is:

[OPT] [X] [·]

where [X] is any single or dual numeric key sequence. The void/valid indicating LED's are used to indicate whether the option is enabled or not. Depressing the VOID VALID key causes the LED's to change state. For this sequence the Mode 1 and 2 LED's are off. Depressing the OPT key in this sequence causes OP to be displayed in segments 00 and 01.

[OPT] [0] [·]

causes the status of options 1 to 9 to be displayed in segments 03 to 11. A dash indicates it is disabled and the option number indicates it is enabled. To allow for future expansion of the options, a two digit sequence should be allowed.

[OPT] [1] [0] [·]

would be used for displaying the status of options 11 through 19 (no option 10). In this case the 1 would be displayed in segment 02 and the remainder of the display is as previously described. The options which are presently defined are:

1. AUDIBLE ENABLE — Enables the audible alarm for system status conditions. The AC power up condition will override this option.

2. PRINTER ENABLE — Enables the printer for printing of all card transactions and system status conditions. The LIST function will override this condition.

3. PRINT VALID CARDS — Enables the printer to print only valid card transactions and ignore void cards.

4. PRINT ALARMS — Enables the printer for the printing of alarms.

5. PRINT SYSTEM FAULTS — Enables the printer for the printing of system faults such as bad reader terminals, memory failure, etc.

6. TIME ZONE ENABLE — Enables the use of time zones for both readers and cardholders. When disabled, dashes appear in the clock display (segments 25 to 28).

Sequences for Programming of System Parameters

The parameters which can be programmed into the system are:

(a) CARD KEY DATA

Void/Valid Status
Issue Level
Access Level
Time Zone
Entry/Exit Status

(b) READER TERMINAL DATA

Void/Valid Status
Time Zone
Access Level Combinations

(c) TIME ZONE DATA

Zone Number
Day of the Week
Start Time
Stop Time

CARD KEY DATA

To allow individuals to use their card keys they must be programmed into the system. There are various sequences which can be used to store the information and recall it to the display. The primary sequency for recalling card key data is:

[CARD KEY] [X] [·]

This recalls from memory the information associated with card number X which is any five digit number within the system's limits. When CARD KEY is depressed, the Mode 1 LED is turned on, and 0.0 displayed in segments 04 and 05. This is to indicate to the operator where the numeric entry will be displayed. The card number (except issue level) is then entered from the keyboard, most significant digit first, and the digits are loaded into segment 04 as each one is entered. Leading zeroes are blanked. When the [·] key is depressed the information associated with the card number is read from memory and displayed in the appropriate section on the display. The display will remain until cleared with the CLEAR key.

To change or load the system parameters associated with the card keys, the desired information must be entered on the display. The following sequences are used for setting the parameters:

[ACCS LEVEL] [X] [·]

[TIME ZONE] [X] [·]

-continued

[ISSUE] [X] [·]

[VOID VALID]

[ENTRY EXIT]

Depressing the above function keys causes the appropriate parameter display to go to zero and when the number(s) X are entered to be displayed as defined in the display sections. System limits determine the numbers which may be entered. Depressing the VOID VALID key or ENTRY EXIT key causes these parameters to change their state. After all of the desired parameters are displayed the information may then be recorded. If part of the information does not have to changed, that parameter is ignored in the key sequence. To record the displayed card key information the [RCRD] key is depressed. The record function is internally verified and an indication made to the operator that the operation is complete. It is indicated by displaying an F in display segment 24. To facilitate the recording of card keys with identical information the following sequence may be used.

[CARD KEY] [X] [·] [TO] [·] [RCRD]

X indicates the lower limit of the range of card numbers to be recorded and Y the upper limit. As Y is entered, it is displayed in segments 07 to 11. The display indicates when the operation is in progress by displaying a P in segment 24.

READ TERMINAL DATA

The sequence:

[TERM] [X] [·]

causes the void/valid status, time zone, and alarm status of reader terminal X to be displayed. Depressing [TERM] causes the mode 1 LED to be turned on and a zero displayed in segment 18 which is the unit's digit of the terminal display. As the number is entered it is displayed in segments 16 to 18 as the digits are entered. Execution of the function causes the time zone number associated with the terminal to be displayed in segment 24, the alarm conditions to be displayed in segments 03 to 10, and the appropriate void/valid status LED is turned on. The parameters may be changed by first changing the display using:

[VOID VALID]

[TIME ZONE] [X] [·]

and then recorded by depressing the [RCRD] key.

[RCRD] [TERM] [·]

As with other sequences, the information is stored and verified and completion is indicated to the operator by displaying an F in segment 24. The previously displayed information remains on display.

As with card keys, group storage may also be performed on reader terminals.

[TERM] [X] [·] [TO] [·] [RCRD]

will record the terminal void/valid status and the time zone indicated for all terminals between the number initially displayed in the terminal section of the display and Y which replaces the initial display in segments 16 to 18.

TIME ZONE DATA

To utilize time zones the individual zones must be programmed with start and stop times for each day. To display a particular zone, the sequence used is:

[TIME ZONE] [X] [Y] [·]

where X is the time zone number and Y is the day of the week. If the display is cleared and [TIME ZONE] is depressed, the Mode 2 LED is turned on and a zero is indicated in the time zone segment 01. X will be displayed in 01 and Y will be displayed in the proper segment (16 to 22). The [·] will cause the stored START and STOP times to be displayed.

To change the displayed time, the sequence is used:

[TIME ZONE] [X] [TO] [Y] [·]

X is a 4 digit start time and Y is a 4 digit stop time. Recording to time zones is accomplished with:

[RCRD] [TIME ZONE] [·]

To group load time zones use sequence:

[RCRD] [TIME ZONE] [TO] [X] [Y] [·]

X represents the upper limit of the zone number and Y the day of the upper limit zone. An appropriate display should be used to indicate limits and completion of the operation.

ACCESS LEVEL DATA

Each card reader used in the system must be associated with one or more access levels. To determine if a particular terminal is valid for a particular access level the following sequence is used:

[TERM] [X] [·] [ACCS LEVEL] [Y] [·]

The first half of this sequence was previously described. The other half of the sequence causes the void/valid LED's to indicate the status for the displayed terminal-access level combination. The access level number is displayed in segments 20, 21 and 22. To change status the void/valid key is depressed and then the sequence below records the operation:

[RCRD] [ACCS LEVEL] [·]

When completed the access level number is displayed in segments 08 to 10.

To group load access level - terminal combinations the applicable sequence is:

RCRD ACCS LEVEL TO X .

OR

RCRD ACCS LEVEL TO X TERM TO Y .

The first sequence will void or validate the access level displayed to level X for the displayed terminal. The second sequence is used for combinations with different terminal numbers. X may be the same as the initially displayed access level.

CLOCK SEQUENCES

A clock display is provided in the upper right hand corner of the front panel. The four segment display is used to display the time, day of week, and day of year. The CLOCK key is depressed to change the display from one format to the next. If time zone operation had been disabled a C is displayed in segment 24 until the CLEAR key is depressed which places the dashes back on the clock display. To set any of these parameters the following sequence is used:

RCRD CLOCK TO X .

The parameter which is presently displayed is the one which the sequence will affect. The value of X entered must be an allowed value and is displayed in the TO section of the display. Neither the Mode 1 or 2 LED's are used.

NEXT Key SEQUENCES

The NEXT key is used for two functions. The first is to increment the display to take a look at the "next" item in sequence. For example, if you are examining card keys and number 1220 and its parameters is displayed, the number 1221 and its parameters may be brought up to the display by using the NEXT key. The sequences used for these operations are:

CARD KEY NEXT .

TERM NEXT .

ACCS LEVEL NEXT .

TIME ZONE NEXT .

The TIME ZONE sequence will cause one of two displays to appear. If card key programming is being performed, the time zone number will be incremented. If the start and stop times are being examined or programmed then the sequence will increment the day of the zone and display the recorded times. If the seventh day is displayed the sequence will cause the first day of the next time zone to be displayed.

The second function of the NEXT key is to aid in the searching of memory for specified conditions. The sequence:

CARD KEY NEXT TERM .

skips all card keys above the displayed card number which have access levels that are not valid for the displayed terminal, and displays the first card key which meets the condition. The memory is searched only up to its defined limits. The display should indicate that a search operation is being performed and when it is completed.

Other sequences which are allowable are:

CARD KEY NEXT ACCESS LEVEL .

Displays next card key with the same access level.

CARD KEY NEXT TIME ZONE .

Displays next card key with the same time zone.

CARD KEY NEXT ENTRY EXIT .

Displays the next card key with the same entry exit status as the one displayed.

CARD KEY NEXT ISSUE .

Displays the next card key with the same issue level indicated by the display.

CARD KEY NEXT VOID VALID .

Displays the next card key with the same void valid status as displayed.

TERM NEXT ACCS LEVEL .

Finds and displays the next terminal which is valid for the displayed access level.

TERM NEXT TIME ZONE .

Finds the next terminal which has the displayed time zone associated with it.

TERM NEXT VOID VALID .

Finds the next terminals which has the displayed void valid status.

ACCS LEVEL NEXT TERM .

Finds and displays the next access level which is valid for the displayed terminal.

LIST Key SEQUENCES

It is desirable to obtain hard copy records of information stored in the system memory. A LIST function is provided to output data to the printer or any other output device which the system might be interfaced.

The available sequences are:

LIST CARD KEY .

Outputs one line to the printer which contains the data associated with the card number presently in the display.

[LIST] [CARD KEY] [TO] [X] [.]

Outputs to the printer stored data for all card keys from the number displayed to X. The number X should be displayed in the TO section of the display.

[LIST] [CARD KEY] [TERM] [TO] [X] [.]

Outputs to the printer the card key data for cards from the displayed numbers to X which are authorized for access at the displayed terminal.

[LIST] [CARD KEY] [ACCS LEVEL] [TO] [X] [.]

Outputs to the printer card key data from the displayed number to X for card with the displayed access level.

[LIST] [CARD KEY] [TIME ZONE] [TO] [X] [.]

Outputs card key with the displayed time zone in the range of the displayed card number to X.

[LIST] [CARD KEY] [ENTRY EXIT] [TO] [X] [.]

Same as above LIST functions except the card keys outputted have the same entry exit status as displayed. Depressing the entry/exit key does not change the status of the display.

[LIST] [CARD KEY] [VOID VALID] [TO] [X] [.]

Same as previous sequence except the displayed void/valid status is used to determine the card numbers to be outputted.

[LIST] [CARD KEY] [ISSUE] [TO] [X] [.]

Outputs the card key data between the displayed number and X which has the displayed ISSUE level.

[LIST] [TERM] [.]

Prints one line of information for the displayed terminal.

[LIST] [TERM] [TO] [X] [.]

Outputs to the printer terminal data from the displayed number to X.

[LIST] [TERM] [TIME ZONE] [TO] [X] [.]

Outputs terminal data for terminals with the displayed time zone to terminal.

[LIST] [TERM] [VOID/VALID] [TO] [X] [.]

Outputs terminal data for terminals with the displayed void/valid status from the indicated terminal to X. Depressing the void/valid key doesn't change the status of the display.

[LIST] [ACCS LEVEL] [.]

Prints data for the access level displayed. The data contains the valid terminals in the access level.

[LIST] [ACCS LEVEL] [TO] [X] [.]

Prints data for access level displayed to level X.

[LIST] [ACCS LEVEL] [TERM] [TO] [X] [.]

Outputs the access level for which the displayed terminal is valid. The displayed access level to X is the range of the search.

[LIST] [TIME ZONE] [.]

Prints start and stop times for the time zone and day of the week currently displayed.

[LIST] [TIME ZONE] [TO] [X] [Y] [.]

Prints all start and stop time data from the displayed zone and day to zone number X, day number Y.

To allow for the outputting of data to some other I/O device, the software is capable of accepting a one digit number between LIST and the system parameter such as

[LIST] [X] [CARD KEY] [.]

Assume X equals 0 for the printer and if no number is depressed, set X equal to 0 as the default condition.

OPEN Key FUNCTION

An OPEN key is provided to allow access to be granted from the keyboard. When access is granted it is recorded on the system printer and any other output device interfaced to the system. The sequences used are:

[OPEN] [TERM] [X] [.]

[OPEN] [TERM] [TO] [X] [.]

For the first sequence, access is granted at Terminal X. For the second sequence, all terminals from the displayed one to X will be granted access.

SYS STAT KEY FUNCTION

The SYS STAT key is used for displaying and acknowledging System Status activity. When this key is depressed, the first entry in the System Status Buffer is displayed. If no more of the System Status conditions exist in the buffer the appropriate LED's are turned off (alarm, void, request, or system fault). The displayed item is cleared from the buffer for new transactions. The next item in the buffer is displayed when the key is depressed again. If no fault or alarm conditions are in the buffer, the display is blank.

CLEAR Key

The CLEAR key is used to erase an incorrect numeric entry to allow for reentry and to remove the system from the keyboard program mode once a sequence is started. The CLEAR key will also turn off the audible alarm if it is on and clear the display panel except for the clock to allow card key and other transactions to be displayed.

SYS RESET Key

The SYS RESET key is enabled only when the key switch on the front panel is in the "program" position and interrupts the CPU with a 05 (RST) instruction for initiating the start up routine.

ADDITIONAL KEYBOARD SEQUENCE REQUIREMENTS

Only numerics within system defined limits are allowed to be programmed. Illegal entries will cause the display to go to 0 or blank.

Keyboard operations do not take the system away from reader polling for more than 250 milliseconds per scan of all readers.

The display contains adequate information to allow the operator to see the limits established for the various TO functions.

When search operations are being performed, a P is indicated on segment 24 and also an F is indicated in segment 24.

When a keyboard operation is being performed, the display cannot be used for card key or other transactions until cleared.

SYSTEM STATUS AND ALARM MONITORING OPERATIONS

The central controller is capable of receiving and processing of system status and alarm data. The information is printed and/or outputted as the condition occurs and may be recalled from the system status buffer for viewing by the operator on the display panel. Besides alarm conditions, other system status conditions are void card key requests, reader terminal failures, and memory system faults.

ALARM & SYSTEM STATUS PROCESSING

Card readers transmit data containing alarm contact switch status as previously described. Other system status conditions are monitored as part of normal program functions. If an alarm, void request, or system fault condition is detected, the following event take place:

(a) Appropriate status indicator LED is displayed.

(b) The condition is stored in the system status buffer so that it can be recalled by the operator. The information which is required is described in the display panel. Buffering is provided for 64 transactions.

(c) The information is outputted to the printer along with the time of day.

(d) If enabled, the audible alarm is set.

Provisions are made to allow the status buffer to be expanded if necessary.

The alarm status of any terminal may be displayed by the appropriate keyboard sequence.

The aplication of primary power will not be handled as an alarm condition, but the power fail LED will be turned on and a printout with the time and day of the year will be application

PRINTER OPERATIONS

The system is interfaced to a 21 column printer with a speed of about 3 lines per second. The printer is buffered to prevent the limiting of system speed. A minimum of twenty-two lines of print must be buffered with the capability of expanding by adding additional RAM buffer memory. The printer is capable of printing in both red and black and the print drum contains full numerics and some alpha characters. The printer is used to record all card key, alarm, and system status transactions and for listing information stored in the card key data memory.

PRINTER FORMATS

Ten basic formats have been assigned as shown in FIG. 36. The software routine allows for the adding of other routines at a later time.

Format 1 is outputted once an hour on the hour in black, and whenever the clock is changed.

Format 2 in black is used to indicate valid card entry requests (without the void reason code) and red with the void reason code for void entry requests.

Format 3 in red is used for alarm conditions.

Format 4 in red is used when access is granted from the keyboard.

Format 5 in red is used to indicate a system fault.

Format 6 is used for LIST card key functions. Valid cards show a blank in column 7 and Out cards in blank in column 5. Void cards are indicated in red.

Format 7 is used for LIST TERM functions. Valid terminals have a blank in column 7. Void terminals are indicated in red.

Format 8 is used for LIST ACCS LEVEL functions, void access level termed points are indicated in red.

Format 9 is used for LIST TIME ZONE functions.

Format 10 in black is printed at the end of a LIST TO function to indicate completion.

The print buffer is used during LIST operations to allow incoming transactions to be stored until the LIST function is complete.

Prnt buffer full is a system fault condition and when this occurs the system slows down so that no transactions will be lost.

CARD KEY DATA MEMORY SYSTEM

The card key data memory system is a peripheral used to store all required information for programming card holders into the system, and programmable system parameters. The system is expandable to 65,536 words in 4, 8, 12, or 16 bit word lengths. The storage media is solid state devices and battery power is provided to maintain data when primary power is lost.

SYSTEM DATA

All system parameter data is stored in the lower portion of memory. Data packing techniques used to minimize the amount of memory required. The main parameters and the approximate memory required are:

(a) Access Level - Card Reader Combinations

For a maximum system of 128 levels and 128 readers using one bit per combinations requires 1024, 16 bit words.

(b) Time Zone 8, 7 day time zones require 112, 16 bit words assuming one word for each start time and one for each stop time per zone per day. Time zone times are to the minute.

(c) Card Reader Terminal Status

| | |
|---|---|
| Void Valid Status | 1 bit |
| Time Zone | 3 bits |

This is the pertinent information concerning each reader and is stored as a back-up to the identical data stored in RAM memory which is more easily accessible by the CPU.

(d) Real Time Clock Information

Adequate information must be stored to maintain time functions. This includes time to the minute, day of the week and day of the year. Several approaches can be used requiring (e) Keyboard Controlled Options Several options are operator programmable such as printer enable, audible alarm enable, etc. The status of all options must be stored in protective memory so that when power comes on no programming is required.

CARDHOLDER DATA

The major portion of the memory system is delegated to card key data and one word is assigned to each card key. The maximum data associated with each card is fifteen bits divided as follows:

| | |
|---|---|
| Void/Valid Status | 1 bit |
| Issue Level | 3 bits |
| Time Zone | 3 bits |
| Access Level | 7 bits |
| Entry/Exit Status | 1 bit |

The system parameters will define how many bits will be allocated for each function to allow for system of reduced capacity. In some cases functions may even be eliminated such as time zone and entry/exit features, and total word length reduced.

If no memory is present, the CPU will see a 1 on each input data line.

PERIPHERAL INPUT/OUTPUT DEVICE SPECIFICATIONS

General Information

This section defines the input/output specification requirements for operating software for interfacing the peripheral devices to the CPU. The defined peripherals are:

Card Reader Interface
Keyboard
Display Panel
Card Key Data Memory System
Real Time Clock
Test Reader

Data Format

All data to or from the CPU and peripheral devices is handled by the CPU's A register (accumulator). The eight bits of this register are designated $A_0$ to $A_7$, and all data is right hand justified. That is $A_0$ is the least significant bit and $A_7$ the most. Each byte may be described as two hexidecimal digits and this convention is used throughout the section. Below is an example.

| A Register | $A_7$ | $A_6$ | $A_5$ | $A_4$ | $A_3$ | $A_2$ | $A_1$ | $A_0$ |
|---|---|---|---|---|---|---|---|---|
| Data | 1 | 1 | 0 | 0 | 0 | 0 | 1 | 1 |

Input/Output Port Assignments

The central processor instruction set provides for 32 directly addressable I/O ports. Input ports are 00 to 07 and output ports are 08 to 1F (Hex). The number of input ports may be expanded by hardware decoding of the contents of the A register during an input instruction, and this technique is used with some devices. Below is a list of the input/output ports used and the peripherals asssociated with them:

| Ports (Hex) | Function |
|---|---|
| 02 | Reader Interface Input Data |
| 03 | Test Reader |
| | Real Time Clock |
| | Printer Status |
| 06 | Card Key Memory Input Data |
| 07 | Keyboard |
| 0A | Reader Interface Control |
| 0B | Reader Interface Output Data |
| 0C | Display Address |
| 0D | Display Data |
| 12 | Printer Data |
| 13 | Printer Control |
| 16 | Card Key Memory Output Data |
| 17 | Card Key Memory Control |

The input data channel on the CPU module has pull-up resistors, and therefore if a peripheral device is addressed which is not in the system a 1 will be read by the CPU on all input data lines.

The failure of any device to respond to an input or output command does not cause the program to hang up. The peripheral is assumed not present or faulty and the program should proceed.

CARD READER INTERFACE

Functional Description

The card reader interface provides the link of communication between the remote card readers and the CPU of the central controller. Each interface module is capable of handling 16 readers and 8 modules may be used with the central controller. Data is formated by the interface for serial transmission and received serial data is reformated to parallel data for the CPU. Received data is checked for transmission errors with status information which is available to the CPU.

There are three basic steps in the communication between the CPU and card readers. The first is the selection of the desired reader interface module. The other two are for the transmission of data and the reading of data or status flags. The status flags contain the following information:

(a) Transmit Buffer Empty
(b) Data Available for Reading
(c) Parity Error
(d) Framing Error
(e) 1200/1300 Baud Module Indicator The status words are checked before transmitting or reading of data.

Peripheral Port Address and Codes

Output Port OA is used to select a reader interface module, and enable it for transmission, reading of data or reading of flags. The data which is outputted during the output instruction will determine the module selected and the operation which is to be performed. Bits $A_2$, $A_1$, and $A_0$ are the complement of the selected module. $A_4$ is set (1) for reading the status flags and $A_5$ is set for reading data. If neither $A_4$ or $A_5$ is set then the module is enabled for transmission. Both bits may not be set simultaneously. Bits $A_3$, $A_6$ and $A_7$ are not used for this operation. Below is a list of the accumulator codes and their meaning:

| Hex Code | Function |
|---|---|
| OF | Selects module #0 and enables it for transmission of data |
| IF | Selects module #0 and enables it to read the status flags |
| 2F | Selects module #0 and enables it to read data |

To select other modules the F in the above codes will be changed as follows:

E Module #1
D Module #2
C Module #3
B Module #4
A Module #5
9 Module #6
8 Module #7

After selecting the module, the desired operation is performed. Output port 0B is used to send the data to the reader interface module and initiate transmission to the remote card readers. The accumulator will contain the complement of the reader address and the transmission word type code. Bits $A_3$, $A_2$, $A_1$ and $A_0$ contain the reader address (F to 0) and bits $A_7$, $A_6$, $A_5$ and $A_4$ the transmission code. The codes are shown below with their meaning and represent the accumulator data during an output port 0B instruction

| Hex Code | Function |
|---|---|
| CF | Interrogate word to reader #1 and enable receive channel #1 |
| AF | Acknowledge word to reader #1 |
| 6F | Access word to reader #1 |

F can be replaced with any character to 0 for readers 1 to 16.

After the interrogate word is transmitted, the addressed reader if connected to the system will respond with at least one word. Based on a transmission rate of 1200 Baud:

Bit Time = 0.833 M Sec (Milliseconds)

Word Time = (12 Bits) = 9.99 M Sec

The minimum nominal delay based on zero transmission line delay between transmission of the interrogate word and the receiving of the response word is 20 MSec. Delay due to transmission lines is approximately 6 MSec/100 miles. For multiword responses, the next words will be about 10 MSec apart.

In anticipation of a response word a repetitive routine of status flag read commands must be performed until data is received or adequate time has passed to determine that no response is forthcoming. Output Port OA is used to enable the particular module from which the flags are to be read and input port 02 is used to read the data. Below are the data bits and their meaning:

| Bit | Flag | Significance |
|---|---|---|
| $A_0 = 1$ | Read data available | Indicates data is available |
| $A_1 = 1$ | Transmit Buffer empty | Indicates transmission data may be loaded and transmitted |
| $A_2 = 1$ | Parity Error | Indicates a parity error |
| $A_3 = 1$ | Framing Error | Indicates received data has no valid stop bit |
| $A_7 = 1$ | 1200/300 Baud Indicator | $A_7 = 1$ 1200 Baud, $A_7 = 0$ 300 Baud Data Rate |

When the presence of data is detected the error flags, parity and framing error, are checked, and then the actual data word can be read.

Reading of data is accomplished by outputting the proper code on port 0A for reading data and then reading the data on input port 02. After the first word has been read and stored, the status word is again checked for the data available signal. If a second word is not detected, then the single word is the full response. When a second word is detected, it can be assumed that eight words will be the transmission length. The status word and read data routines continue until all words of the response are read.

Once a particular module is enabled for transmission or data and flag reading, it is not necessary to repeat this step before each input operation unless another module is selected.

Received data will have the following format:

(a) Single Word Response

| | $A_7$ | $A_6$ | $A_5$ | $A_4$ | $A_3$ | $A_2$ | $A_1$ | $A_0$ | $A_0$ |
|---|---|---|---|---|---|---|---|---|---|
| | Alarm Status | | | | Peripheral ID Code | | | | Card Present = 0 |
| Alarm # | 4 | 3 | 2 | 1 | Hex Code (with Card present) | | | | |
| | Alarm Condition = 1 | | | | Card Reader | | | | E |
| | No Alarm Condition = 0 | | | | Entrance Reader | | | | C |
| | | | | | Exit Reader | | | | A |
| | | | | | 8 Alarm Reader | | | | G |

(b) Eight Word (Double four word) Transmission

First and fifth words are as above. Second, is the same as sixth, third the same as seventh and fourth the same as the eighth. All data received is the complement of the data encoded on the card keys.

CARD KEY DATA:

| BCD Coding | | | | | |
|---|---|---|---|---|---|
| Units | Tens | Hundreds | Thousands | Issue Level | Spare |
| 2nd and 6th words | | 3rd and 7th words | | 4th and 8th words | |

| | $A_7$ | $A_6$ | $A_5$ | $A_4$ | $A_3$ | $A_2$ | $A_1$ | $A_0$ |
|---|---|---|---|---|---|---|---|---|
| 2nd Word | 80 | 40 | 20 | 10 | 8 | 4 | 2 | 1 |
| 3rd Word | * | 4K | 2K | 1K | 800 | 400 | 200 | 100 |
| | | | | | | * | * | |
| 4th Word | SPARE | | | | ISSUE LEVEL | | | |

*Indicates the issue level of the card key. $A_7$ of the third word represents the most significant bit of the issue level. $A_0$ of the 4th word is the least significant bit. For example:

| | | 3rd Word | 4th Word | |
|---|---|---|---|---|
| | | $A_7$ | $A_1$ | $A_0$ |
| Issue Level | 1 | 1 | 1 | 0 |
| Issue Level | 5 | 0 | 1 | 0 |

BINARY CODING

2nd and 6th words, lower order byte
3rd and 7th words, upper order byte
4th and 8th words, issue level as in BCD coding
Issue level coding is the same as in BCD coding For an 8 alarm reader there will always be an 8 word response. The 1st word contains the peripheral type code and the four alarm bits are ignored. The 2nd word contains the alarm information as indicated:

| Alarm # | $A_7$ | $A_6$ | $A_5$ | $A_4$ | $A_3$ | $A_2$ | $A_1$ | $A_0$ |
|---|---|---|---|---|---|---|---|---|
| | 8 | 7 | 6 | 5 | 4 | 3 | 2 | 1 |

Alarm Condition = 1
No Alarm Condition = 0

For future data formats, the program should be flexible to allow the alternate use of the six spare data bits or all data words. As an example, for BCD card key coding, the 8K, 10K, 20K, 40K and 80K bits could be added to allow card numbers 99,999. Alternately, the data might have some meaning completely unrelated to a card key number and require separate processing.

KEYBOARD

Functional Description

The keyboard is the primary peripheral device used to program the security system parameters and enter card key data into memory. The keyboard is used in conjunction with the front panel display to examine information stored in the system memory.

The CPU must interrogate the keyboard to determine if any key is depressed. A status bit is presented to the CPU when the keyboard is interrogated to indicate when a key is depressed along with a five bit binary code to indicate the selected key.

PERIPHERAL PORT ADDRESS

The keyboard is wired to input port 07 and no peripheral selection code is required to be present in the A register (accumulator) of the CPU prior to the input instruction.

INPUT DATA FORMAT

A Register after input instruction S 1 1 $D_4$ $D_3$ $D_2$ $D_1$ $D_0$ Bit # 7 6 5 4 3 2 1 0

(a) Bit 7 (S) is the status bit which indicates the presence of a depressed key.

(b) If Bit 7 = 0 then a key is depressed

If Bit 7 = 1 then no key is depressed

Bits 0 through 4 ($D_0$-$D_4$) is the key code of the depressed key. Table I indicates the codes for the keys presently in the system. Expansion is provided for up to 32 individual keys.

(c) The status bit is automatically reset when the keyboard is interrogated.

(d) Bits 5 and 6 are not used.

TABLE I

KEYBOARD ENCODING

| Key | Hex Code |
|---|---|
| 0 | 7F |
| 1 | 7E |
| 2 | 7D |
| 3 | 7C |
| 4 | 7B |
| 5 | 7A |
| 6 | 79 |
| 7 | 78 |
| 8 | 77 |
| 9 | 76 |
| CLEAR | 75 |
| . | 74 |
| Void Valid | 6F |
| Issue | 6E |
| Sys Stat | 6D |
| CLOCK | 6C |
| Test Reader | 70 |
| Entry Exit | 6B |
| TO | 69 |
| NEXT | 68 |
| TIME ZONE | 67 |
| ACCS LEVEL | 66 |
| TERM | 65 |
| CARD KEY | 64 |
| OPEN | 63 |
| RCRD | 62 |
| LIST | 61 |
| OPT | 60 |
| SYS RESET | Generates RESTART 0 (05) Interrupt Instruction |

DISPLAY PANEL

Functional Description

The display panel is used to inform the system operator of card key and other transactions which are occurring, and to provide a visual aid in programming and recalling system data stored in memory. The display consists of 24 seven segment LED display elements (six with decimal points) and 11 discrete LED devices. The display has its own memory and multiplexing electronics to maintain information.

To display information a digit address must first be sent to the display to select the element which is to updated. The required data for the display element is then transmitted to complete the operation.

PERIPHERAL PORT ADDRESS

Output port OC is used for transmitting the display element address and port OD for sending the actual data.

When addressing a display element, bits 0 through 4 contain the five required address bits. Table II contains the hex code for addressing each display segment. Note that certain addresses are not used.

DATA FORMAT

Output port OD is used for transmitting display data. Below is the standard 7 segment display with the accumulator bit required to light each segment:

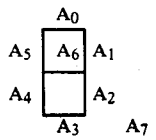

$A_n = 0$ ON $A_n = 1$ OFF corner to generate the colons for time relate displays.

Table II indicates the hex data code for various displays and the hex address code for elements of the display panel.

TABLE II

DISPLAY ADDRESS AND DATA CODES

| Hex Data Code | Character Displayed |
|---|---|
| CO | 0 |
| F9 | 1 |
| A4 | 2 |
| BO | 3 |
| 99 | 4 |
| 92 | 5 |
| 82 | 6 |
| F8 | 7 |
| 80 | 8 |
| 90 | 9 |
| 88 | A |
| C6 | C |
| 86 | E |
| 8E | F |
| C7 | L |
| 8C | P |
| 89 | b |
| 8B | h |
| BF | — |
| FF | Blank |

To set the decimal point on the allowable displays subtract hex 80 from the above data (inverts bit $A_7$). Other data characters can also be generated using any combination of display segments.

| Display Panel Format | Address |
|---|---|
| Upper Format (Mode 1) | |
| Card Key Number | |
| From: | 00, 01, 02, 03, 04, 05 |
| TO: | 07, 08, 09, 0A, 0B |
| Terminal | 10, 11, 12 |
| Access Level | 14, 15, 16 |
| Time Zone | 18 |
| Day | 1A, 1B, 1C |
| Lower Format (Mode 2) | |
| Time Zone | 01 |
| Start Time | 03, 04, 05, 06 |
| Stop Time | 08, 09, 0A, 0B |
| Sun. | 10 |
| Mon. | 11 |
| Tue. | 12 |
| Wed. | 13 |
| Thu. | 14 |
| Fri. | 15 |
| Sat. | 16 |
| Time | 19, 1A, 1B, 1C |

| Discrete LED | Address | Data Bit |
|---|---|---|
| Mode 1 | 0D | $A_0$ |
| Mode 2 | 0D | $A_1$ |
| Power Fail | 0D | $A_2$ |
| Valid | 1D | $A_0$ |
| Void | 1D | $A_1$ |
| In | 1D | $A_2$ |
| Out | 1D | $A_3$ |
| Audible Enable | 1D | $A_4$ |
| Alarm | 1D | $A_5$ |
| Void Request | 1D | $A_6$ |
| System Fault | 1D | $A_7$ |

Audible alarm is controlled as a display function. To turn on and maintain the alarm the $A_7$ bit of the accumulator must be 1 whenever the display is addressed. The addresses shown above will maintain the alarm in the off condition.

Sending an address to the display without sending data will cause the display to blank out.

CARD KEY DATA MEMORY SYSTEM

Functional Description

The card key data memory system is used to store operator programmable parameters, cardholder data, and any data that cannot be lost in the event of power failure. The memory is expandable up to 65,536 words and word lengths may be 4, 8, 12 or 16 bits.

PERIPHERAL PORT ADDRESSES AND FUNCTIONS

Output port 16 (Hex) is used to load the memory address and data for a write cycle. The memory address field is 2 bytes long (16 bits) as is write data for a 16 bit word. Therefore, two output operations are required to send the memory address from the CPU and two for the write data. For a read cycle only the address must be sent and the first byte is the lower order address. $A_0$ of the accumulator is the least significant bit and $A_7$ the most significant.

For a write cycle the two bytes of data are first sent to the memory before the address is transmitted. As with the address the first byte is the lower order data. If a write cycle is performed followed by a read at the same address, it is not necessary to retransmit the address, but it must if a red cycle is followed by a write.

Input port 06 is used by the CPU to read data from the memory. The memory contains data registers to store the two bytes of data until the CPU is ready to read them. The data will remain valid until a new memory cycle is initiated. Since the CPU can read only one byte at a time, two input operations are required to read the upper and lower order data.

Output port 17 is used to control the memory's operation. $A_0$, $A_1$ and $A_2$ of the accumulator define the function to be performed. $A_0$ is for initiating a cycle, $A_1$ determines a write or read cycle, and $A_3$ selects the upper or lower data byte to be read from the memory. Below is a list of the control commands loaded in the accumulator and outputted to the memory for various functions:

| Hex Code | Operation |
|---|---|
| 01 | Initiates a read cycle and selects the lower order data byte for the input operation. |
| 05 | Initiates a read cycle and selects the higher order data byte for the input operation. |
| 00 | Selects lower data byte for input without initiating a memory cycle. |
| 04 | Selects the higher order byte for input without initiating a memory cycle. |
| 03 | Initiates a write cycle. |

The address and data must be sent to memory before any cycle is initiated. When selecting the second byte of a read cycle after reading the first the $A_0$ bit must always be 0 so as to prevent the initiating of a new memory cycle. After a read cycle is initiated a 25 usec delay must be allowed before inputting the first byte.

REAL TIME CLOCK

Functional Description

A read time clock is provided for time function operations by the system. The clock is a 13 bit binary counter which is read by the CPU as two separate bytes. The counter is incremented once per minute and therefore takes about 5 days, 16 hours for a full count cycle. The eight bits of the lower byte contain the lower order counter outputs. The first 5 bits of the upper byte contain the remainder of the counter outputs. The most significant bit is a status bit to indicate when the counter has been updated. After the counter has incremented, reading the upper byte will automatically reset the status bit. The other two bits contain 150 Hz and 300 Hz clocks for use by the program.

The clock is to be used for generating the time in Military hours (0 to 23:59), day of the week (1 to 7) and the Julian day (1 to 366). Power of the clock is maintained by batteries when primary power is lost so the integrity of time functions can be maintained. The present clock conditions are always stored in battery protected memory, and using this information and the value of the clock when prime power service resumes, the time can be updated by software.

Peripheral Port Address and Select Code

The real time clock is wired to input port 03 of the CPU. When performing an input instruction involving the clock, it is necessary that the A register (accumulator) of the CPU contain the following Hex code for the listed operations:

| Hex Code | Operation |
|---|---|
| FC | Sets all clock bits to zero |
| FB | Reads the lower counter byte |
| FA | Reads the upper counter byte |

INPUT DATA FORMAT

| Register after Input Instruction (Upper Byte) | S | $D_6$ | $D_5$ | $D_4$ | $D_3$ | $D_2$ | $D_1$ | $D_0$ |
|---|---|---|---|---|---|---|---|---|
| | 7 | 6 | 5 | 4 | 3 | 2 | 1 | 0 |

(a) Bits 0 through 4 are data
(b) Bit 7 is the clock status bit If Bit 7 = 0 then clock data is valid and new If Bit 7 = 1 then data is not valid or new
(c) Bit 5 is a 300 Hz clock (50% duty cycle)
(d) Bit 6 is a 150 Hz clock (50% duty cycle)

TEST READER

Functional Description

The test reader is part of the front panel and is used to test card keys and verify card numbers. The presence of a card is sensed by the CPU just like any key on the keyboard.

After the presence of a card key is determined, then the data is read from the reader and displayed on the front panel elements 00 and 05 and remains on the display until cleared. The data is assumed to be in the same format (BCD or Binary) are received from remote card readers and read as three bytes.

Pheripheral Port Address and Select Code

The test reader is wired to input port 03 of the CPU. When performing a test reader input instruction, the following hex code must be in the CPU accumulator to read the individual bytes:

| Hex Code | |
|---|---|
| FF | Third Byte |
| FE | Second Byte |
| FD | First Byte |

A card is present if reading a 70 (hex) occurs from an input 07 instruction (keyboard).

PRINTER INTERFACE

Functional Description

The printer interface module interfaces the CPU to a twenty one column impact printer. The printer has full numerics and some other characters and symbols as shown in Table III. All system transactions can be recorded on the printer or data in memory may be listed out. The unit can print lines in either black or red at a rate of about 3 lines per second. The various formats required are shown in FIG. 38.

PERIPHERAL PORT ADDRESSES AND FUNCTIONS

The printer provides the CPU with two status conditions which must be checked before sending a print command. The two signals are printer busy and printer out of paper, and are read on input port 03. A hex 59 must be in the accumulator prior to the input instruction, and $A_0$ is the printer busy and $A_1$ the out of paper signals. A 0 indicates that the printer is busy or out of paper. The other bits are don't care conditions.

Data is outputted to the printer using output port 12 (Hex), and each byte contains the data for two columns. Eleven bytes must be outputted to the printer for each line of print. Referring to FIG. 38, the first byte of data contains the code for the first column in the lower order bits and the upper four bits are ignored. Thereafter, every byte contains data for two columns with the lower order bits used for the higher numbered column. Printer columns are numbered from right to left. Table III below contains the drum pattern for the printer and indicates the codes for each row.

Output port 13 (Hex) is the printer cycle control port and is used for initiating print cycles, selecting red or black print and selecting decimal point printout. The printer has a feature to allow decimal points to be printed and other characters together in specified columns.

Below are the codes used for the various modes of operation:

| Hex Code | Control Function |
|---|---|
| 0 1 | Print in black without decimal points |
| 0 3 | Print in red without decimal points |
| 0 5 | Print in black with decimal points |
| 0 7 | Print in red with decimal points |

TABLE III

| ROW (Hex Code) | PRINTER DRUM FORMAT COLUMN 21 | 20 | 19 | 18 | 17 | 16 | 15 | 14 | 13 | 12 | 11 | 10 | 9 | 8 | 7 | 6 | 5 | 4 | 3 | 2 | 1 |
|---|---|---|---|---|---|---|---|---|---|---|---|---|---|---|---|---|---|---|---|---|---|
| 0 | 0 all columns | | | | | | | | | | | | | | | | | | | | |
| 1 | 1 all columns | | | | | | | | | | | | | | | | | | | | |
| 2 | 2 all columns | | | | | | | | | | | | | | | | | | | | |
| 3 | 3 all columns | | | | | | | | | | | | | | | | | | | | |
| 4 | 4 all columns | | | | | | | | | | | | | | | | | | | | |
| 5 | 5 all columns | | | | | | | | | | | | | | | | | | | | |
| 6 | 6 all columns | | | | | | | | | | | | | | | | | | | | |
| 7 | 7 all columns | | | | | | | | | | | | | | | | | | | | |
| 8 | 8 all columns | | | | | | | | | | | | | | | | | | | | |
| 9 | 9 all columns | | | | | | | | | | | | | | | | | | | | |
| A | X | $E_L$ | : | X | $E_L$ | : | X | X | X | : | M | V | : | $E_L$ | X | : | in | R | : | M | V |
| B | . | . | . | . | . | . | . | . | . | . | . | . | . | . | . | . | . | . | . | . | ns |
| C | + | + | + | + | + | + | + | + | + | + | + | + | + | + | + | + | + | + | + | + | Hz |
| D | − | − | − | − | − | − | − | − | − | − | − | − | − | − | − | − | − | − | − | − | S |
| E | Y | Az | °F. | Y | Az | °F. | Y | Y | Y | dc | K | | °F. | Az | Y | % | ft | dc | °F. | K | |
| F | Blank All Columns | | | | | | | | | | | | | | | | | | | | |

INITIAL PROGRAMMING OF SYSTEM PARAMETERS

When the access control system of the present invention is installed, and before it can be put into operation, all parameters desired for the installation must be programmed into the central controller.

Referring to FIG. 35, during the following programming operations, the mode keyswitch 130 must be turned to the Program position. When programming has been completed, the keyswitch is turned to the Operate position. When not required for controller operations, the key (not shown) may be removed to avoid risk to the information programmed into memory.

The programming operations are presented as entry sequences composed of rectangles containing legends or symbols. Each rectangle represents a key on the keyboard, 120, and they are shown in the proper sequences to enter the system parameters.

INITIAL STARTUP

Power is provided to the central controller by connecting a 3-conductor power cable to an appropriate source of ac power, which will normally be either 115 vac or 230 vac, 50/60 Hz, single phase. No power control switch is provided since power is continuously applied under normal operating conditions. If the unit is being operated initially only for checkout, the emergency batteries need not be connected. When actually programming system parameters into the controller, the battery cable connectors are connected.

When power is first applied to the controller, miscellaneous indications may be displayed temporarily, but will soon disappear, and will be replaced by a letter F under time zone in the upper display 110. At this time, the power fail indicator will illuminate and the clock display will illuminate. The audible alarm on the panel may sound. depressing the [CLEAR] key will clear all display indications except the clock, and will also turn off the audible alarm if it is sounding. The battery test indicator may be illuminated and will remain so long as the emergency batteries are charging and are within their high-low limits. This indicator should be on at all times that ac power is applied.

If the system is ever to be intentionally down with power off for more than three days, disconnect the batteries. If allowed to discharge excessively, the batteries may be damaged - although the battery test indicator will still illuminate when ac power is reconnected.

When initially programming system parameters into the central controller, it is recommended that the printer power switch be off. This will avoid distractions from unexpected printer operations, and also because most printouts that may occur during initial programming will be incomplete and meaningless. When the printer is first turned on at a later time, data stored in the buffer during system programming operations may be printed out.

CLOCK SETTING

The clock display has four segments to show three types of time information. These are the time of day, day of year, and day of week. Only one is displayed at a given time. Selection may be made by pressing the [CLOCK] and [NEXT] keys. When the [CLOCK] key is pressed, the display will go dark, and when the [NEXT] key is pressed, the display will show the next type of information. Whenever any changes are made in the clock settings, the display must show the appropriate type of data before the changes are made.

TIME OF DAY

The time of day display has positions for four digits and has a colon between the two center digits. The time of day may be set by first obtaining the appropriate display as described above and then pressing the [CLOCK] key, at which time the display will become blank. Each numeric key pressed will enter the display at the right end and will move to the left as additional numbers are entered. It is unnecessary to enter nonsignificant or leading zeros. If an incorrect digit is entered, pressing the [CLEAR] key will clear the display and the correct digits may be entered. When the display presents the correct time in hours and minutes for a 24-hour clock, press [RCRD] key to set the time of day clock functions into operation. The following examples illustrate the sequences for several time entries:

1. 10:42 AM: [CLOCK] [1] [0] [4] [2] [RCRD]
2. 11:57 PM: [CLOCK] [2] [3] [5] [7] [RCRD]
3. 3:45 AM: [CLOCK] [3] [4] [5] [RCRD]

The first example (10:42 AM) would appear on the display as shown in the illustration below:

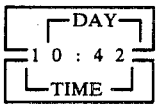

DAY OF YEAR

The day of year display does not have a colon or dashes, and will consist of one, two, or three digits. The day of year is set by first obtaining the appropriate display and then pressing the [CLOCK] key, at which time the display will become blank. Press the digit keys representing the day of the year, followed by the [RCRD] key. Non-significant zeros need not be entered. Check a calendar for the number of the day of year: Jan. 1 = 1, Feb. 5 = 36, July 28 = 209, except Leap year, etc. On Jan. 1 of each year the day of year display will automatically reset to 1. The following examples illustrate the above-mentioned day of year entries.

1. Jan. 1: [CLOCK] [1] [RCRD]
2. Feb. 5: [CLOCK] [3] [6] [RCRD]
3. July 28: [CLOCK] [2] [0] [9] [RCRD] (210 during Leap Year)

The third example would appear on the display as shown in the illustration at the bottom:

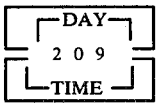

DAY OF WEEK

The day of week display has a single number with a dash (—) on each side. The day of week is set by first obtaining the appropriate display and then pressing the [CLOCK] key, at which time the display will become blank. Press the single digit key representing the day of the week that the entry is made (1 = Sunday, 2 = Monday, etc.), and followed by the [RCRD] key. The following example shows the entry sequence for Tuesday, and the illustration shows how this entry would appear on the display.

[CLOCK] [3] [RCRD]

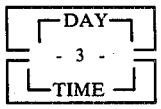

With all of the above-described clock settings, after pressing the [RCRD] key an "F" will be displayed in the time zone location of the upper display. The "F" indicates that the information entered has been accepted and that the process of entering it into system memory has been finished. Press the [CLEAR] key to blank the F before proceeding. If the information entered has not been accepted an "E" will be displayed to indicate error. Press the [CLEAR] key to blank the E and the clock information shown, then reenter the desired information.

When a printer is connected to the central controller, there will automatically be a printout each hour showing the time of day and day of year as shown below. (The X's are merely separators and have no meaning.)

11:00 X 090 X

TIME ZONES

A time zone is basically a period of time with a designated beginning and end (or starting and stopping times). The purpose of time zones is to establish time periods that can be used to control the operating times of certain items of system equipment such as reader terminals and card keys.

A time zone is established by keyboard entries programmed into the controller. A time zone may be programmed to cover a single day, several days, or all seven days of the week. The time period for the time zone may be set for the same start and stop times for each active day, or it could be set for different start and stop times for each day of the week, if desired. When reader terminals or card keys are programmed into the controller for a given time zone, they will operate only during the active time periods for that time zone.

Time zone information is presented on the lower display. Normally shown are time zone number, start time, stop time, and a number representing one of the days of the week to which the time zone applies. Depending upon the controller model in use there will be either four or eight time zones available. Time zones are identified as 1 through 4, or 1 through 8. Each time zone must be set for the desired time period for the days applicable.

PROGRAMMING A TIME ZONE FOR ONE DAY

The following example shows the entry sequence for time zone 4, for the hours 930–2300, for Saturday only.

TZ Day Start Time Stop Time

[TIME ZONE] [4] [·] [7] [·] [9] [3] [0] [·] [2] [3] [0] [0]
[·] [RCRD]

The above entry sequence assigns the time zone to cover the time period of 9:30 AM to 11:00 PM for Saturday only, as illustrated below.

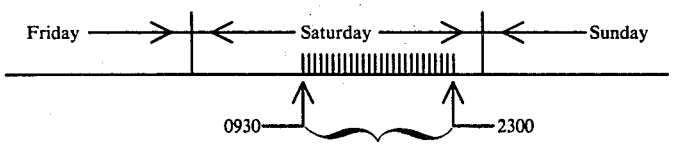

Time Zone Active

When the [TIME ZONE] key is pressed, time zone 1 will initially be shown in the time zone segment at the left end of the lower display, and a number representing the current day of week will be shown in the appropriate position in the days area of the display. These will change as the desired time zone and day numbers are entered. When the [.] key is pressed after the day of week has been entered, the time area of the display will initially show all zeroes. As the start time is entered, the first digit will appear at the right end of the start time area and will move to the left as each successive digit is entered. After the desired start time has been entered pressing the [.] key enables the stop time to be entered in the same manner and followed by the [.] key. Enter only the significant digits (930 for 9:30 A.M., etc.). When all entries displayed appear correct, pressing the [RCRD] key will load the information into system memory. The following information shows how the preceding entry sequence example would appear on the display.

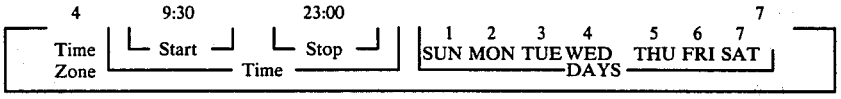

After time zone information has been entered into memory, whenever the sequence

[TIME ZONE] [#] [.] [#] [.]

is entered, the current start and stop times for that time zone and day of week will be displayed. If it is desired to change the time period for the current day, the sequence

[TIME ZONE] [#] [.] [.]

can be used without entering the day of the week. This will display the start and stop times for that time zone for the current day, and as soon as this display appears, the start limit may be entered. If the start time is correct but the stop time must be changed, entering the sequence

[TIME ZONE] [#] [.] [#] [.] [.]

will enable the new stop time to be entered. It should be remembered that the

[.] [RCRD]

keys must be pressed after the stop time has been entered in order to load the revised limits into memory.

PROGRAMMING A TIME ZONE FOR A GROUP OF DAYS

When the same time periods applies to more than one day (such as Monday through Friday), the entry may be made as shown in the following example for time zone 2, for the hours 0700–1600, for Monday through Friday.

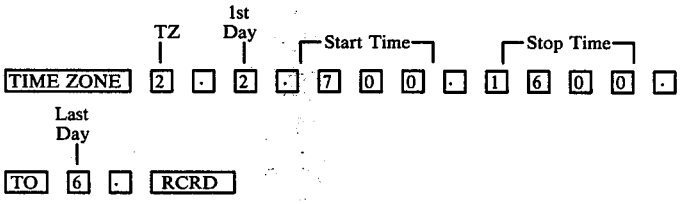

The above entry sequence assigns the time zone to cover the time period of 7:00 AM to 4:00 PM, Monday through Friday as shown below.

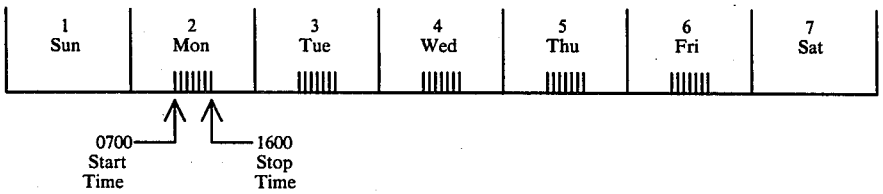

GENERAL TIME ZONE INFORMATION

When certain days (such as Saturday or Sunday) are not to be covered by the time zone being programmed into the controller, they must be specifically excluded. This is done by programming both the start and stop times for that day of 00:00. This will prohibit the time zone from operation on the day so entered.

To set a given time zone to cover an entire 24-hour day, set the start to 00:00 and the stop time to 24:00.

A time zone may have different time periods for different days of the week. For example, a given time zone could have the same time period for Monday through Friday and a different time period for Saturday. If so required, a given time zone could be assigned a different time period for each day of the week.

A time zone may also be set to overlap from one day to the next. For example if the start time for one day is set to 20:00 and the stop time is not set for a later time, the time period will operate until 24:00 and then, if the stop time for the next day precedes the start time for the second day, the time period will continue into the second day and stop at the stop time entered for the second day. (However, if the second day start time precedes the stop time, then the first day time period will terminate at midnight, which is the start of the second day. second day will start at 24:00 (midnight) and stop immediately; it will not overlap into the third day. Any other start time from 1:01 to 23:59 could be entered, but they would produce a valid time zone period from the start time entered until midnight. (Optionally, a start time of 0:00 could be entered instead of 24:00. In this case the time zone would theoretically stop at midnight and start again instantly without hiatus and continue until 1:00,at which time it would stop.)

The above entry sequence confines the overlapping time zone to Monday evening and through 1:00 AM Tuesday only. This same time zone could be set for other time periods for other days of the week, if desired.

EXAMPLE 2:

To set the same overlapping time zone as in Example 1 to apply to five days, Monday through Friday. (Note that although the time zone is for five evenings, the last sequence must be for the sixth day, Saturday, because the Friday time period extends to 1:00 AM Saturday.)

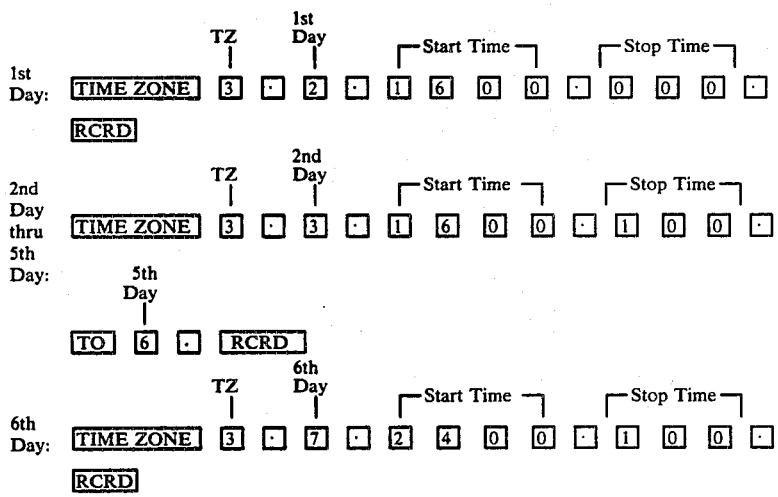

EXAMPLE 1:

To set a time zone to start at 1600 and overlap to 0100 the next day, Monday to Tuesday only.

The above entry sequence assigns the time zone to cover the time period of 4:00 PM of one day to 1:00 AM the next day, Monday through Friday, as illustrated below.

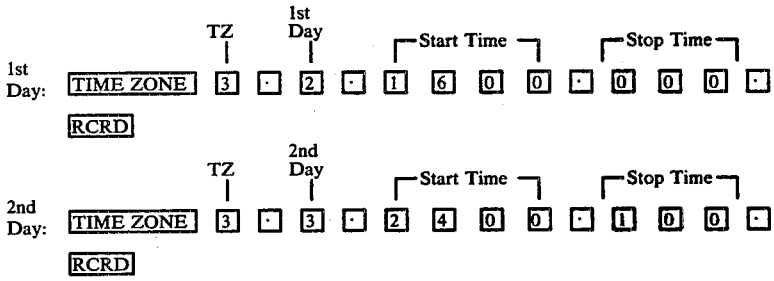

Note in the above example for the first day that the stop time is set for 0:00, which precedes the start time of 16:00. If no other entries have previously been programmed into the controller for this time zone period, 0:00 will automatically appear for the stop time and it will not be necessary to enter these digits. Any other stop time from 0:01 to 15:59 could be entered with satisfactory results.

In the example for the second day the start time is shown as 24:00, which follows the stop time of 1:00. By entering this number a new time zone period for the

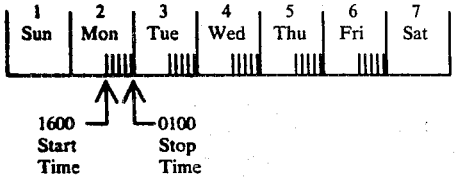

Time zone entries such as the above examples may easily be displayed for examination with the following entry sequence. Each time the NEXT key is pressed, the display will advance to the next day and display the start and stop times for that day for the time zone entered.

EXAMINATION OF TIME ZONES

Time zone entries such as the above example may easily be displayed for examination with the use of the [NEXT] key. Each time the [NEXT] key is pressed, the display will advance to the next day and display the start and stop limits for the day shown. Other time zones may be displayed for the day shown by pressing the [TIME ZONE] key. Each time this key is pressed the display will advance to the next higher time zone number and show its start and stop limits for that day. Once a time zone number and a day of week have been entered, either the [NEXT] key or the [TIME ZONE] key may be pressed at any time to increment the desired parameter. When advancing the display in this manner, the start and stop limits may be changed immediately, if desired, after either key has been pressed. The display need not be cleared before making such changes.

USE OF CLEAR KEY DURING TIME ZONE ENTRIES

During the first part of the entry sequence before the start time entry is begun, pressing the [CLEAR] key will clear the entry. During the start time entry, if an error is noted in the time entry, pressing the [CLEAR] key will return the start time display to all zeroes, either before or after the [.] key is pressed. During the stop time entry, if the [CLEAR] key is pressed before the [.] key is pressed, the stop time display will return to all zeroes. If the [CLEAR] key is pressed after the [.] key is pressed (and before the [RCRD] key is), the entire entry sequence will be cleared from the display. Note: The entry can be terminated at any time by pressing the CLEAR key twice.

READER/TERMINAL VALIDATION AND TIME ZONE ASSIGNMENTS

Each reader terminal used in the system must be programmed into the controller as a valid terminal and must be assigned to a time zone. (This will prevent the terminal from being used during any time period other than that established by the time zone assigned.) Also, each unused terminal number must be programmed into the controller as an invalid terminal. For example: If the controller has a capacity of 32 terminals and only 25 are used in the system, the numbers of these 25 terminals are to be entered as valid and the numbers of the remaining 7 terminal addresses are to be entered as void. Reader/-terminals are numbered consecutively, starting with the number (1). In the entry sequences for terminals, the symbol [#] after [TERM] represents the digits required for the particular terminal concerned; this may be from one to three digits.

The entry sequence

[TERM] [#] [.]

will display the terminal number, time zone number, alarm status, void/valid status, and in/out status. (In/-out means whether or not the terminal is responding properly to the polling function and is "in" or "out" of the system.) As the terminal number is entered, it is displayed under terminal number. Pressing the [.] key displays the parameters associated with that terminal number. The time zone number will appear under time zone, the alarm status (of the alarm circuits in the terminal) will appear under card key number, either the valid or the void indicator (under card status) will illuminate, and either the in or out indicator (under entry/exit status) will illuminate. (When terminal parameters are being displayed, the indicators mentioned apply only to the status of the terminal; they are not associated with card status or entry/exit status as labeled on the front panel.)

The example below illustrates the dislay for terminal number 15, assigned to time zone 2, no alarm detectors activated, valid status and "in" the system.

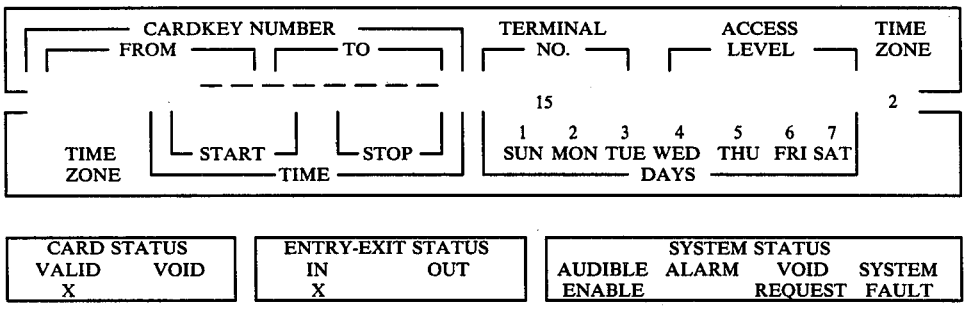

Before the desired information is programmed into the controller, any information (other than the terminal number entered) that may appear on the display may be ignored. The time zone area will initially show time zone 1, and the in and void indicators will be illuminated because the controller memory is pre-programmed to assume that all terminals are assigned to time zone 1, and that they are in and are void. (After the terminals to be used in the system have been programmed into the controller as being valid, the valid indicator will illuminate when their parameters are displayed.)

The in/out feature provides an easy means of verifying whether a terminal is responding properly to the controller polling function. It provides both a visual indication and a printout when a terminal goes out of operation for any reason, and it provides a visual indication when the terminal is returned to proper operation. This eliminates any need to go to the terminal (once it has been down and the condition has been corrected) and test its operation to verify that it is actually back in the system. The feature also enables ready recognition of intermittent terminal operation.

The central controller will have a capacity of from 16 to 128 reader terminals (in blocks of 16). If a terminal number is entered that is beyond the controller capacity, the terminal number will appear but no parameters will be displayed.

PROGRAMMING ONE TERMINAL FOR A TIME ZONE

The following entry sequence will program one terminal for a time zone. Note: Before the desired parameters are programmed into the controller, the initial condition displayed for the terminal will be time zone 1 and a void status. Enter the time zone number desired and press the [VOID/VALID] key to illuminate the valid indicator before pressing the [RCRD] key. Each time the [VOID/VALID] key is depressed, the condition will alternate. The condition displayed just prior to pressing the [RCRD] key will be programmed into memory. The asterick (*) is shown in the sequence as a reminder to check the validity at this point.

[TERM] [#] [.] [TIME ZONE] [#] [.] * [RCRD]

PROGRAMMING A GROUP OF TERMINALS FOR A TIME ZONE

When a group of terminals with sequential numbers are to be assigned to the same time zone, they may be programmed into the controller with the following entry sequence. Make certain the desired validity in indicated before the [TO] key is pressed.

[TERM] [#] [.] [TIME ZONE] [#] [.] * [TO] [TERM] [#] [.] [RCRD]

PROGRAMMING UNUSED TERMINAL NUMBERS

As previously mentioned, unused terminal numbers are to be programmed into the controller as being void. The procedures above may be used for this purpose - just make certain the void indicator is illuminated before pressing the [RCRD] key.

ACCESS LEVELS

GENERAL

Access levels provide a means of controlling access to certain terminals or groups of terminals in a manner similar to mastering and sub-mastering mechanical key codes. One or more terminals may be assigned a given level, either individually or in groups of sequential numbers. This assignment should be made to meet the access requirements of all personnel groups that are to receive card keys, as developed on the master chart described in Appendix A. Card keys are assigned to a single access level and may only gain access through terminals having that access level.

Access level information is presented on the upper display. Depending upon the controller model in use there will be either 32, 64, 96, or 128 access levels available. Access levels are identified consecutively, starting with the number (1). Each reader/terminal in the system must be assigned to one or more access levels. As many terminals as desired may be assigned to a given access level, or to more than one access level. While performing the following programming sequences, after the initial access level entry make certain the valid indicator is illuminated. Each time [VOID VALID] key is pressed, the condition alternates. An asterisk (*) is shown in the entry sequences as a reminder to check the validity condition at those points.

PROGRAMMING ONE TERMINAL TO ONE ACCESS LEVEL

[TERM] [#] [.] [ACCS] [LEVEL] [#] [.] * [RCRD]

Note that when the [ACCESS LEVEL] key is depressed, the time zone number disappears and a number appears under access level. If the terminal number has not been previously assigned to an access level, this number will be zero (0). The example below illustrates the display that would result from the above entry sequence for terminal number 59 assigned to access level 23.

| CARDKEY NUMBER FROM | CARDKEY NUMBER TO | TERMINAL NO. | ACCESS LEVEL | TIME ZONE |
|---|---|---|---|---|
| | | 59 | 23 | |

PROGRAMMING A GROUP OF TERMINALS TO ONE ACCESS LEVEL.

[TERM] [#] [.] [ACCS LEVEL] [#] [.] * [TO] [TERM] [#] [.] [RCRD]

Note that after the programming sequence has been completed, the display advances to show the next higher terminal number and its parameters (if any have been stored). When loading a quantity of groups into the controller, this feature can speed up programming.

PROGRAMMING ONE TERMINAL TO A GROUP OF ACCESS LEVELS

[TERM] [#] [.] [ACCS LEVEL] [#] [.] * [TO] [ACCS LEVEL] [#] [.] [RCRD]

Again, the display will advance to the next higher terminal number after the programming is complete.

PROGRAMMING A GROUP OF TERMINALS TO A GROUP OF ACCESS LEVELS

[TERM] [#] [.]

[TERM] [#] [.] [ACCS LEVEL] [#] [.] * [TO] [ACCS LEVEL] [#] [.] [TO] [TERM] [#] [.] [RCRD]

Again, the display will advance to the next higher terminal number after the programming is complete.

USE OF CLEAR KEY DURING TERMINAL ENTRIES

During any of the preceding entry sequences, the display may be cleared by pressing the [CLEAR] key once after any [·] key entry or after a [TO] key entry. Before the [TO] key is pressed, the display may also be cleared after a [TERM] key or an [ACCS LEVEL] key entry by pressing the [CLEAR] key only once. However, if a number has been entered after the [TERM] key or the [ACCS LEVEL] key (and the [·] key has not been pressed), the [CLEAR] key must be pressed twice to clear the display.

After the [TO] key has been pressed, pressing the [TERM] or [ACCS LEVEL] keys will initially show a zero (0) for the parameter selected. Pressing the [CLEAR] key at this time will not clear the display. If a number has been entered after the [TERM] or [ACCS LEVEL] key, pressing the [CLEAR] key will merely return the parameter to zero and wait for a number to be entered. To clear the display at this point, press the [#] and [·] keys first and then press the CLEAR key.

ENTRY CORRECTIONS

If errors are made during digit entries in terminal entry sequences, they may be corrected without clearing the entire display, providing that the [·] key has not been pressed following the incorrect digit entry. If the [·] key has been pressed after the incorrect digit entry, the display must be cleared and the entry sequence reinitiated. In the following types of corrections, it is assumed that the [·] key has not been pressed following the incorrect number entry.

1. If the parameter being entered has a limit of a single digit, simply press the correct digit key and the new number will replace the original incorrect number. This will apply to time zone entries.

2. If the parameter being entered has a maximum limitation of more than one digit, press the [CLEAR] key once to return the parameter shown to zero (0) and then press the correct digit key(s). This will apply to terminal numbers and access level numbers.

ALARM MONITOR

The alarm monitors must be programmed into the controller as valid terminal addresses in a manner similar to validating reader terminals. The entry sequence will display the alarm monitor address number, alarm status, void/valid status, and in/out status. As previously explained, the void indicator and the in indicator will be illuminated. To validate the alarm monitor it is merely necessary to press the [VOID/VALID] key to illuminate the valid indicator and then press the [RCRD] key. Whatever time zone information may be indicated does not matter because the alarm reporting function is continuous and is not affected by time zones.

CARD KEYS

Card key information is presented on the upper display. Each card key to be used in the system must be programmed into the controller as a valid card, along with the access level and time zone assigned to each card. If the controller includes the entry/exit feature, the entry/exit status for each card should also be entered. Cards may be entered individually, or in blocks of card numbers having the same parameters.

The entry sequence

[CARD KEY] [#] [.]

will display the card key number and all parameters associated with that card number. As the card key number is entered, it is displayed under the "from" part of card key number. The issue number of the card is also shown, separated from the card number by a decimal point. (The controller is programmed to show all card key issue numbers as zero until such time as they may be changed by reprogramming at a later date.) Pressing the [·] key displays the parameters associated with that card key number. The time zone number will appear under time zone, the access level number will appear under access level, either the valid or the void indicator (under card status) will illuminate, and either the in or out indicator (under entry/exit status) will illuminate.

Before the desired information is programmed into the controller, any information (other than the card key number entered) that may appear on the display may be ignored. The controller is preprogrammed to assume that all card keys are assigned to time zone 1 and access level 1, and that they are void and out of the system. Until other parameters are programmed in for the cards, the display will show time zone 1 and access level 1, and the void and out indicators will be illuminated. After the card keys to be used in the system have been programmed into the controller with their desired parameters, their individual parameters will be displayed when the card numbers are entered.

The example below illustrates the display that would be shown for card key number 52, assigned to time zone 2 and access level 3, valid status, and "in" the plant.

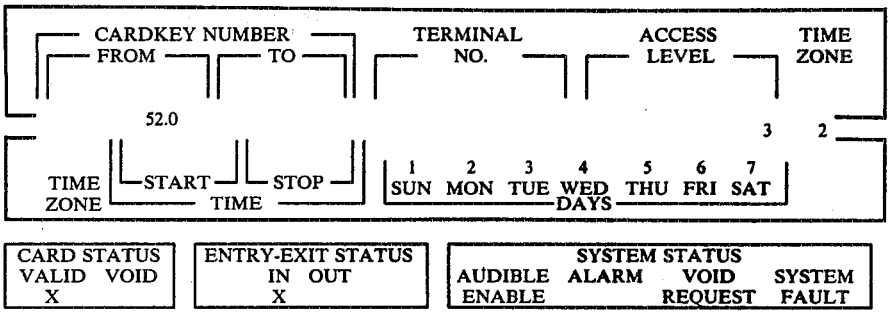

PROGRAMMING ONE CARD TO ACCESS LEVEL AND TIME ZONE

The following entry sequence will program one card key for an access level and a time zone. Make certain the valid indicator is illuminated before pressing the [RCRD] key (indicated by asterisk in entry sequence).

[CARD KEY] [#] [·] [ACCS LEVEL] [#] [·] [TIME ZONE] [#] [·]

* [RCRD]

PROGRAMMING A BLOCK OF CARD KEYS TO ACCESS LEVEL AND TIME ZONE

When a block of card keys with sequential numbers are to be assigned to the same access level, time zone, and issue number, they may be programmed into the controller with the following entry sequence. In this sequence the lowest card number in the block cards is entered after [CARD KEY] and the highest card number in the block is entered after [TO] .

[CARD KEY] [#] [·] [ACCS LEVEL] [#] [·] [TIME ZONE] [#] [·]

* [TO] [#] [·] [RCRD]

With group entries make certain the valid indicator is illuminated before pressing the [TO] key (indicated by asterisk in entry sequence).

PROGRAMMING ENTRY/EXIT FEATURE

When the entry/exit feature is included in the system, two advantageous functions are provided. These are:

1. Reader/terminals may be programmed so that they may be used for either entrance or exit, but not both. When a card is used in an entry terminal, it cannot again be used in an entry terminal until it has first been used in an exit terminal. This prevents the card from being passed back after entry for use by another person.

2. At any time simple keyboard entries may be used to determine whether any particular card in the system is in the plant of out.

When the system utilizes the entry/exit feature, it is not necessary for all reader/terminals to be programmed for entrance-only or exit-only operation. It may be desirable to have some non-entry/exit terminals in-plant between secure areas. This will enable free movement between the areas for authorized personnel without changing the in or out status of the cards.

When the entry/exit feature is included in the controller, the cards must be properly programmed for entry/exit operation before being issued to cardholders. Under "entry/exit status" are two indicators identified as in and out. "In" means in-plant and "out" means out of the plant. If the cards are to be distributed to personnel while inside the plant, the cards should be programmed as in. If the cards are to be distributed to personnel while outside the plant, the cards should be programmed as out. The programming of the feature is accomplished during the above described programming sequence. Before pressing the [RCRD] key, make certain the correct status indicator is illuminated. Pressing the [ENTRY/EXIT] key will change the status indication. When entering blocks of cards, make certain the correct indicator is illuminated before pressing the [TO] key.

If the entry/exit feature has not been ordered and is not included in the controller, the entry/exit indicators will still function but will not be controlled from card location input data. In this event, all cards should be programmed as out in order to avoid confusion and to prevent the printer from printing card numbers as being in-plant.

PROGRAMMING UNUSED BLOCKS OF CARD NUMBERS

Unused blocks of card numbers should be programmed into the controller as being void. For example, if 300 cards have been assigned to a department and only 250 are initially to be put into use, the remaining 50 card numbers should be invalidated. This may be done by simply group-loading the block of cards into the controller as being void. Make certain the void indicator is illuminated before pressing the [TO] key (indicated by asterisk in entry sequence).

[CARD KEY] [#] [·] * [TO] [#] [·] [RCRD]

To provide further assurance that the block of cards cannot be used (and as a precaution against erroneous programming) the following is recommended. Designate the highest-numbered access level for void cards only, assign the block of cards to that access level as being void, and then never use that access level in the system. The following example illustrates the entry sequence to assign a block of cards to access level 32 as void. Again, make certain the void indicator is illuminated before pressing the [TO] key.

[CARD KEY] [#] [·] [ACCS LEVEL] [3] [2] [·] * [TO] [CARD KEY] [#] [·] [RCRD]

USE OF [CLEAR] KEY CLEAR CARD KEY ENTRIES

During the preceding card key entry sequences the display may be cleared at almost any time by pressing the [CLEAR] key once. One exception is after the [ACCS EVEL] key has been pressed, with or without its number, the [·] key must also be pressed before the display can be cleared. The second exception is in group loading: Following the

[TO] [#]

entry the display may be cleared either by first pressing the [·] key and then the [CLEAR] key, or by pressing the [CLEAR] key twice.

ENTRY CORRECTIONS

If errors are made during digit entries in card key entry sequences, they may be corrected without clearing the entire display, providing that the [·] key has not been pressed following the incorrect digit entry. If the [·] key has been pressed after the incorrect digit entry, the display must be cleared and the entry sequence reinitiated. In the following it is assumed that the [·] key has not been pressed following the incorrect number entry.

1. If the parameter being entered has a limit of a single digit, simply press the correct digit key and the new number will replace the original incorrect number. This will apply to time zone entries (which are limited to either 4 or 8) and to issue number entries.

2. If the parameter being entered has a maximum limitation of more than one digit, press the [CLEAR] key once to return the parameter shown to zero (0) and then press the correct digit key(s). This will apply to card key numbers and access level numbers.

OPTIONAL FUNCTIONS

A number of functions may at the user's option be programmed to either operate or not operate. The optional functions will remain in an operating or non-operating state until their status is changed. To program these functions into memory, or to display them for observation, the mode switch must be in the program position.

There are two series of options, OP1 and OP2, with each having a possible eight optional functions. Not all option numbers are currently assigned, however. The active options are described in the following paragraphs.

DISPLAYING OPTIONS

To display the options, merely press the [OPT] key. The letter-number combination OP1 will appear at the left end of the display above time zone. (During option displays neither the upper display indicator or the lower display indicator will illuminate.) Before any options are programmed into the controller, a series of eight dashes will be displayed to the right of "OP1". Also, a number "1" will appear at the right end of the display under time zone. The eight dashes are the locations where the numbers of the optional functions will appear when programmed into memory, and the number 1 under time zone indicates that the controller is initially set for programming optional 1.

When the option display is illuminated, pressing the [NEXT] key will change the display to read OP2 and, again, a series of eight dashes will be seen. This is a second series of options. Each time the [NEXT] key is pressed the display will change between OP1 and OP2, and will show which options in each series are currently in operation.

PROGRAMMING OPTIONS

After the [OPT] key has been pressed and the display is illuminated, the following entry sequence will program a single option into memory.

[#] [VOID VALID] [RCRD]

As the digit key is pressed for the desired option number, this number will appear under time zone. As the [VOID VALID] key is pressed, the number selected will replace one of the dashes in its correct sequential position (1 to 8, left to right). When the [RCRD] key is pressed, the number under time zone will change to an F to indicate that the transaction is finished. The entry may be checked by pressing the [CLEAR] key to clear the display and then pressing the [OPT] key. The number entered will appear in the correct position in the display to verify that the option selected is now programmed for operation.

Group entries of options may be made by pressing the digit keys for all desired options and pressing the key after each digit key. The following example will enter options 2, 7 and 8.

[2] [VOID VALID] [7] [VOID VALID] [8] [VOID VALID] [RCRD]

Once entered into the system an option will remain in operation until removed. Deleting an option is performed in a manner similar to entering an option. Press the digit key for the number of the option to be removed, and then the [VOID VALID] key. This will replace that number in the display with a dash. Pressing the [RCRD] key will remove the option from operation. Note: During option entries the options represented by all numbers displayed will be entered for operation. Missing option numbers (dashes) will be entered as not operating.

AVAILABLE OPTIONS

OP1:

1. Audible Enable. — This option enables the audible alarm on the controller panel to sound whenever an alarm is received. (Reader/terminal alarm; void request; system fault)

2. Printer Enable. — This option enables the printer to print all information outputted from the controller. The listing option will still function when option 2 is disabled.
3. Print Valid Cards Enable. — Normally, the controller will cause the printer to print only the attempted use of void cards. When this option is entered, the printer will print valid cards in addition to void cards. (Option 2 must be enabled for option 3 to function.)
4. Print Alarm Enable. — This option enables the printer to print alarm conditions when they are received. (Option 2 must be enabled for option 4 to function.)
5. Display Alarm Transactions and Voided Cards. — This option enables the controller to display all alarm transactions and voided cards transactions as they occur. If keyboard entries are made while these transactions are being displayed, the keyboard entries will have priority.
6. Display Valid Card Transactions. — This option enables the controller to display all valid card transactions as they occur. If keyboard entries are made while these transactions are being displayed, the keyboard entries will have priority.
7. Time Zone Enable. — This option enables the time zones previously entered to operate. Normally, this option should always be entered. If there are periods of time during which it is desired to have all reader/terminals and cards operate, this option may be deleted during such periods.
8. Polling Enable. — This option enables the controller to poll the reader/terminals, and once the installation is complete it should always be in operation. When first programming the controller and installing terminals, it is advantageous to not have this function in operation. For example, when group loading large quantities of cards, the operation may be performed faster when the controller is not polling. Also, if terminals are still being installed, the polling operation may product a number of alarms, incorrect data, etc.

OP2:

1. Leap Year Enable. — Normally, the day of year display will advance to 365 on December 31, and then change to 001 on January 1. The Leap Year option will enable the day of year to advance to 366 on December 31 before changing to 001 on January 1. This option should be entered during a Leap Year and removed the following year.

DISPLAY PARAMETERS AND MODIFY PARAMETERS

Referring to FIG. 35, all of the parameters programmed into the central controller may be readily displayed for examination without risk to the information stored in memory. After the desired parameters are displayed, any or all may be easily changed by turning the mode switch 130 to the program position and entering a short key sequence to effect the desired change. The following provides both the entry sequence to display the desired parameters, and also the entry sequence to change the parameters. It is important to remember that if parameters are being recalled only for display and no changes are contemplated, the mode keyswitch 130 should be left in the operate position. Only when changes are being made should the mode switch be set in the program position. When the changes have been completed, the mode switch should be set to the operate position and the key should be removed.

CARD KEY PARAMETERS

DISPLAY PARAMETERS

The following entry sequence will show all parameters for the card key identification number entered.

[CARD KEY] [#] [·]

If no changes are to be made to the parameters for the card number display and it is desired to inspect the next higher number card, the following sequence will advance the card number sequentially and display the parameters for that card.

[NEXT] [·]

MODIFY PARAMETERS

When the card parameters have been displayed and changes are to be made, turn the mode switch to program and enter the appropriate key sequence to change the parameter desired.

1. [TIME ZONE] [#] [·] [RCRD]
2. [ACC LEVEL] [#] [·] [RCRD]
3. [ISSUE] [#] [·] [RCRD]
4. [VOID VALID] [RCRD]
5. [ENTRY EXIT] [RCRD]

If more than one parameter requires changing, enter all of the desired changes before pressing the [RCRD] key. Remember that the issue number of all cards is zero (O) when they are initially programmed into the controller. The issue number of a card should only be changed when the same card number is reissued to replace a lost or stolen card.

GROUP CARD KEY PARAMETER CHANGES.

The parameters for a group of cards cannot be displayed at one time. The parameters for a given group were initially programmed into memory from the data compiled on the Master Chart for the system. When any parameters for a group of cards are to be changed, the Master Chart should be changed to reflect the new parameters and the group of cards should then be completely reprogrammed with the new parameters.

TERMINAL PARAMETERS

DISPLAY PARAMETERS

The following entry sequence will show the time zone, void/valid status, in/out status, and alarm status for the terminal number entered.

[TERM] [#] [·]

If no changes are to be made to the parameters for the teminal number displayed and it is desired to inspect the next higher number terminal, the following sequence will advance the terminal number sequentially and display the parameters for that terminal.

[NEXT] [·]

MODIFY PARAMETERS

When the above parameters have been displayed and it is desired to change either the time zone or void/valid condition, turn the mode switch to program and enter the appropriate key sequence to change the parameter desired.

1. [TIME ZONE] [#] [·] [RCRD]
2. [VOID VALID] [RCRD]
3. [TIME ZONE] [#] [·] [VOID VALID] [RCRD] (to change both)

ACCESS LEVELS

The above entry sequence does not show access level numbers for the terminal. This is because a terminal may be assigned to a number of access levels. To display access level information for a terminal, enter the following sequence.

[TERM] [#] [·] [ACCS LEVEL] [#] [·]

The void/valid indicator will show whether or not the terminal is valid for the access level entered and displayed.

If it is desired to check the validity of a group of terminals for a given access level, enter the same key sequence as above with the desired access level and number of the first (lowest number) terminal to be examined. Pressing the

[NEXT] [TERM]

keys will advance the terminal number to the next higher number, and the void/valid indicator will indicate the validity of the access level for that terminal. This may be repeated until all desired terminal numbers have been examined for that access level.

[TERM] [#] [·] [ACCS LEVEL] [#] [·] --- [NEXT] [TERM] ---

[NEXT] [TERM] --- etc.

If it is desired to check the validity of a given terminal for a group of access levels, enter the same key sequence as the above with the access level number for the first (lowest number) to be examined. Pressing

[NEXT] [ACCS LEVEL]

keys will advance the access level to the next higher number, and the void/valid indicator will indicate the validity of the terminal for that access level number. This may be repeated until all desired access levels have been examined for the terminal.

[TERM] [#] [·] [ACCS LEVEL] [#] [·] --- [NEXT] [ACCS LEVEL] ---

[NEXT] [ACCS LEVEL] --- etc.

MODIFY ACCESS LEVEL.

At any time when the entry sequence has been made to show the terminal access level, the validity of the terminal for that access level is shown by the void/valid indicators. If it is desired to change the validity condition of the terminal for the access level shown, this may be done by pressing the VOID VALID RCRD keys. A letter F will appear under time zone to indicate the finish of the programming transaction. The display will remain and may be advanced with the NEXT ACCS LEVEL keys to examine higher numbered access levels. If the validity status of the terminal is desired to be changed for any of the higher access levels, this may be done with the same VOID VALID RCRD key sequence. This procedure may be repeated up to the highest access level desired to be examined.

GROUP TERMINAL PARAMETER CHANGES

The parameters for a group of terminals cannot be displayed at one time. The parameters for a given group were initially programmed into memory from the data compiled from the reader/terminal chart and the Master Chart. When any parameters for a group of terminals are to be changed, the appropriate information on the charts should be changed to reflect the new parameters and the group of terminals should then be completely reprogrammed with the new parameters.

TIME ZONE PARAMETERS

DISPLAY PARAMETERS.

The following entry sequence will show the time zone time period for the time zone entered for the current day.

[TIME ZONE] [#] [·] [·]

The following entry sequence will show the time zone time period for the day entered.

[TIME ZONE] [#] [·] [#] [·]

For a given time zone the time period for each day of the week may be displayed by pressing the [NEXT]

key. Each time the [NEXT] key is depressed, the time zone display will advance to the next day and will show the time period covered by that time zone for the day displayed.

TIME ZONES CURRENTLY IN EFFECT.

To quickly determine which time zones are in effect at the current moment, press the

[TIME ZONE] [SYS STATUS]

keys. The numbers appearing above the time area in the lower display are the time zones active at this moment in real time.

MODIFY TIME ZONES

The time zones were initially programmed into memory from the data compiled on the time zone chart. When any time zone parameters are to be changed, the appropriate information on the chart should be changed to reflect the new parameters and the time zone parameters may then be reprogrammed in the manner described previously.

MISCELLANEOUS FUNCTIONS

In addition to programming, displaying, and modifying system parameters, the central controller 100 performs a variety of other very useful functions. The description and application of these additional functions are described below. Reference should be made to FIG. 35.

SYSTEM STATUS KEY

The [SYS STAT] key is used for two operations.

1 . To show numbers of time zones in effect at the moment the entry sequence is made.

[TIME ZONE] [SYS STAT]

2. To show next alarm condition in printer buffer:

[NEXT] [SYS STAT]

As alarm conditions are received at the controller, they are normally printed when received (with options 2 and 4 enabled). Additionally, a number of such signals are stored in the printer buffer and may be recalled for display. The above entry sequence will display the latest alarm condition in the buffer. Repeating the sequences will display the next latest alarm condition in the buffer, etc.

SYSTEM RESET KEY

[SYS RESET] key is only used for one operation. (The mode switch must be in the program position for this function.) If the controller seems to "hang up" because of illegal entries, etc., this key may be used to reset the controller and clear the display. This condition should rerely occur, if ever.

OPEN KEY

This key may be used to enable access for any terminal from the controller keyboard. It may be used for visitor entry, etc. The entry sequence is:

[TERM] [#] [·] [OPEN]

Each time that access is granted from the keyboard there will be a printout in red providing the time of day and the terminal number, as illustrated below. The "0" is a code number signifying that access was granted.

| Time | Term. |
|---|---|
| 12:31 | 012.0 |

NEXT KEY

The [NEXT] key may be used either to look at the next time in sequence, or to search the controller memory for specified conditions either for display or for listing.

DISPLAY NEXT ITEM IN SEQUENCE.

In the following entry sequences all entries prior to the NEXT key set up the parameter to be inspected sequentially.

1. Next card key number.

[CARD KEY] [#] [·] [NEXT] [·] --- [NEXT] [·] --- etc.

2. Next terminal number.

[TERM] [#] [·] [NEXT] [·] --- [NEXT] [·] --- etc.

3. Next access level for the terminal number entered.

[TERM] [#] [·] [ACCS LEVEL] [#] [·] [NEXT] [ACCS LEVEL] --- [NEXT] [ACCS LEVEL] --- etc.

4. Next terminal number for access level entered.

[TERM] [#] [·] [ACCS LEVEL] [#] [·] [NEXT] [TERM] --- [NEXT] [TERM] --- etc.

5. Next day of time zone number entered.

TZ Day

[TIME ZONE] [#] [·] [#] [·] [NEXT] --- [NEXT] --- etc.

6. Next time zone for day entered.

TZ Day

[TIME ZONE] [#] [·] [#] [·] [TIME ZONE] --- [TIME ZONE] --- etc.

This sequence will increment the time zone for the day entered. It may be combined with the preceding sequence which incremented the day of week for time zone entered. After the initial entry of time zone and day of week, either [NEXT] key or the [TIME ZONE] key may be pressed at any time, depending upon which parameter is desired to be incremented. The following sequence illustrates this.

TZ Day

[TIME ZONE] [#] [·] [#] [·] [NEXT] --- [TIME ZONE] --- [NEXT]

--- etc.

7. Next Option.

Two option series are available. When the [OPT] key is first pressed, OP1 will be displayed along with the numbers of the options which have been programmed into operation. Pressing the [NEXT] key changes the display between OP1 and OP2.

8. Next Clock.

Pressing the

[CLOCK] [NEXT]

keys changes the clock display to show the next type of time display.

9. Display information in printer buffer.

A.

[NEXT] [·]

recalls from printer buffer the latest transaction in memory. Repeating the sequence recalls the next latest transaction, etc.

B.

[NEXT] [CARD KEY]

recalls from printer buffer the latest card key transaction in memory. Repeating the sequence recalls the next latest card key transaction, etc.

C.

[NEXT] [VOID/VALID]

recalls from printer buffer the latest void card key transaction in memory. Repeating the sequence recalls the next latest void card key transaction, etc. The reason for the void transaction is given by a code number under time zone.

D.

[NEXT] [SYS STAT]

recalls from printer buffer the latest alarm transaction in memory. Repeating the sequence recalls the next latest alarm transaction, etc. Note: The above four types of entry sequences have their own "pointers" for selecting from buffer storage the type of information requested. When the [NEXT] key is depressed, a dash will appear under time zone on the display. The dash will disappear when the second key in the sequence is depressed. If the requested type of transaction is in the buffer it will appear on the display. If the buffer does not contain that type of transaction, the dash will disappear and the display will be blank. After a transaction has been recalled for display, if it desired to recall a different type of transaction, the [CLEAR] key should first be pressed. This will reset the pointers to start the search at the latest transaction in memory. It should be remembered that only the 64 most recent transactions are stored in the printer buffer, and that the earliest transactions will be dropped as new transactions occur. Also, if the above entries do not product a display, the printer buffer is empty.

SEARCH MEMORY FOR SPECIFIED CONDITIONS

During search operations a letter P will appear under time zone at the right end of the display. This will be replaced by the time zone number of the located card key or terminal when the search is completed. If the searched-fo parameters are in controller memory, they will be displayed at the conclusion of the search process. If they are not stored in memory, the search will continue until the complete memory has been searched. At this time, the highest numbered card key or terminal (depending upon which is being searched for) in the system capability will be displayed. In large systems with many thousands of cards, search operations may be expedited by temporarily disabling the polling option.

Card Key Parameters

The entry sequence

[CARD KEY] [#] [·]

will display all parameters for the card key number entered. When it is desired to locate the next higher card key number having a particular parameter, or group of parameters, the following sequences may be used.

If it is desired to locate the next higher card number having the same parameter, or parameters, as are displayed for the card number entered, it is only necessary to enter the search sequence for the parameter or parameters desired. If the search is to be made for a card number with different parameters, these new parameters should be entered before the search sequence is entered.

1. Next higher card number having displayed time zone:

[NEXT] [TIME ZONE] [.]

2. Next higher card number having displayed access level.

[NEXT] [ACCS/LEVEL] [.]

3. Next higher card number having displayed void/-valid status:

[NEXT] [VOID/VALID] [.]

4. Next higher card number having displayed entry exit status:

[NEXT] [ENTRY EXIT] [.]

5. The search may be made for groupings of parameters. The following entry sequence will search for all four parameters.

[NEXT] [TIMEZONE] [ACCS LEVEL] [VOID/VALID] [ENTRY/EXIT] [.]

TERMINAL PARAMETERS

The entry sequence

[TERM] [#] [.]

will display all parameters for the terminal number entered. When it is desired to locate the next higher terminal number having a particular parameter, or group of parameters, the following sequences may be used.

To locate the next higher terminal number having the same parameter, or parameters, as are displayed for the terminal number entered, it is only necessary to enter the search sequence for the parameter or parameters desired. If the search is to be made for a terminal number with different parameters, these new parameters should be entered before the search sequence is entered.

1. Next higher terminal number having displayed time zone:

[NEXT] [TIME ZONE] [.]

2. Next higher terminal number having displayed void/valid status:

[NEXT] [VOID VALID] [.]

3. Next higher terminal number having displayed time zone and void/valid status:

[NEXT] [TIME ZONE] [VOID VALID] [.]

4. For terminal number displayed, locate next higher access level having some void/valid status as that displayed: (Complete sequence shown.)

[TERM] [#] [.] [ACCS LEVEL] [#] [.] [NEXT] [.]

LIST KEY

The [LIST] key is used to recall specified system parameters from the controller memory and to cause the printer to print out the requested information. (This function is, of course, not usable in systems not having a printer.) The mode switch must be in the program position for listing operations, and, if any system parameters are being displayed, the panel must be cleared by pressing the [CLEAR] key.

LIST ALL TIME ZONES

[TIME ZONE] [LIST]

The entry sequence will list all time zone information in four columns as shown:

| Time Zone | Day of Week | Start Time | Stop Time |
|---|---|---|---|
| 1 | 1 | 00:00 | 00:00 |

The printout starts with the first line (bottom line) showing time zone 1, the first day of week, and the time period covered by time zone 1 on that day. The second line continues with time zone 1, but advances to the second day of week. This continues through day 7, and then the printout changes to time zone 2 and repeats through all seven days of the week. The printout will continue through all eight time zones in this manner.

LIST SEQUENTIAL BLOCK OF CARD KEYS

In this sequence the lowest card number in the block of cards is entered after [CARD KEY] and the highest card number in the block is entered after [TO].

[CARD KEY] [#] [.] [TO] [#] [.] [LIST]

This entry sequence will list all card day information in columns as shown below; in this example for a block of cards from 1 to 8. (For illustrative purposes there are many more variations in parameters shown than would normally occur in a block of eight card keys.)

| Card Key No./Issue | Access Level | Time Zone | Void/ Valid | Entry/ Exit | Code |
|---|---|---|---|---|---|
| 00008.0 | 002 | 4 | | in | K |
| 00007.0 | 002 | 3 | | | K |
| 00006.0 | 003 | 2 | | in | K |
| 00005.0 | 001 | 1 | — | | K |
| 00004.0 | 002 | 2 | | in | K |
| 00003.0 | 001 | 2 | — | | K |
| 00002.0 | 002 | 1 | | in | K |
| 00001.0 | 001 | 1 | | in | K |

The printout will start with the first card number entered and will continue sequentially to the second card number entered. When the card number being printed is void, the printout will be in red and a dash (-) is printed in the void/valid column. With controllers having entry/exit capabilities, the entry exit column will print "in" if that card is in the plant at that moment. (Column is blank if card is out). The code "K" indicates that the information printed is for card keys. (If the controller does not have the entry exit feature, all cards should be programmed as "out" when initially entered into memory. This will avoid misleading "in" printouts.)

Note that at the conclusion of the listing operation the display advances to show the parameters for the next card number higher than the highest card number entered in the block.

SEARCHING BLOCK OF CARDS FOR DESIRED PARAMETERS

A block of card numbers may be searched and a listing made of those cards having the desired parameter or parameters. The following entry sequences will provide these listings. Under each type of entry sequence is shown the printout that would be obtained from the block of eight cards listed above. (Note: All examples show the entry/exit printout as it would appear for the type of listing specified. If the controller does not contain the optional entry/exit feature, this column will be omitted. When this feature is not included, all cards should be initially programmed into the controller as being "out" to prevent misleading "in" indications and printouts.) In the following entry sequences the [#] following [CARD KEY] is the lowest card number in the block of cards, and the [#] following [TO] is the highest card in the block.

1. Cards having the desired access level (Access level 2)

[CARD KEY] [#] [.] [ACCS LEVEL] [#] [.] [NEXT] [ACCS LEVEL] [TO]

[#] [.] [LIST]

| Card Key No./Issue | Access Level | Time Zone | Void/ Valid | Entry/ Exit | Code |
|---|---|---|---|---|---|
| 00008.0 | 002 | 4 | | in | K |
| 00007.0 | 002 | 3 | | | K |
| 00004.0 | 002 | 2 | | in | K |
| 00002.0 | 002 | 1 | | in | K |

2. Cards having the desired time zone (time zone 1):

[CARD KEY] [#] [.] [TIME ZONE] [#] [.] [NEXT] [TIME ZONE] [TO] [#]

[.] [LIST]

| Card Key No./Issue | Access Level | Time Zone | Void/ Valid | Entry/ Exit | Code |
|---|---|---|---|---|---|
| 00005.0 | 001 | 1 | — | | K |
| 00002.0 | 002 | 1 | | in | K |
| 00001.0 | 001 | 1 | | in | K |

3. Void cards in block:

In this entry sequence make certain the void indicator is illuminated before pressing the [NEXT] key (as indicated by the asterisk).

[CARD KEY] [#] [.] * [NEXT] [VOID/VALID] [TO] [#] [.] [LIST]

| Card Key No./Issue | Access Level | Time Zone | Void/ Valid | Entry/ Exit | Code |
|---|---|---|---|---|---|
| 00005.0 | 001 | 1 | — | | K |
| 00003.0 | 001 | 2 | — | | K |

4. Valid cards in block.

Make certain the valid indicator is illuminated before pressing the [NEXT] key.

[CARD KEY] [#] [.] * [NEXT] [VOID/VALID] [TO] [#] [.] [LIST]

| Card Key No./Issue | Access Level | Time Zone | Void/ Valid | Entry/ Exit | Code |
|---|---|---|---|---|---|
| 00008.0 | 002 | 4 | | in | K |
| 00007.0 | 002 | 3 | | | K |
| 00006.0 | 003 | 2 | | in | K |
| 00004.0 | 002 | 2 | | in | K |

-continued

CARD KEY # . * NEXT VOID/VALID TO # . LIST

| Card Key No./Issue | Access Level | Time Zone | Void/ Valid | Entry/ Exit | Code |
|---|---|---|---|---|---|
| 00002.0 | 002 | 1 | | in | K |
| 00001.0 | 001 | 1 | | in | K |

5. Cards in block which are "in-plant".

In this entry sequence make certain the in indicator is illuminated before pressing the NEXT key (as indicated by the @ symbol).

CARD KEY # . ACCS LEVEL # . TIME ZONE # . * at NEXT ACCS LEVEL TIME ZONE VOID/VALID ENTRY/EXIT TO

. LIST

CARD KEY # . at NEXT ENTRY/EXIT TO # . LIST

| Card Key No./Issue | Access Level | Time Zone | Void/ Valid | Entry/ Exit | Code |
|---|---|---|---|---|---|
| 00008.0 | 002 | 4 | | in | K |
| 00006.0 | 003 | 2 | | in | K |
| 00004.0 | 002 | 2 | | in | K |
| 00002.0 | 002 | 1 | | in | K |
| 00001.0 | 001 | 1 | | in | K |

6. All cards in block which are not "in-plant".

Make certain the out indicator is illuminated before pressing the NEXT key.

CARD KEY # . at NEXT ENTRY/EXIT TO # . LIST

| Card Key No./Issue | Access Level | Time Zone | Void/ Valid | Entry/ Exit | Code |
|---|---|---|---|---|---|
| 00007.0 | 002 | 3 | | | K |
| 00005.0 | 001 | 1 | — | | K |
| 00003.0 | 001 | 2 | — | | K |

7. Valid cards in block which are not "in-plant".

Make certain both the valid indicator and the out indicator are illuminated before pressing the NEXT key.

CARD KEY # . * at NEXT VOID/VALID ENTRY/EXIT TO

. LIST

| Card Key No./Issue | Access Level | Time Zone | Void/ Valid | Entry/ Exit | Code |
|---|---|---|---|---|---|
| 00007.0 | 002 | 3 | | | K |

Entry sequence 7, above, is an example of searching a block of card numbers for cards having two desired parameters. If necessary, a block of card numbers can be searched for any combination of parameters. The following entry sequence will search for cards having all four parameters specified and entered. Again, the asterisk and the symbol are reminders to make certain the desired indicators are illuminated before pressing the NEXT key.

LIST SEQUENTIAL GROUP OF TERMINALS

In this sequence the lowest terminal number in the group of terminals is entered after TERM and the highest terminal number in the group is entered after TO.

TERM # . TO # . LIST

This entry sequence will list all terminal information in columns as shown below, in this example for terminals 1 through 8. (For illustrative purposes there are more variations in parameters shown than would normally occur in a group of eight terminals.)

| Term No. | Time Zone | Void/Valid | Code |
|---|---|---|---|
| 008 | 3 | | R |
| 007 | 2 | — | R |
| 006 | 4 | | R |
| 005 | 1 | — | R |
| 004 | 3 | | R |
| 003 | 2 | | R |
| 002 | 1 | | R |
| 001 | 1 | | R |

The printout will start with the first terminal number entered and will continue sequentially to the second terminal number entered. When the terminal number being printed is void, the printout will be in red and a dash (-) is printed in the void/valid column. The code "R" indicates that the information printed is for a reader/terminal.

Note that at the conclusion of the listing operation the displays advance to show the parameters for the next terminal number higher than the last terminal printed in the search.

SEARCHING GROUP OF TERMINALS FOR TIME ZONE, VOID/VALID, OR BOTH

A group of terminal numbers may be searched and a listing made of those terminals having the desired time zone, void/valid status, or both. The following entry sequences will provide these listings. Under each type of entry sequence is shown the printout that would be obtained from the group of eight terminals listed above.

The parameters displayed before pressing the [NEXT] key are the parameters that will be searched for. For example, if time zone 1 is desired and it is displayed when the first terminal number is entered, it is not necessary to enter

[TIME ZONE] [1] [.]

before pressing the

[NEXT] [key].

However, if a time zone different than the one displayed is desired, then the correct time zone entry must be made. The same applies to the void and valid indicators. In the following entry sequences the [#] following [TERM] is the lowest terminal number in the group of terminals, and the [#] following [TO] is the highest terminal number in the group.

1. Searching for terminals with desired time zone (1).

[TERM] [#] [.] [TIME ZONE] [#] [.] [NEXT] [TIME ZONE] [TO] [#] [.] [LIST]

| Term No. | Time Zone | Void/Valid | Code |
|---|---|---|---|
| 005 | 1 | — | R |
| 002 | 1 | | R |
| 001 | 1 | | R |

2. Searching for terminals having a void status.

[TERM] [#] [.] * [NEXT] [VOID/VALID] [TO] [#] [.] [LIST]

In the above entry sequence make certain the void indicator is illuminated (as indicated by the asterisk) before pressing the [NEXT] key.

| Term No. | Time Zone | Void/Valid | Code |
|---|---|---|---|
| 007 | 2 | — | R |
| 005 | 1 | — | R |

3. Searching for terminals having a valid status.

[TERM] [#] [.] * [NEXT] [VOID/VALID] [TO] [#] [.] [LIST]

Make certain the valid indicator is illuminated before pressing the [NEXT] key.

| Term. No. | Time Zone | Void/Valid | Code |
|---|---|---|---|
| 008 | 3 | | R |
| 006 | 4 | | R |
| 004 | 3 | | R |
| 003 | 2 | | R |
| 002 | 1 | | R |
| 001 | 1 | | R |

4. Searching for terminals with desired time zone and void/valid status (Time zone 3, and valid).

TERM # . TIME ZONE # . * NEXT TIME ZONE

VOID/VALID TO # . LIST

| Term No. | Time Zone | Void/Valid | Code |
|---|---|---|---|
| 008 | 3 | | R |
| 004 | 3 | | R |

TERMINAL ACCESS LEVEL LISTINGS

A given terminal may be assigned to as many access levels as may be desired in the installation. Searches for terminal access level information cannot be combined with searches for other parameters.

1. List Group of Access Levels for One Terminal.

TERM # . ACCS LEVEL # . TO ACCS LEVEL # . LIST

The above entry sequence will list all access levels in the group entered, and will show the void/valid status of the terminal number entered for each access level. When the terminal is valid for an access level that line will be printed in black. When the terminal is void for an access level, that line will be printed in red and a dash (-) is printed in the void/valid column. The code "V" indicates that the printout is for a reader/terminal-access level combination. The following example illustrates the printout for terminal 1 and for access levels 1 through 6, with the terminal void in access levels 3 and 5.

| Term No. | Access Level | Void/Valid | Code |
|---|---|---|---|
| 001 | 006 | | V |
| 001 | 005 | — | V |
| 001 | 004 | | V |
| 001 | 003 | — | V |
| 001 | 002 | | V |
| 001 | 001 | | V |

2. List Groups of Terminals for One Access Level.

TERM # . ACCS LEVEL # . TO TERM # . LIST

The above entry sequence will list all terminals in the group entered, and will show the void/valid status of each terminal for the access level entered. The following example illustrates the printout for terminals 1 through 6 for access level 1, and with terminals 2 and 4 void for access level 1.

| Term. No. | Access Level | Void/Valid | Code |
|---|---|---|---|
| 006 | 001 | | V |
| 005 | 001 | | V |
| 004 | 001 | — | V |
| 003 | 001 | | V |
| 002 | 001 | — | V |
| 001 | 001 | | V |

3. List Group of Terminals for Group of Access Levels.

TERM # . ACCS LEVEL # . TO ACCS LEVEL # .

TO TERM # . LIST

This entry sequence will list all terminal numbers in the group entered and, for each terminal number, will list all access levels in the group entered. The validity of each terminal for each access level is indicated by a red printout for void. The following example illustrates the printout for terminals 1 through 3 and for access levels 1 through 3, with all terminals valid for only access levels 1 and 2.

| Term. No. | Access Level | Void/Valid | Code |
|---|---|---|---|
| 003 | 003 | — | V |
| 003 | 002 | | V |
| 003 | 001 | | V |
| 002 | 003 | — | V |
| 002 | 002 | | V |
| 002 | 001 | | V |
| 001 | 003 | — | V |
| 001 | 002 | | V |
| 001 | 001 | | V |

4. List Valid (or Void) Access Levels for One Terminal.

TERM # . ACCS LEVEL # . * NEXT VOID/VALID TO

-continued

ACCS LEVEL # . LIST

This entry sequence will selectively list only the valid (or void) access levels for the terminal number entered. (Make certain the desired validity is indicated before pressing the NEXT key.) Shown below are the printouts that would be obtained for Terminal # 1 from the group of three terminals and three access levels listed in Example 3, above.

A. List Valid Access Levels.

| Term. No. | Access Level | Void/Valid | Code |
|---|---|---|---|
| 001 | 002 | | V |
| 001 | 001 | | V |

B. Listing Void Access Levels.

| Term. No. | Access Level | Void/Valid | Code |
|---|---|---|---|
| 001 | 003 | — | V |

5. List Valid (or Void) Terminals for One Access Level.

TERM # . ACCS LEVEL # . * NEXT VOID/VALID TO

TERM # . LIST

This entry sequence will selectively list only the valid (or void) terminals for the access level entered. (Make certain the desired validity is indicated before pressing the NEXT key.) Shown below are the printouts that would be obtained for the access level shown from the group of three terminals and three access levels listed in Example 3, above.

A. Listing Valid Terminals in Access Level 1.

| Term. No. | Access Level | Void/Valid | Code |
|---|---|---|---|
| 003 | 001 | | V |
| 002 | 001 | | V |
| 001 | 001 | | V |

B. Listing Void Terminals in Access Level 3.

| Term. No. | Access Level | Void/Valid | Code |
|---|---|---|---|
| 003 | 003 | — | V |
| 002 | 003 | — | V |
| 001 | 003 | — | V |

6. List Valid (or Void) Terminals for Group of Access Levels.

TERM # . ACCS LEVEL # . * NEXT VOID/VALID

TO ACCS LEVEL # . TERM # . LIST

This entry sequence will selectively list only the valid (or void) terminals for the group of access levels entered. (Make certain the desired validity is indicated before pressing the NEXT key.) Shown below are the printouts that would be obtained for the group of three terminals and three access levels listed in Example 3, above.

A. Listing Valid Terminals from Group.

| Term. No. | Access Level | Void/Valid | Code |
|---|---|---|---|
| 003 | 002 | | V |
| 003 | 001 | | V |
| 002 | 002 | | V |
| 002 | 001 | | V |
| 001 | 002 | | V |
| 001 | 001 | | V |

B. Listing Void Terminals from Group.

| Term. No. | Access Level | Void/Valid | Code |
|---|---|---|---|
| 003 | 003 | — | V |
| 002 | 003 | — | V |
| 001 | 003 | — | V |

DATA FROM READER/TERMINALS, ALARMS, AND CARD KEYS

During system operation various types of data will be received by the controller from the peripheral equipment. In response, the controller will cause certain types of printouts from the printer, or will produce displays or alarm conditions. These responses are described and illustrated below.

TERMINAL DATA

TERMINAL INOPERATIVE: PRINTOUT

If a terminal becomes inoperative for some reason, the controller will detect the malfunction and will cause a printout in red as in the following example:

| Time | Term./Code |
|---|---|
| 15:15 | 021.1 |

The code 1 indicates that the terminal is inoperative. The terminal number is shown, and also the time that the terminal stopped operating. Additionally, the system fault indicator illuminates to alert the operator to the alarm indication and the audible alarm is sounded, if enabled. These two alarm indictions will remain on until the CLEAR key is depressed.

TERMINAL INOPERATIVE: DISPLAY

When option 5 has been enabled, alarm transactions such as an inoperative terminal will be displayed as they occur. (During alarm displays neither the upper display indicator nor the lower display indicator will illuminate.) The time of day will be shown under card key number "TO", the terminal number will be shown under terminal no., and a "1" will appear under time zone. The "1" is the code number for an inoperative terminal. The following example illustrates this display.

| CARDKEY NUMBER FROM | CARDKEY NUMBER TO | TERMINAL NO. | ACCESS LEVEL | TIME ZONE |
|---|---|---|---|---|
| | 1 3:40 (Time) | 1 6 (Term No.) | | 1 (Code) |

The time shown in the display is the time the terminal became inoperative. The information displayed will remain until it is cleared with the CLEAR key, or is replaced either by keyboard entries, or other incoming data from peripheral equipment. Concurrently with the display, the system fault indicator is illuminated.

TERMINAL ALARM: PRINTOUT

When one of the alarm detectors connected to a reader/ terminal or an alarm monitor detects an alarm condition, a signal to the controller will cause a printout in read as in the following example. In the example Alarm #3 in the terminal produced the alarm signal.

| Time | Term. | Alarms |
|---|---|---|
| 20:52 | 051 | — — 3 — — — |

The above type of printout in read will occur when any alarm detector connected to any reader/terminal or alarm monitor detects an alarm condition. A reader/terminal has four alarm inputs and its alarm signal will appear only in the first four positions. An alarm monitor has eight alarm inputs and its alarm signals can appear in any of the eight positions.

When the alarm condition has been corrected, another printout will be made. This printout will be in the same format but it will show the time the alarm condition was corrected, it will show all eight dashes (no alarms), and the printout will be in black.

Note: As explained in the Interrogator 880 Installation Manual, most alarm detectors are the normally-closed contact type. This type of alarm detector will produce all dashes on the printout when all contacts are closed, When a set of contacts is opened (alarm condition) the number of the alarm detector with the open contacts is printed. If alarm detectors having normally open contacts have been installed (not recommended) the opposite will be true; i.e., all alarm detector numbers will appear when there are no alarm conditions, and a dash will appear in place of a number when an alarm condition is detected.

TERMINAL ALARM: DISPLAY.

When option 5 has been enabled, alarm transactions will be displayed as they occur. (During alarm displays neither the upper display indicator nor the lower display indicator will illuminate.) As illustrated in the following example, the alarm indicators appear under card key number, the terminal number will be shown under terminal no., and a "2" will appear under time zone. The "2" is the code number for an alarm message. In the example alarm detectors 1,2,3, and 4 having been activated.

| CARDKEY NUMBER FROM | CARDKEY NUMBER TO | TERMINAL NO. | ACCESS LEVEL | TIME ZONE |
|---|---|---|---|---|
| | 1 2 3 4 — — — — (Alarm Detector No.) | 1 4 (Term No.) | | 2 (Code) |

The information displayed will remain until it is cleared with the CLEAR key, or is replaced either by keyboard entries or other incoming data from peripheral equipment. Concurrently with the display, the alarm indicator is illuminated and the audible alarm is sounded, if enabled. These two alarm indications will remain on until the CLEAR key is depressed.

When the alarm condition has been corrected, the same information will again be displayed with the exception that the number of the alarm detector causing the alarm condition will be replaced with a dash.

CARD KEY DATA

CARD KEY DATA: PRINTOUT

When a card key is fully inserted into a reader terminal, information is sent to the controller to cause a printout of the transaction. If the card data meets all entrance criteria, the printout will be in black and in the following format.

| Time | Term./Code | Card No./Issue |
|---|---|---|
| 12:05 | 022 | 00126.0 |

If the card key is denied access for some reason, a code number will be printed to the right of the terminal number and the printout will be in red. The following example illustrates this type of printout.

| Time | Term./Code | Card No./Issue |
|---|---|---|
| 14:25 | 031.5. | 00228.0 |

There are seven possible reasons for the card key to be denied access. The seven code numbers and their meanings are as follows:

| Code | Meaning |
|---|---|
| 3 | Reader is void. |
| 4 | Reader time zone is void. |

-continued

| Code | Meaning |
|---|---|
| 5 | Card key number is void. |
| 6 | Card key issue number is void. |
| 7 | Card key time zone is void. |
| 8 | Card key access level is void. |
| 9 | Card key entry/exit status is void. |

CARD KEY DATA: DISPLAY

When option 6 has been enabled, card key transactions will be displayed as they occur. (Neither the upper display indicator nor the lower display indicator will be illuminated.) The following example illustrates the display for a card key that has met all entrance criteria and has been granted access. The letter "A" under time zone indicates that access has been granted.

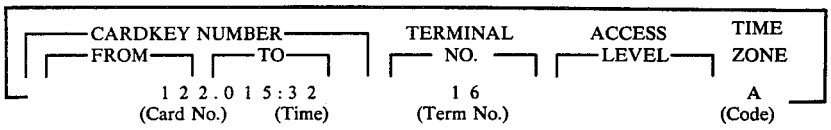

When a card key is not granted access, the same information will be displayed with the exception that a code number will appear under time zone in place of the "A". The code number will indicate the reason for denying access, as described in the preceding paragraph. The void request indicator will illuminate and the audible alarm will sound, if enabled. They will remain on until the CLEAR key is depressed.

We claim:

1. An access control system responsive to an access signal comprising:

a central processing unit, at least one card reader terminal, said card reader terminal comprising at least one first signal generating means for transmitting a first signal responsive to the presence of a proper first code on a card key; said first signal enabling at least one reading means for reading and transmitting to said CPU a second signal, said second signal corresponding to a second code on said card key, said CPU having access signal transmitting means for transmitting an access signal responsive to receipt by said CPU of said second signal.

2. The access control system of claim 1 in which said central processor unit comprises a microprocessor, said microprocessor having means for storing information corresponding to the second signal translated by said terminal reader representing the second code of said card key; said microprocessor having means for storing information relating to predetermined conditions associated with said second electrical signal, and means for providing an access signal for permitting access to the area upon the presence of proper conditions.

3. The access control system of claim 2 in which said first signal generator means comprises a programmable lock, said programmable lock permitting transmission of said first signal upon the presence of said proper first code.

4. The access control system of claim 1 in which said central processor unit comprises a microprocessor, said microprocessor having means for storing information corresponding to the electrical signal generated by said terminal reader representing the second code of said card key; said microprocessor having means for storing information relating to predetermined conditions associated with said first electrical signal, and means for providing a second electrical signal for permitting access to the area upon proper conditions.

5. The access control system of claim 2 in which a proper condition comprises said second electrical signal being transmitted to said central processing unit during a predetermined time period.

6. The access control system of claim 2 in which there are a plurality of card reader terminals each of said reader terminals having a unique address for providing a signal to said central processor unit corresponding to its address.

7. The access control system of claim 2 in which a proper condition comprises said second signal being transmitted from at least one proper address.

8. The access control system of claim 7 in which said first signal may be transmitted from a plurality of addresses.

9. An access control system comprising:

(a) a card key, said card key magnetized in a predetermined pattern so as to form at least a first code and a second code;

(b) a terminal reader, said terminal reader comprising at least one lock means, said lock means responsive to said first code on said card key, to enable at least one reader means for reading said second code and transmitting a first electrical signal corresponding to said second code;

(c) A central processor unit for receiving said first electrical signal transmitted from said reader and transmitting a second electrical signal for activating a switch permitting access when said first electrical signal meets the conditions present in said second central processor unit.

10. The access control system of claim 7 in which said first code of said card key comprises at least two subcodes.

11. The access control system of claim 9 in which said central processor unit comprises a microprocessor, said microprocessor having means for storing information corresponding to each of said second codes on said card key, said information determining whether said central processor unit will transmit said second electrical signal so as to permit access.

12. The access control system of claim 9 in which said information stored by said central processing unit comprises the address of said terminal for which said card key is proper.

13. The access control system of claim 9 in which said information stored by said central processing unit comprises the real time during which said card key is proper.

14. The access control system of claim 5 in which said microprocessor includes a clock for maintaining real time, said clock powered by a battery power supply in the absence of sufficient power being provided by a first electrical power supply.

15. The access control system of claim 6 in which said central processor unit has means for sampling a plurality of terminal readers, said terminal readers transmitting said signal to said central processor corresponding to its address during the time said terminal is sampled.

16. The access control system of claim 15 in which said address signal transmitted to said central processor unit is partially stored in the microprocessor during each sampling cycle of the terminal.

17. The access control system of claim 16 in which said address signal transmitted to said central processor unit is partially stored in the microprocessor during each sampling cycle of the terminal.

18. The access control system of claim 11 in which at least one of said terminal readers is accessible from within the facility only after access to the area, said microprocessor preventing access to a cardholder until after said card has been placed in said terminal reader within said facility.

19. The access control system of claim 11 in which said microprocessor prevents access by use of the same card key until information stored in said microprocessor indicates said card key has been inserted within at least one terminal reader having a selected address.

20. The access control system of claim 15 in which said electrical signal sampled during the first sampling cycle is compared by said central processor unit with the electrical signal sampled during a second sampling cycle of the same terminal, said central processor unit not permitting access if said first sampled signal is not identical with the electrical signal sampled during said second sampling cycle.

21. The access control system of claim 20 in which said central processor indicates an alarm in the event more than two consecutive sampling cycles of said terminal reader transmits different addresses.

22. The access control system of claim 2 in which a proper condition comprises the real time and the address of said reader terminal status.

23. In the access control system of claim 2 in which said proper condition comprises the real time, the location of the terminal reader, whether the card key has been used to gain access and whether said code is valid for access.

* * * * *